US012492835B2

(12) United States Patent
Delgoshaei et al.

(10) Patent No.: US 12,492,835 B2
(45) Date of Patent: Dec. 9, 2025

(54) DIAGNOSTICS OF OUTDOOR UNIT OF HVAC SYSTEM BASED ON SOUND SIGNATURES

(71) Applicant: Lennox Industries Inc., Richardson, TX (US)

(72) Inventors: Payam Delgoshaei, Addison, TX (US); Sridhar Venkatesh, Irving, TX (US); Eric Berg, The Colony, TX (US)

(73) Assignee: Lennox Industries Inc., Richardson, TX (US)

( * ) Notice: Subject to any disclaimer, the term of this patent is extended or adjusted under 35 U.S.C. 154(b) by 429 days.

(21) Appl. No.: 18/299,482

(22) Filed: Apr. 12, 2023

(65) Prior Publication Data

US 2024/0344729 A1 Oct. 17, 2024

(51) Int. Cl.

| | |
|---|---|
| ***F24F 11/38*** | (2018.01) |
| ***F24F 11/49*** | (2018.01) |
| ***F24F 11/52*** | (2018.01) |
| *F24F 140/00* | (2018.01) |

(52) U.S. Cl.

CPC ..... *F24F 11/38* (2018.01); *F24F 11/49* (2018.01); *F24F 11/52* (2018.01); *F24F 2140/00* (2018.01)

(58) Field of Classification Search

CPC .. F24F 11/30; F24F 11/32; F24F 11/38; F24F 11/39; F24F 11/48; F24F 11/49; F24F 11/52; F24F 11/526; F24F 11/56; F24F 11/57; F24F 11/58; F24F 11/64; F24F 11/67

USPC ..... 700/276

See application file for complete search history.

(56) References Cited

U.S. PATENT DOCUMENTS

| | | | | |
|---|---|---|---|---|
| 11,521,438 | B2 * | 12/2022 | Kim | G06F 16/65 |
| 11,573,022 | B2 * | 2/2023 | Delgoshaei | F24F 11/38 |
| 12,222,117 | B2 * | 2/2025 | Delgoshaei | F24F 11/38 |
| 2024/0271814 | A1 * | 8/2024 | Knieser | F24F 11/30 |
| 2024/0344727 | A1 * | 10/2024 | Delgoshaei | F24F 11/38 |
| 2024/0344728 | A1 * | 10/2024 | Delgoshaei | F24F 11/64 |

OTHER PUBLICATIONS

U.S. Appl. No. 18/299,257, filed Apr. 12, 2023.
U.S. Appl. No. 18/299,302, filed Apr. 12, 2023.

* cited by examiner

*Primary Examiner* — Crystal J Barnes-Bullock
(74) *Attorney, Agent, or Firm* — Baker Botts L.L.P.

(57) ABSTRACT

A method for heating, ventilation, and air conditioning (HVAC) system diagnostics includes sending a first instruction to a thermostat to shut down an HVAC system. A user is instructed to minimize background noise. A second instruction is sent to the thermostat to turn on the HVAC system. A third instruction is sent to the thermostat to set a temperature setpoint below or above a value of a room temperature. Outdoor unit sound data is captured for a second time period. The baseline sound data is subtracted from the outdoor unit sound data to determine normalized outdoor unit sound data. Expected sound signatures of the outdoor unit are identified. The normalized outdoor unit sound data is compared to the expected sound signatures. In response to determining that an expected sound signature for a compressor is missing from the normalized outdoor unit sound data, it is determined that the compressor has failed.

20 Claims, 25 Drawing Sheets

DIAGNOSTICS OF OUTDOOR UNIT OF HVAC SYSTEM BASED ON SOUND SIGNATURES

TECHNICAL FIELD

The present disclosure relates generally to Heating, Ventilation, and Air Conditioning (HVAC) system control, and more specifically to sound-based diagnostics of an outdoor unit of an HVAC system.

BACKGROUND

Existing heating, ventilation, and air conditioning (HVAC) systems typically can only provide a general alert when there is an issue with an HVAC system. For example, the HVAC system may report that an error has occurred while trying to operate the HVAC system and that a service is required to repair the HVAC system. Existing HVAC systems cannot typically self-diagnose any issues with the HVAC system. This means that a technician will need to inspect the HVAC system and make repairs to the HVAC system. In many instances, a technician will need to make multiple trips to a location to first diagnose the issue with an HVAC system and then to return with the appropriate parts and tools for servicing the HVAC system. This process results in an extended amount of downtime while the technician diagnoses and makes repairs to the HVAC system.

SUMMARY

The system disclosed in the present application provides a technical solution to the technical problems discussed above by providing a visual- and sound-based HVAC diagnostic system that is configured to detect faults and issues within an HVAC system based on sounds made by the components of the HVAC system and detect faults and issues within a filter of an HVAC system based on images of the filter. The disclosed system provides several practical applications and technical advantages which include a process that enables a user of an HVAC system to diagnose faults within the HVAC system and to output information that identifies any faulty components of the HVAC system. These features reduce the amount of downtime that an HVAC system will experience because the HVAC system is able to identify the components that are causing the issues that the HVAC system is experiencing. This process allows the user to provide diagnostic information to a technician, such that the technician is prepared with all of the necessary equipment (i.e., parts and tools) and instructions for servicing the HVAC system without having to first diagnose the HVAC system themselves.

In one embodiment, a system includes a thermostat communicatively coupled to a heating, ventilation, and air conditioning (HVAC) system, and a user device communicatively coupled to the thermostat. The user device includes a first processor configured to determine if a triggering event has occurred. In response to determining that the triggering event has occurred, the first processor enters a filter diagnostics mode. The first processor sends a first instruction to the thermostat to shut down the HVAC system. The first processor instructs a user of the user device to locate a filter of the HVAC system. The first processor instructs the user to remove the filter. The first processor classifies the filter as acceptable or dirty. In response to classifying the filter as acceptable, the first processor instructs the user to the turn on the HVAC system. The first processor determines a desired mode of the HVAC system based on the triggering event. In response to determining that the desired mode is a cooling mode, The first processor determines a first value of a room temperature. The first processor instructs the user to set a temperature setpoint below the first value of the room temperature. The first processor determines a second value of the room temperature. The first processor compares the first value of the room temperature to the second value of the room temperature. In response to determining that the second value of the room temperature is less than the first value of the room temperature, The first processor determines that the HVAC system operates properly.

In another embodiment, a system includes a thermostat communicatively coupled to a heating, ventilation, and air conditioning (HVAC) system, a user device communicatively coupled to the thermostat, and a computing system communicatively coupled to the user device. The user device includes a first processor configured to send a first instruction to the thermostat to shut down the HVAC system. The first processor instructs a user to minimize background noise. The first processor instructs the user to go to an indoor unit of the HVAC system. The first processor instructs the user to capture an image of a nameplate of the indoor unit. The first processor analyzes the image to determine a distance of the user from the indoor unit. The first processor compares the distance to a distance range. In response to determining that the distance is within the distance range, the first processor captures baseline sound data for a first time period. The first processor sends a second instruction to the thermostat to turn on the HVAC system. The first processor determines a value of a room temperature. The first processor sends a third instruction to the thermostat to set a temperature setpoint below or above the value of the room temperature. The first processor captures an indoor unit sound data for a second time period. The first processor sends the indoor unit sound data and the baseline sound data to the computing system. The computing system includes a second processor configured to subtract the baseline sound data from the indoor unit sound data to determine normalized indoor unit sound data. The second processor analyze the normalized indoor unit sound data to determine sound signatures. The second processor identifies expected sound signatures of the indoor unit. The second processor compares the normalized indoor unit sound data to the expected sound signatures. In response to determining that an expected sound signature for a blower is missing from the normalized indoor unit sound data, The second processor determines that the blower has failed. The second processor sends a first notification to the user device that the blower has failed.

In yet another embodiment, a system includes a thermostat communicatively coupled to a heating, ventilation, and air conditioning (HVAC) system, a user device communicatively coupled to the thermostat, and a computing system communicatively coupled to the user device. The user device includes a first processor configured to send a first instruction to the thermostat to shut down the HVAC system. The first processor instructs a user to minimize background noise. The first processor instructs the user to go to an outdoor unit of the HVAC system. The first processor instructs the user to capture an image of a nameplate of the outdoor unit. The first processor analyzes the image to determine a distance of the user from the outdoor unit. The first processor compares the distance to a distance range. In response to determining that the distance is within the distance range, the first processor captures baseline sound data for a first time period. The first processor sends a second instruction to the thermostat to turn on the HVAC system. The first processor determines a value of a room temperature. The first processor sends a third instruction to the thermostat to set a temperature setpoint below or above the value of the room temperature. The first processor captures first outdoor unit sound data for a second time period. The first processor sends the first outdoor unit sound data and the baseline sound data to the computing system. The computing system includes a second processor configured to subtract the baseline sound data from the first outdoor unit sound data to determine first normalized outdoor unit sound data. The second processor analyzes the first normalized outdoor unit sound data to determine first sound signatures. The second processor identifies expected first sound signatures of the outdoor unit. The second processor compares the first normalized outdoor unit sound data to the expected first sound signatures. In response to determining that an expected sound signature for a compressor is missing from the first normalized outdoor unit sound data, the second processor determines that the compressor has failed. The second processor sends a first notification to the user device that the compressor has failed.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

System Overview

Figure 1:
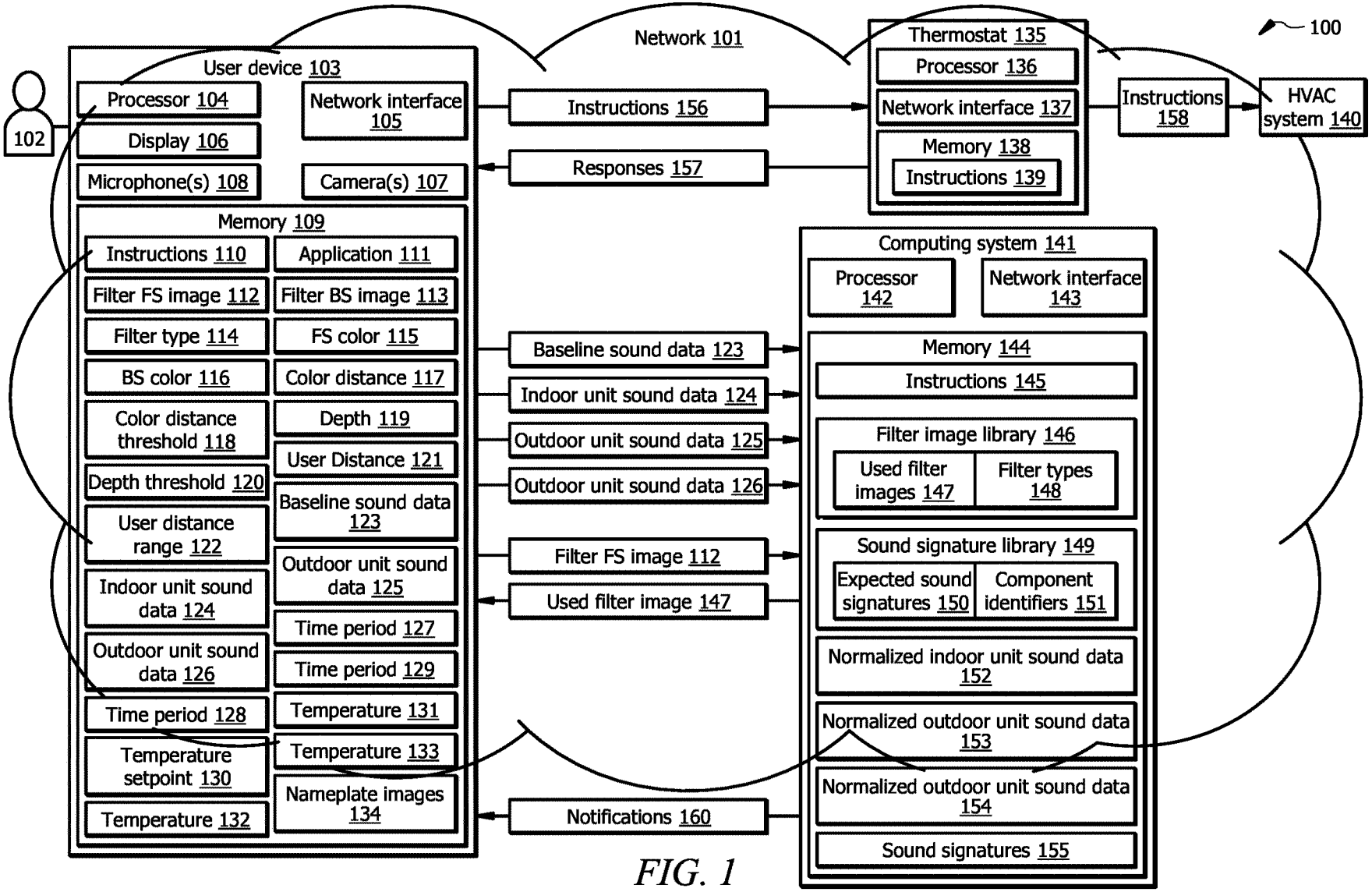
FIG. 1 is a schematic diagram of an embodiment of a diagnostic system for an HVAC system.

FIG. 1 is a schematic diagram of an embodiment of a diagnostic system 100 for a heating, ventilation, and air conditioning (HVAC) system 140. In one embodiment, the diagnostic system 100 comprises a user device 103, a thermostat 135, a computing system 141, and the HVAC system 140 that are in signal communication with each other over a network 101. Network 101 enables the communication between the components of the diagnostic system 100. In other embodiments, the diagnostic system 100 may not have all the components listed and/or may have other elements instead of, or in addition to, those listed above. For example, functionalities of the computing system 141 may be fully or partially integrated into the user device 103. For another example, functionalities of the computing system 141 may be fully or partially integrated into the thermostat 135.

In general, the diagnostic system 100 is configured to use visual and sound data for detecting and diagnosing faults within the HVAC system 140. More specifically, the analysis system 100 is configured to diagnose various faults within the HVAC system 140 and to notify a user 102 that one or more components of the HVAC system have failed or are malfunctioning. The user 102 may provide this information to a technician. These features reduce the amount of downtime that the HVAC system 140 will experience because the diagnostic system is able to output information about the components that are causing the issues that the HVAC system 140 is experiencing. This process allows the technician to be prepared with all of the necessary equipment (i.e., parts and tools) and instructions for servicing the HVAC system 140 without having to first diagnose the HVAC system 140 themselves.

System Components

Network

The network 101 may be any suitable type of wireless and/or wired network including, but not limited to, all or a portion of the Internet, an Intranet, a private network, a public network, a peer-to-peer network, the public switched telephone network, a cellular network, a local area network (LAN), a metropolitan area network (MAN), a personal area network (PAN), a wide area network (WAN), and a satellite network. The network 101 may be configured to support any suitable type of communication protocol as would be appreciated by one of ordinary skill in the art.

User Device

The user device 103 is generally any device that is configured to process data and interact with the user 102. Examples of the user device 103 include, but are not limited to, a personal computer, a desktop computer, a workstation, a server, a laptop, a tablet computer, a mobile phone (such as a smartphone), etc. The user device 103 may include a user interface, such as a display 106, one or more cameras 107, one or more microphones 108, keypad, or other appropriate terminal equipment usable by the user 102.

The user device 103 may comprise a processor 104 in signal communication with a memory 109 and a network interface 105. The processor 104 comprises one or more processors operably coupled to the memory 109. The processor 104 is any electronic circuitry including, but not limited to, state machines, one or more central processing unit (CPU) chips, logic units, cores (e.g., a multi-core processor), field-programmable gate array (FPGAs), application-specific integrated circuits (ASICs), or digital signal processors (DSPs). The processor 104 may be a programmable logic device, a microcontroller, a microprocessor, or any suitable combination of the preceding. The processor 104 is communicatively coupled to and in signal communication with the memory 109, a display 106, one or more cameras 107, one or more microphones 108, and the network interface 105. The one or more processors are configured to process data and may be implemented in hardware or software. For example, the processor 104 may be 8-bit, 16-bit, 32-bit, 64-bit, or of any other suitable architecture. The processor 104 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components.

The one or more processors are configured to implement various instructions. For example, the one or more processors are configured to execute instructions 110 to implement various functions of the user device 103. The one or more processors are configured to execute an application 111 to implement a diagnostic process described in this disclosure. In this way, processor 104 may be a special-purpose computer designed to implement the functions disclosed herein. The processor 104, when executing the application 111, is configured to operate as described in FIGS. 1, 2, and 10-16. For example, the processor 104, when executing the application 111, may be configured to perform operations of processes 1000-1600 as described in FIGS. 10-16, respectively.

The network interface 105 is configured to enable wired and/or wireless communications. The network interface 105 is configured to communicate data between the user device 103 and other components of the diagnostic system 100. For example, the network interface 105 may comprise an NFC interface, a Bluetooth interface, a Zigbee interface, a Z-wave interface, an RFID interface, a WIFI interface, a LAN interface, a WAN interface, a PAN interface, a modem, a switch, or a router. The processor 104 is configured to send and receive data using the network interface 105. The network interface 105 may be configured to use any suitable type of communication protocol as would be appreciated by one of ordinary skill in the art.

The memory 109 comprises one or more disks, tape drives, or solid-state drives, and may be used as an over-flow data storage device, to store programs when such programs are selected for execution, and to store instructions and data that are read during program execution. The memory 109 may be volatile or non-volatile and may comprise a read-only memory (ROM), random-access memory (RAM), ternary content-addressable memory (TCAM), dynamic random-access memory (DRAM), and static random-access memory (SRAM).

The memory 109 is operable to store any of the information described herein with respect to FIGS. 1, 2, 10-12, 13A, 13B, 14A, 14B, 15A-15C, and 16A-16E along with any other data, instructions, logic, rules, or code operable to implement the function(s) described herein when executed by the processor 104. The memory 109 is operable to store the instructions 110, the application 111, and/or any other data or instructions that is used by the processor 104 to perform the function(s) of the user device 103 described herein. The instructions 110 may comprise any suitable set of instructions, logic, rules, or code operable to implement the function(s) of the user device 103 when executed by the processor 104. The application 111 may comprise any suitable set of instructions, logic, rules, or code operable to implement a diagnostic process when executed by the processor 104.

The user device 103 may comprise one or more microphones 108. The microphones 108 are generally configured to record the sounds that are made by electrical and mechanical components of the HVAC system 140. For example, a microphone 108 may be positioned proximate or adjacent to a blower, an integrated furnace control board, a relay, a compressor, a gas valve, a furnace, a fan, or any other component of the HVAC system 140. Each microphone is configured to capture sound data of one or more components of the HVAC system 140. The microphones 108 may be configured to capture sound data continuously, at predetermined intervals, or on-demand. Each microphone 108 is operably coupled to the processor 104 and provides captured sound data to the processor 104 for processing.

The user device 103 may comprise a display 106. The display 106 is a graphical user interface that is configured to present visual information to the user 102 using graphical objects. Examples of the display 106 include, but are not limited to, a liquid crystal display (LCD), a liquid crystal on silicon (LCOS) display, a light-emitting diode (LED) display, an active-matrix OLED (AMOLED), an organic LED (OLED) display, a projector display, or any other suitable type of display as would be appreciated by one of ordinary skill in the art.

The user device 103 may comprise one or more cameras 107. The cameras may be configured to captures images of various components of the HVAC system 104, such as a filter, a nameplate, or any other component of the HVAC system 140. The cameras 107 are operably coupled to the processor 104 and provide captured images to the processor 104 for processing.

In operation, the user device 103 is configured to capture sound data (e.g., indoor unit sound data 124) of one or more indoor units (e.g., indoor unit 202 of FIG. 2) of the HVAC system 140 in various modes, such as cooling mode and heating mode (including a heat pump heating mode and a supplemental heating mode). The user device 103 is further configured to capture sound data (e.g., outdoor unit sound data 125) of an outdoor unit (e.g., outdoor unit 204 of FIG. 2) of the HVAC system 140 is various modes, such as a cooling mode and heating mode (including a heat pump heating mode and a supplemental heating mode). The user device 103 is further configured to send the captured sound data to the computing system 141 for further analysis.

Figure 2:
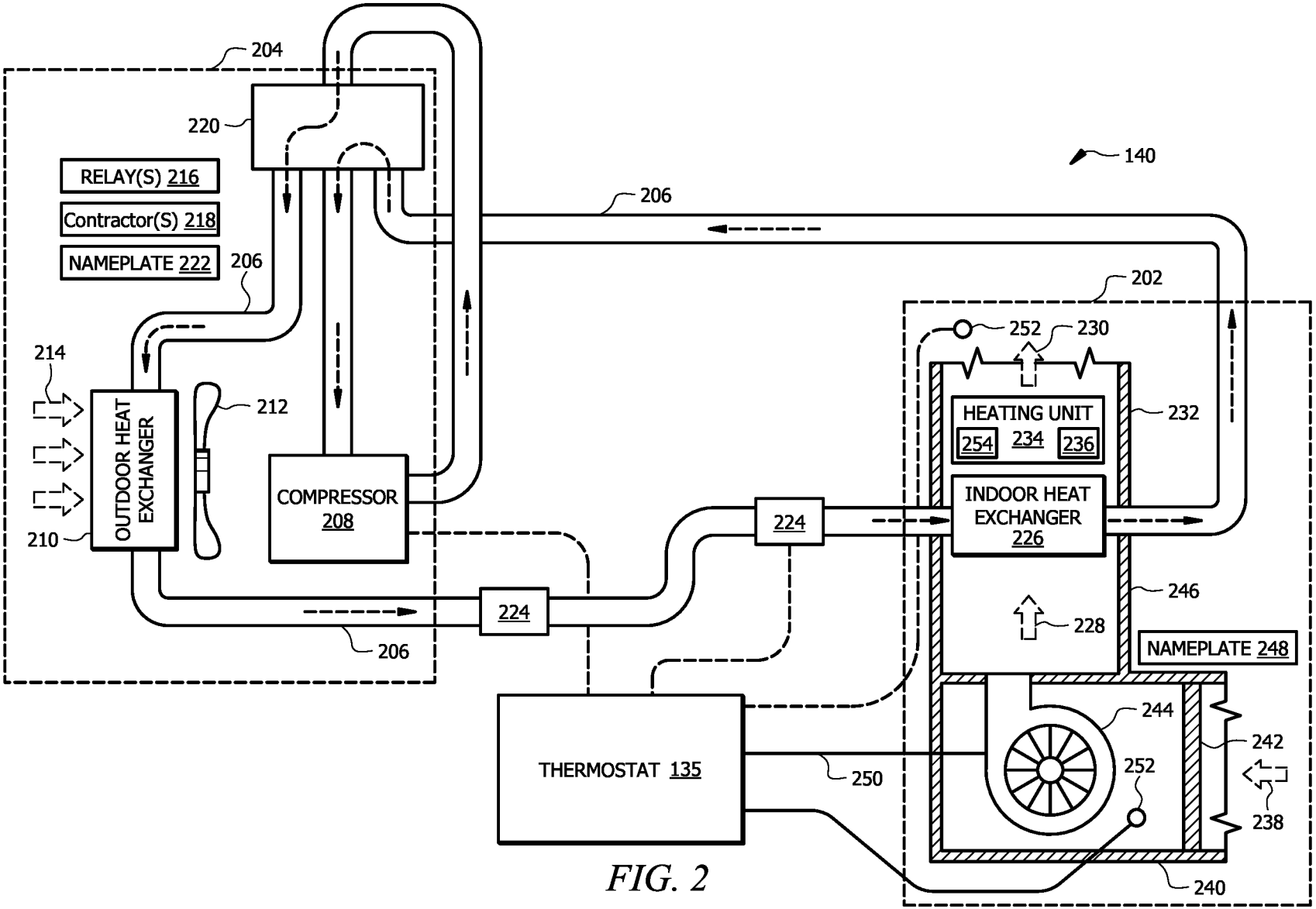
FIG. 2 is a schematic diagram of an embodiment of an HVAC system configured to integrate with the diagnostic system.

The user device 103 is configured capture images (e.g., images 112 and 113) of a front side and a back side of a filter (e.g., filter 242 of FIG. 2). The captured images are then analyzed to classify the filter as acceptable or dirty.

The user device 103 may be further configured exchange various instructions (e.g., instructions 156) and responses (e.g., responses 157) with the thermostat 135 and receive various notifications (e.g., notifications 160) from the computing system 141. In one embodiment, the user device 103 may receive a notification that the indoor unit 202 of the HVAC system 140 operates properly. In another embodiment, the user device 103 may receive a notification that the outdoor unit 204 of the HVAC system 140 operates properly. In yet another embodiment, the user device 103 may receive a notification that a component of HVAC system 140 has failed or is malfunctioning.

Thermostat

The thermostat 135 is generally configured to control various operations of the HVAC system 140. In one embodiment, the thermostat 135 comprises a processor 136 in signal communication with a memory 138 and a network interface 137. The thermostat 135 may further comprise a graphical user interface, a display, a touch screen, buttons, knobs, or any other suitable combination of components.

The processor 136 may be similar to the processor 104 and the description is not repeated herein. The processor 136 is configured to implement various instructions. For example, the processor 136 is configured to execute instructions 139 to implement various functions of the thermostat 135.

The network interface 137 may be similar to the network interface 105 and the description is not repeated herein. The network interface 137 is configured to enable wired and/or wireless communications. The network interface 137 is configured to communicate data between the thermostat 135 and other components of the diagnostic system 100.

The memory 138 may be similar to the memory 109 and the description is not repeated herein. The memory 138 is operable to store any of the information described herein with respect to FIGS. 1, 2, 10-12, 13A, 13B, 14A, 14B, 15A-15C, and 16A-16E along with any other data, instructions, logic, rules, or code operable to implement the function(s) described herein when executed by the processor 136. The memory 138 is operable to store the instructions 139, and/or any other data or instructions that is used by the processor 136 to perform the function(s) of the thermostat 135 described herein. The instructions 139 may comprise any suitable set of instructions, logic, rules, or code operable to implement the function(s) of the thermostat 135 when executed by the processor 136.

In operation, the thermostat 135 is configured to exchange various instructions (e.g., instructions 156) and responses (e.g., responses 157) with the user device 103. The thermostat 135 is configured to send various instructions (e.g., instructions 158) to the HVAC system 140 to control various operations of the HVAC system 140.

Computing System

The computing system 141 may be a remote computing system or a cloud computing system. In one embodiment, the computing system 141 comprises a processor 142 in signal communication with a memory 144 and a network interface 143. The processor 142 may be similar to the processor 104 and the description is not repeated herein. The processor 142 is configured to implement various instructions. For example, the processor 142 is configured to execute instructions 145 to implement various functions of the computing system 141 described herein.

The network interface 143 may be similar to the network interface 105 and the description is not repeated herein. The network interface 143 is configured to enable wired and/or wireless communications. The network interface 143 is configured to communicate data between the computing system 141 and other components of the analysis system 100.

The memory 144 may be similar to the memory 109 and the description is not repeated herein. The memory 144 is operable to store any of the information described herein with respect to FIGS. 1, 2, 10-12, 13A, 13B, 14A, 14B, 15A-15C, and 16A-16E along with any other data, instructions, logic, rules, or code operable to implement the function(s) described herein when executed by the processor 142. The memory 144 is operable to store the instructions 145, a filter image library 146, a sound signature library 149, and/or any other data or instructions that is used by the processor 142 to perform the function(s) of the computing system 141 described herein. The instructions 145 may comprise any suitable set of instructions, logic, rules, or code operable to implement the function(s) of the computing system 141 when executed by the processor 142. The filter image library 146 may comprise used filter images 147 for various filter types 148. The sound signature library 149 comprises expected sound signatures 150 for various components of the HVAC system 140 linked to respective component identifiers 151. The component identifier 151 may be a part name, a part number, a serial number, a model number, a barcode, or any other suitable type of alphanumeric identifier that uniquely identifies a component of the HVAC system 140.

In operation, the computing system 141 is configured to receive various sound data (e.g., sound data 124-126) from the user device 103. The computing system 141 analyzes the received sound data and determines if a component of the HVAC system 140 is malfunctioning or has failed. In an embodiment, the computing system 141 identifies sound signatures (e.g., expected sound signatures 150) that are expected to be present in the received sound data and compares them to the received sound data. If an expected sound signature of a component of the HVAC system 140 is not present in the received sound data, the computing system 141 determines that the component has failed. If a sound signature of a component of the HVAC system 140 is different from the expected sound signature of the component, the computing system 141 determines that the component is malfunctioning.

HVAC System

An HVAC system 140 is generally configured to control the temperature of a space. Examples of the space include, but are not limited to, a room, a home, an apartment, a mall, an office, a warehouse, or a building. Although FIG. 1 illustrates a single HVAC system 140, a location or space may comprise a plurality of HVAC systems 140 that are configured to work together. For example, a large building may comprise multiple HVAC systems 140 that work cooperatively to control the temperature within the building.

FIG. 2 is a schematic diagram of an embodiment of an HVAC system 140 configured to integrate with a diagnostic system 100. The HVAC system 140 conditions air for delivery to an interior space of a building or home. In some embodiments, a portion of the HVAC system 140 may be located within the building and may be referred to as an indoor unit 202, and a portion of the HVAC system 140 may be located outside the building and may be referred to as an outdoor unit 204. In other embodiments, the HVAC system 140 is a rooftop unit (RTU) that is positioned on the roof of a building and the conditioned air is delivered to the interior of the building. The HVAC system 140 may be configured as shown in FIG. 2 or in any other suitable configuration. For example, the HVAC system 140 may include additional components or may omit one or more components shown in FIG. 2.

The HVAC system 140 comprises a working-fluid conduit subsystem 206 for moving a working fluid, or refrigerant. The working fluid may be any acceptable working fluid, or refrigerant, including, but not limited to, fluorocarbons (e.g., chlorofluorocarbons), ammonia, non-halogenated hydrocarbons (e.g., propane), hydrofluorocarbons (e.g., R-410A), or any other suitable type of refrigerant.

The HVAC system 140 comprises one or more outdoor units 204. The outdoor units 204 may be also referred to as condensing units. In one embodiment, the outdoor unit 204 comprises a compressor 208, an outdoor heat exchanger 210, and a fan 212. The compressor 208 is coupled to the working-fluid conduit subsystem 206 that compresses the working fluid. The outdoor unit 204 may be configured with a single-stage or multi-stage compressor 208. A single-stage compressor 208 is configured to operate at a constant speed to increase the pressure of the working fluid to keep the working fluid moving along the working-fluid conduit subsystem 206. A multi-stage compressor 208 may comprise multiple compressors or a single compressor with multiple internal stages and may be configured to operate at a constant speed to increase the pressure of the working fluid to keep the working fluid moving along the working-fluid conduit subsystem 206. In this configuration, one or more compressors can be turned on or off to adjust the cooling/heating capacity of the HVAC system 140. In some embodiments, the compressor 208 may be configured to operate at multiple speeds or as a variable speed compressor. For example, the compressor 208 may be configured to operate at multiple predetermined speeds.

In one embodiment, the outdoor unit 204 (e.g., the compressor 208) is in signal communication with a controller or thermostat 135 using a wired or wireless connection. The thermostat 135 is configured to provide commands, instructions, or signals to control the operation of the compressor 208. For example, the thermostat 135 is configured to send signals to turn on or off one or more compressors 208 when the outdoor unit 204 comprises a multi-stage compressor 208. In this configuration, the thermostat 135 may operate the multi-stage compressors 208 in a first mode where all the compressors 208 are on and a second mode where at least one of the compressors 208 is off. In some examples, the thermostat 135 may be configured to control the speed of the compressor 208.

The outdoor heat exchanger 210 is configured to assist with moving the working fluid through the working-fluid conduit subsystem 206. The outdoor heat exchanger 210 is located downstream of the compressor 208 for exchanging heat. The fan 212 is configured to move air 214 across the outdoor heat exchanger 210. For example, the fan 212 may be configured to blow outside air through the heat exchanger to help cool the working fluid. The compressed, cooled working fluid flows downstream from the outdoor heat exchanger 210 to one or more expansion devices 224, or metering devices, and subsequently to the indoor unit 202.

The outdoor unit 204 may also comprises one or more relays 216 and one or more contactors 218 that are configured to provide power to the compressor 208 and the fan 212 based on instructions received from the thermostat 135.

In certain embodiments, the HVAC system 140 may be configured to operate in a heat pump heating mode. In such embodiments, the outdoor unit 204 may further comprise a reversing valve 220 that is configured to reverse a flow of the working fluid through the working-fluid conduit subsystem 206. In the heat pump heating mode, the heated working fluid flows downstream from the indoor unit 202 to the one or more expansion devices 224, and subsequently to the outdoor heat exchanger 210.

The expansion device 224 is configured to remove pressure from the working fluid. The expansion device 224 is coupled to the working-fluid conduit subsystem 206 downstream of the outdoor heat exchanger 210. The expansion device 224 is closely associated with an indoor heat exchanger 226. The expansion device 224 is coupled to the working-fluid conduit subsystem 206 downstream of the outdoor heat exchanger 210 for removing pressure from the working fluid. In this way, the working fluid is delivered to the indoor heat exchanger 226 and receives heat from airflow 228 to produce a treated airflow 230 that is delivered by a duct sub-system 232 to the desired space, for example, a room in the building.

The indoor unit 202 of the HVAC system 140 is configured to move air across the indoor heat exchanger 226 and/or a heating unit 234 and out of the duct sub-system 232. The heating unit 234 may be also referred to as a supplemental heating unit or an emergency heating unit. The heating unit 234 may comprise one or more relays 236 that are configured to provide power to the heating unit 234 based on instructions received from the thermostat 135. The heating unit 234 may also include one or more heating elements 254. The heating elements 254 may be also referred to as supplemental heating elements.

Return air 238, which may be air returning from the building, fresh air from outside, or some combination, is pulled into a return duct 240 through a filter 242. A suction side of a variable-speed blower 244 pulls the return air 238. The variable-speed blower 244 discharges airflow 228 into a duct 246 from where the airflow 228 crosses the indoor heat exchanger 226 or heating unit 234 to produce the treated airflow 230.

Examples of a variable-speed blower 244 include, but are not limited to, belt-drive blowers controlled by inverters, direct-drive blowers with electronically commutated motors (ECM), or any other suitable types of blowers. In some configurations, the variable-speed blower 244 is configured to operate at multiple predetermined fan speeds. In other configurations, the fan speed of the variable-speed blower 244 can vary dynamically based on a corresponding temperature value instead of relying on using predetermined fan speeds. In other words, the variable-speed blower 244 may be configured to dynamically adjust its fan speed over a range of fan speeds rather than using a set of predetermined fan speeds. This feature also allows the thermostat 135 to gradually transition the speed of the variable-speed blower 244 between different operating speeds. This contrasts with conventional configurations where a variable-speed blower 244 is abruptly switched between different predetermined fan speeds. The variable-speed blower 244 is in signal communication with the thermostat 135 using any suitable type of wired or wireless connection 250. The thermostat 135 is configured to provide commands or signals to the variable-speed blower 244 to control the operation of the variable-speed blower 244. For example, the thermostat 135 is configured to send signals to the variable-speed blower 244 to control the fan speed of the variable-speed blower 244. In some embodiments, the thermostat 135 may be configured to send other commands or signals to the variable-speed blower 244 to control any other functionality of the variable-speed blower 244.

The HVAC system 140 comprises one or more sensors 252 in signal communication with the thermostat 135. The sensors 252 may comprise any suitable type of sensor for measuring the air temperature, relative humidity, pressure, and/or other variables. The sensors 252 may be positioned anywhere within a conditioned space (e.g., a room or building) and/or the HVAC system 140. For example, the HVAC system 140 may comprise a sensor 252 positioned and configured to measure an outdoor air temperature. As another example, the HVAC system 140 may comprise a sensor 252 positioned and configured to measure a supply or treated air temperature and/or a return air temperature. In other examples, the HVAC system 140 may comprise sensors 252 positioned and configured to measure any other suitable type of air temperature, relative humidity, pressure, and/or other variables.

The HVAC system 140 comprises one or more thermostats 135, for example, located within a conditioned space (e.g., a room or building). A thermostat 135 may be a single-stage thermostat, a multi-stage thermostat, or any suitable type of thermostat as would be appreciated by one of ordinary skill in the art. The thermostat 135 is configured to allow a user (e.g., user 102 of FIG. 1) to input a desired temperature or temperature set point for a designated space or zone such as the room.

Filters

Figure 3A:
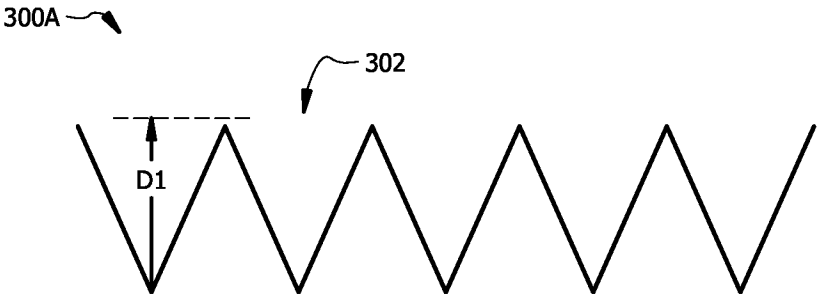
FIG. 3A is a cross-sectional view of an embodiment of a new filter.

FIG. 3A is a cross-sectional view of an embodiment of a filter 300A. In certain embodiments, the filter 300A may comprise a plurality of pleats 302. The pleats 302 increase an effective surface of the filter 300A. Each pleat 302 may have a depth D1. In the illustrated embodiments, the filter 300A is a new filter and is free of dust 304 (see, for example, FIGS. 3B, 3C and 3D). In some embodiments when the user device 103 (see FIG. 1) determines that the filter 242 is dirty, the filter 242 (see FIG. 2) may be replaced by the filter 300A.

Figure 3B:
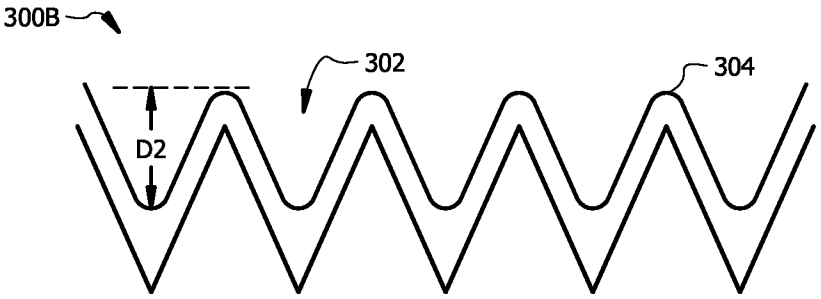
FIG. 3B is a cross-sectional view of an embodiment of a reference used filter.

FIG. 3B is a cross-sectional view of an embodiment of a used filter 300B. The used filter 300B may be the filter 300A after it has been used by the HVAC system 140 (see FIG. 2) for a certain period. Dust 304 may accumulate on the filter 300B and may fill the pleats 302, such that pleats 302 have a depth D2, which is less the depth D1 of the filter 300A (see FIG. 3A). In certain embodiments, the used filter 300B may be used as a reference used filter. In such embodiments, images of the used filter 300B may be stored in the filter image library 146 of the computing system 141 (see FIG. 1). The depth D2 may be also referred to as a depth threshold (e.g., depth threshold 120 of FIG. 1).

Figure 3C:
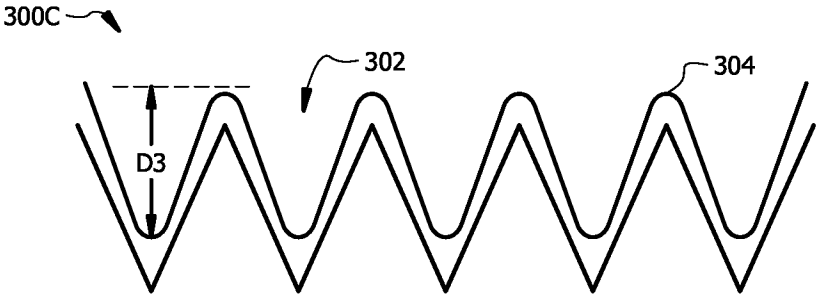
FIGS. 3C and 3D are cross-sectional views of embodiments of used filters.

FIG. 3C is a cross-sectional view of an embodiment of a used filter 300C. The used filter 300C may be the filter 300A (see FIG. 1) after it has been used by the HVAC system 140 (see FIG. 2) for a certain period. Dust 304 may accumulate on the filter 300C and may fill the pleats 302. In the illustrated embodiment, the used filter 300C comprises less dust 304 than the used filter 300B (see FIG. 3B), such that pleats 302 have a depth D3, which is less than the depth D1 of the filter 300A (see FIG. 3A) but is greater than the depth D2 of the filter 300B (see FIG. 3B). In certain embodiments, the user device 103 captures an image of the used filter 300C. In embodiments when the used filter 300B is used as a reference used filter, the image of the used filter 300C is compared to the image of the used filter 300B. In response to determining that the depth D3 is greater than the depth D2, the user device 103 classifies the used filter 300C as acceptable for further use.

Figure 3D:
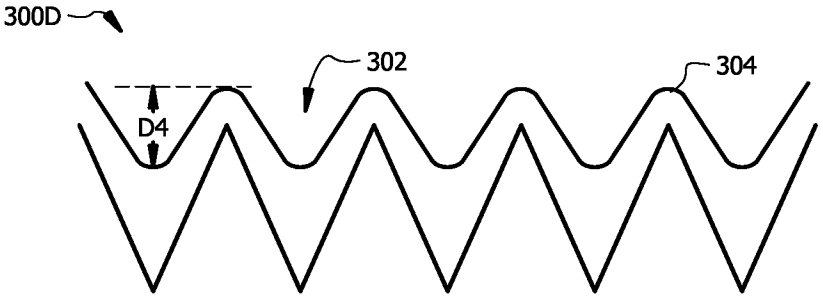

FIG. 3D is a cross-sectional view of an embodiment of a used filter 300D. The used filter 300D may be the filter 300A (see FIG. 1) after it has been used by the HVAC system 140 (see FIG. 2) for a certain period. Dust 304 may accumulate on the filter 300D and may fill the pleats 302. In the illustrated embodiment, the used filter 300D comprises more dust 304 than the used filter 300B (see FIG. 3B), such that pleats 302 have a depth D4 which is less than the depth D1 of the filter 300A (see FIG. 3A) and the depth D2 of the filter 300B (see FIG. 3B). In certain embodiments, the user device 103 captures an image of the used filter 300D. In embodiments when the used filter 300B is used as a reference used filter, the image of the used filter 300D is compared to the image of the used filter 300B. In response to determining that the depth D4 is less than the depth D2, the user device 103 classifies the used filter 300D as dirty and determines that the used filter 300D is unacceptable for further use.

Sound Signatures

Figure 4:
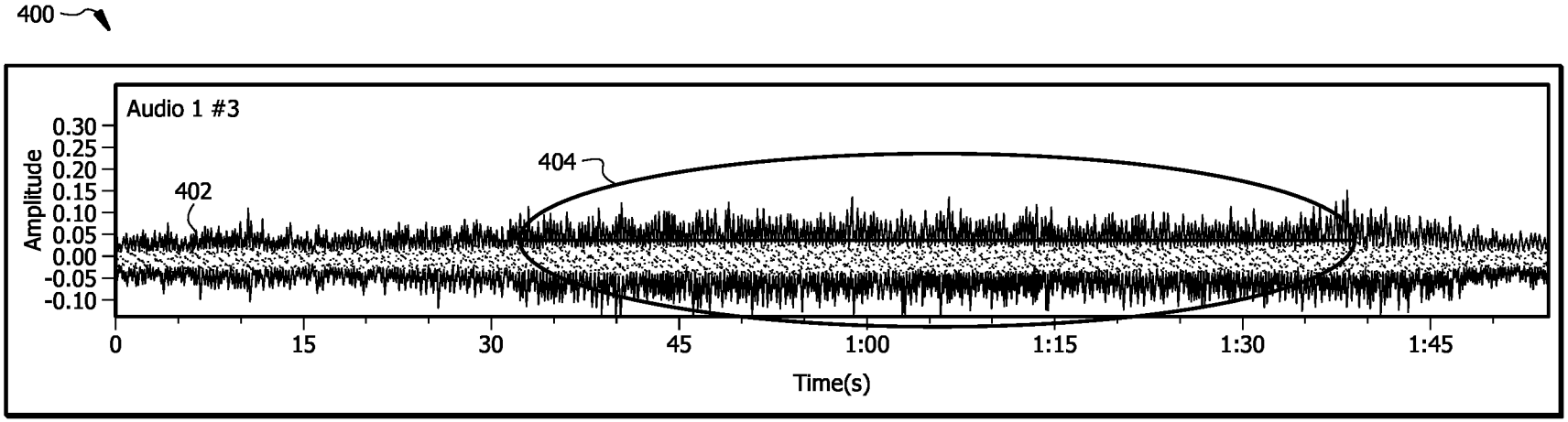
FIG. 4 is an example of a plot of sound data of an indoor unit of an HVAC system operating in a cooling mode.

FIG. 4 is an example of a plot 400 of sound data 402 of the indoor unit 202 of the HVAC system 140 (see FIG. 2) operating in a cooling mode. In the illustrated embodiment, the plot 400 shows amplitudes for the sound data 402 over time. In other embodiments, the sound data 402 may be represented as an amplitude vs frequency plot, or as a spectrogram (e.g., a visual representation of the spectrum of frequencies of the sound data 402 as it varies with time). In this example, the sound data 402 includes a sound signature 404 of a blower 244 (see FIG. 2) during proper or normal operation. In embodiments when the blower 244 has failed, the sound signature 404 of the blower 244 will be missing from the sound data 402. In embodiments when the blower 244 is malfunctioning, the sound signature 404 of the blower 244 will be distorted compared to the proper operation.

Figure 5:
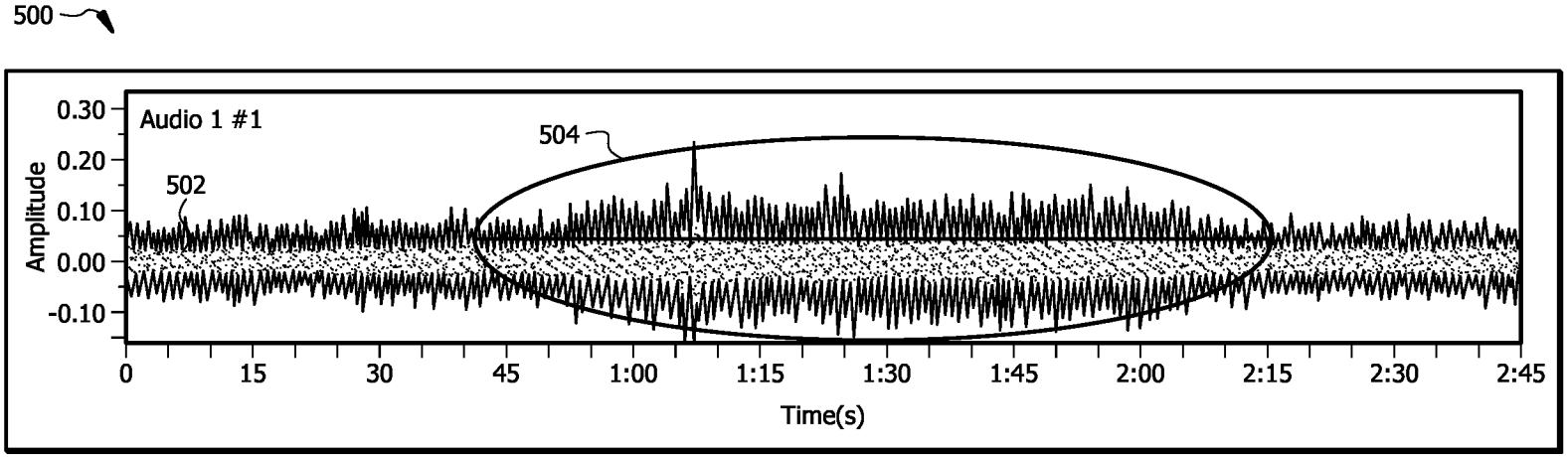
FIG. 5 is an example of a plot of sound data of an indoor unit of an HVAC system operating in a heating mode.

FIG. 5 is an example of a plot 500 of sound data 502 of the indoor unit 202 of the HVAC system 140 (see FIG. 2) operating in a heating mode. In the illustrated embodiment, the plot 500 shows amplitudes for the sound data 502 over time. In other embodiments, the sound data 502 may be represented as an amplitude vs frequency plot, or as a spectrogram (e.g., a visual representation of the spectrum of frequencies of the sound data 502 as it varies with time). In this example, the sound data 502 includes a sound signature 504 of a blower 244 (see FIG. 2) during proper or normal operation. In embodiments when the blower 244 has failed, the sound signature 504 of the blower 244 will be missing from the sound data 502. In embodiments when the blower 244 is malfunctioning, the sound signature 504 of the blower 244 will be distorted compared to the proper operation.

Figure 6A:
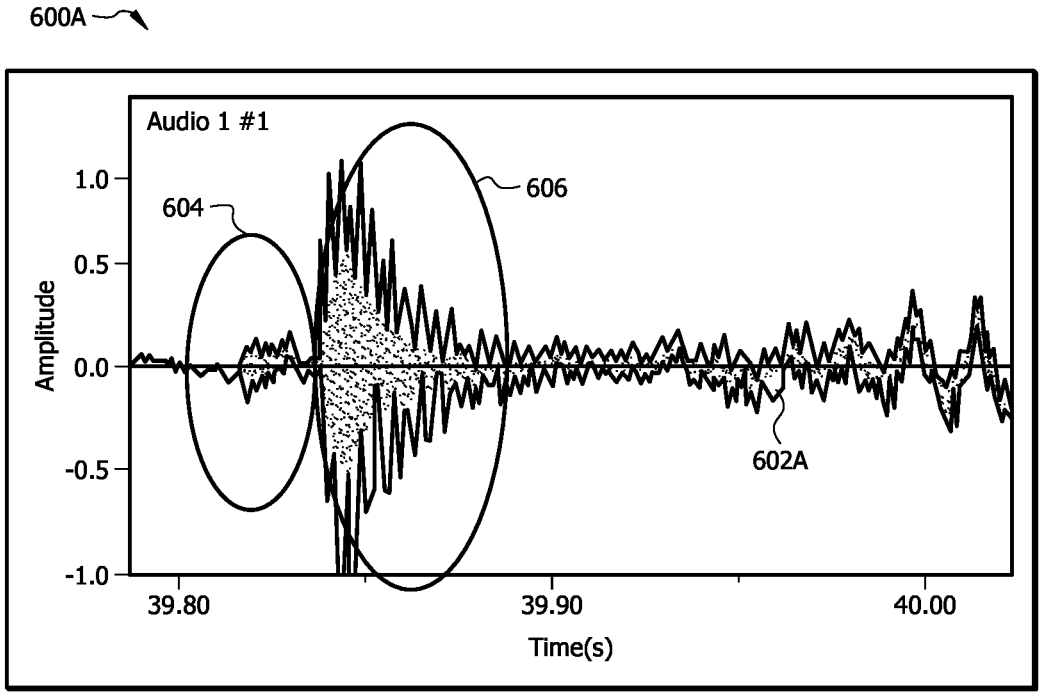
FIGS. 6A and 6B are examples of plots of sound data of an outdoor unit of an HVAC system.

FIG. 6A is an example of a plot 600A of sound data 602A of the outdoor unit 204 of the HVAC system 140 (see FIG. 2). In the illustrated embodiment, the plot 600A shows amplitudes for the sound data 602A over time. In other embodiments, the sound data 602A may be represented as an amplitude vs frequency plot, or as a spectrogram (e.g., a visual representation of the spectrum of frequencies of the sound data 602A as it varies with time). In this example, the sound data 602A includes a sound signature 604 of the relay 216 (see FIG. 2) and a sound signature 606 of the contactor 218 (see FIG. 2) during proper or normal operation.

Figure 6B:
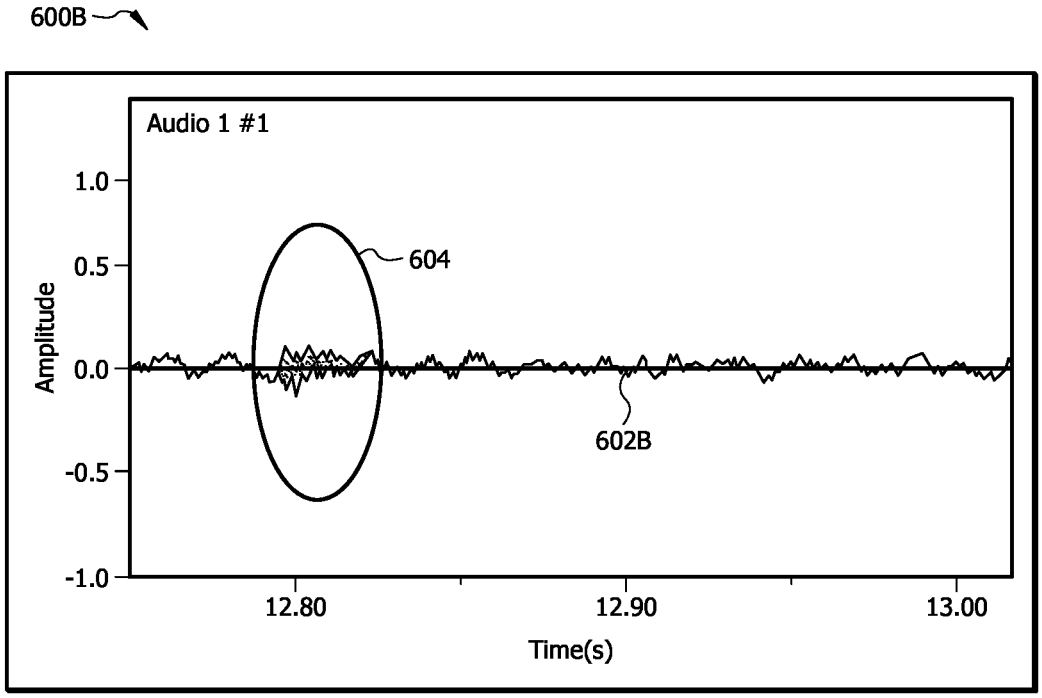

FIG. 6B is an example of a plot 600B of sound data 602B of the outdoor unit 204 of the HVAC system 140 (see FIG. 2). In the illustrated embodiment, the plot 600B shows amplitudes for the sound data 602B over time. In other embodiments, the sound data 602B may be represented as an amplitude vs frequency plot, or as a spectrogram (e.g., a visual representation of the spectrum of frequencies of the sound data 602B as it varies with time). In this example, the contactor 218 (see FIG. 2) has failed and the sound data 602B includes the sound signature 604 of the relay 216 (see FIG. 2), while the sound signature 606 (see FIG. 6A) of the contactor 218 (see FIG. 2) is missing. In embodiments when the contactor 218 is malfunctioning, a sound signature of the contactor 218 will be distorted compared to the sound signature 606. In embodiments when the relay 216 (see FIG. 2) has failed, the sound signature 604 of the relay 216 and the sound signature 606 of the contactor 218 (see FIG. 2) will be missing from the sound data. In embodiments when the relay 216 (see FIG. 2) is malfunctioning, a sound signature of the relay 216 will be distorted compared to the sound signature 604 and a sound signature of contactor will be missing or will be distorted compared to the sound signature 606.

Figure 7A:
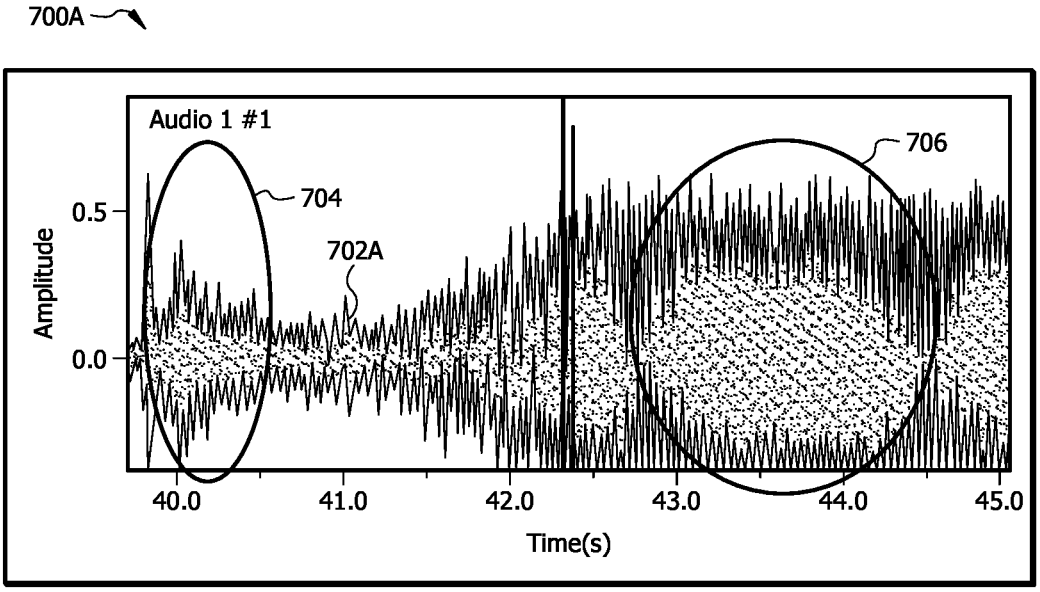
FIGS. 7A, 7B and 7C are examples of plots of sound data of an outdoor unit of an HVAC system operating in a cooling mode.

FIG. 7A is an example of a plot 700A of sound data 702A of the outdoor unit 204 of the HVAC system 140 (see FIG. 2) operating in a cooling mode. In the illustrated embodiment, the plot 700A shows amplitudes for the sound data 702A over time. In other embodiments, the sound data 702A may be represented as an amplitude vs frequency plot, or as a spectrogram (e.g., a visual representation of the spectrum of frequencies of the sound data 702A as it varies with time). In this example, the sound data 702A includes a sound signature 704 of a compressor 208 (see FIG. 2) and a sound signature 706 of a fan 212 (see FIG. 2) during proper or normal operation.

Figure 7B:
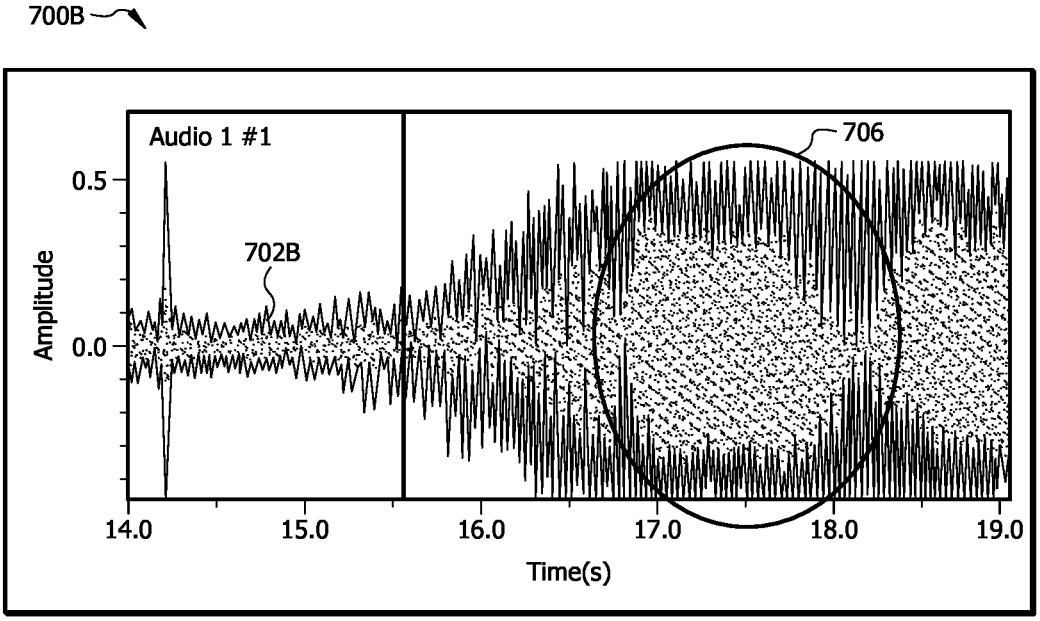

FIG. 7B is an example of a plot 700B of sound data 702B of the outdoor unit 204 of the HVAC system 140 (see FIG. 2) operating in a cooling mode. In the illustrated embodiment, the plot 700B shows amplitudes for the sound data 702B over time. In other embodiments, the sound data 702B may be represented as an amplitude vs frequency plot, or as a spectrogram (e.g., a visual representation of the spectrum of frequencies of the sound data 702B as it varies with time). In this example, the compressor 208 (see FIG. 2) has failed and the sound data 702B includes the sound signature 706 of the fan 212 (see FIG. 2), while the sound signature 704 (see FIG. 7A) of the compressor 208 is missing. In embodiments when the compressor 208 is malfunctioning, a sound signature of the compressor 208 will be distorted compared to the sound signature 704.

Figure 7C:
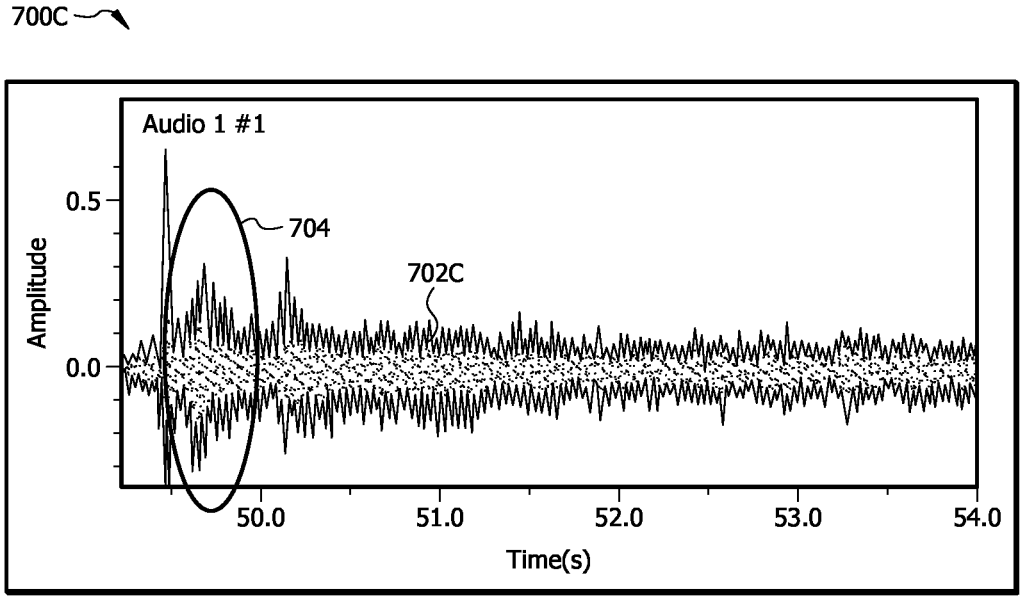

FIG. 7C is an example of a plot 700C of sound data 702C of the outdoor unit 204 of the HVAC system 140 (see FIG. 2) operating in a cooling mode. In the illustrated embodiment, the plot 700C shows amplitudes for the sound data 702C over time. In other embodiments, the sound data 702C may be represented as an amplitude vs frequency plot, or as a spectrogram (e.g., a visual representation of the spectrum of frequencies of the sound data 702C as it varies with time). In this example, the fan 212 (see FIG. 2) has failed and the sound data 702C includes the sound signature 704 of the compressor 208 (see FIG. 2), while the sound signature 706 (see FIG. 7A) of the fan 212 is missing. In embodiments when the fan 212 is malfunctioning, a sound signature of the fan 212 will be distorted compared to the sound signature 706.

Figure 8A:
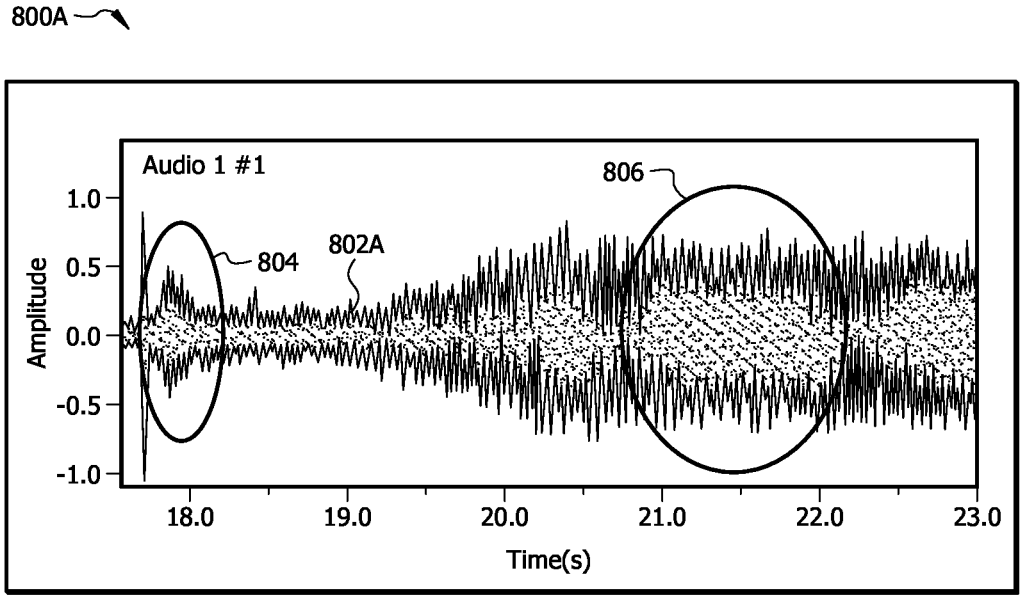
FIGS. 8A, 8B and 8C are examples of plots of sound data of an outdoor unit of an HVAC system operating in a heating mode.

FIG. 8A is an example of a plot 800A of sound data 802A of the outdoor unit 204 of the HVAC system 140 (see FIG. 2) operating in a heating mode. In the illustrated embodiment, the plot 800A shows amplitudes for the sound data 802A over time. In other embodiments, the sound data 802A may be represented as an amplitude vs frequency plot, or as a spectrogram (e.g., a visual representation of the spectrum of frequencies of the sound data 802A as it varies with time). In this example, the sound data 802A includes a sound signature 804 of the compressor 208 (see FIG. 2) and a sound signature 806 of the fan 212 (see FIG. 2) during proper or normal operation.

Figure 8B:
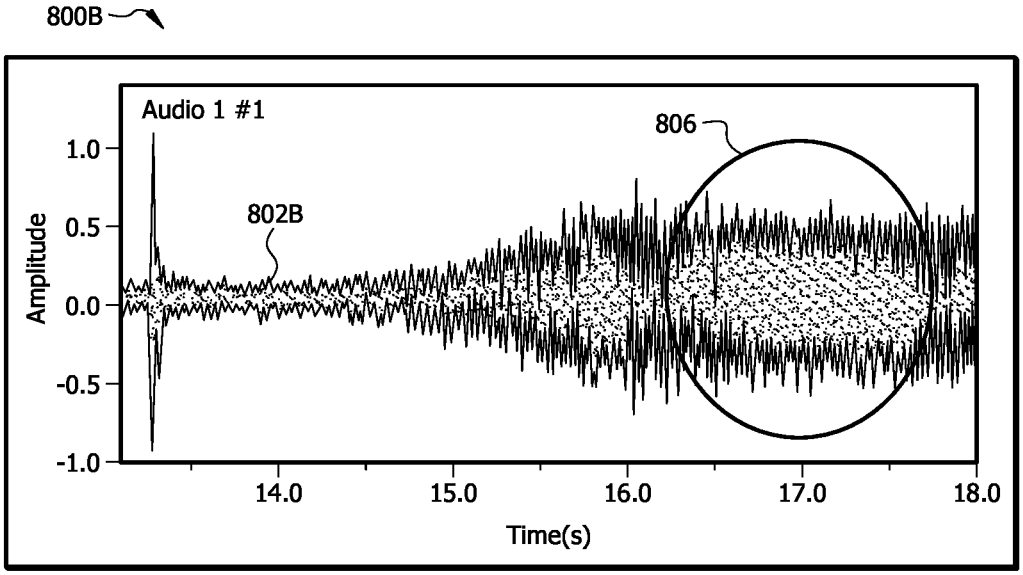

FIG. 8B is an example of a plot 800B of sound data 802B of the outdoor unit 204 of the HVAC system 140 (see FIG. 2) operating in a heating mode. In the illustrated embodiment, the plot 800B shows amplitudes for the sound data 802B over time. In other embodiments, the sound data 802B may be represented as an amplitude vs frequency plot, or as a spectrogram (e.g., a visual representation of the spectrum of frequencies of the sound data 802B as it varies with time). In this example, the compressor 208 (see FIG. 2) has failed and the sound data 802B includes the sound signature 806 of the fan 212 (see FIG. 2), while the sound signature 804 (see FIG. 8A) of the compressor 208 is missing. In embodiments when the compressor 208 is malfunctioning, a sound signature of the compressor 208 will be distorted compared to the sound signature 804.

Figure 8C:
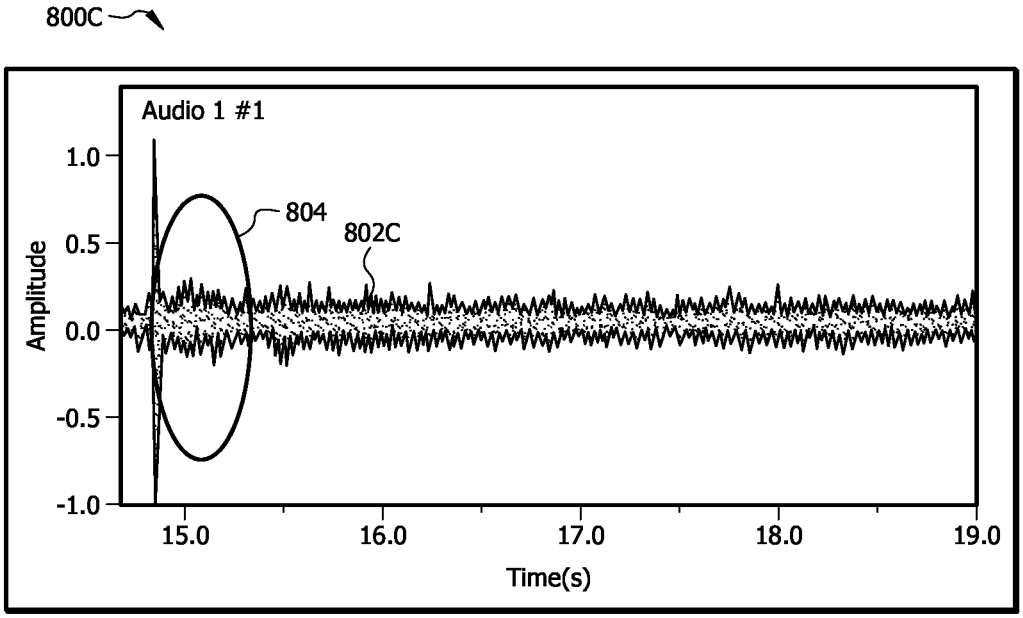

FIG. 8C is an example of a plot 800C of sound data 802C of the outdoor unit 204 of the HVAC system 140 (see FIG. 2) operating in a heating mode. In the illustrated embodiment, the plot 800C shows amplitudes for the sound data 802C over time. In other embodiments, the sound data 802C may be represented as an amplitude vs frequency plot, or as a spectrogram (e.g., a visual representation of the spectrum of frequencies of the sound data 802C as it varies with time). In this example, the fan 212 (see FIG. 2) has failed and the sound data 802C includes the sound signature 804 of the compressor 208 (see FIG. 2), while the sound signature 806 (see FIG. 8A) of the fan 212 is missing. In embodiments when the fan 212 is malfunctioning, a sound signature of the fan 212 will be distorted compared to the sound signature 806.

Figure 9A:
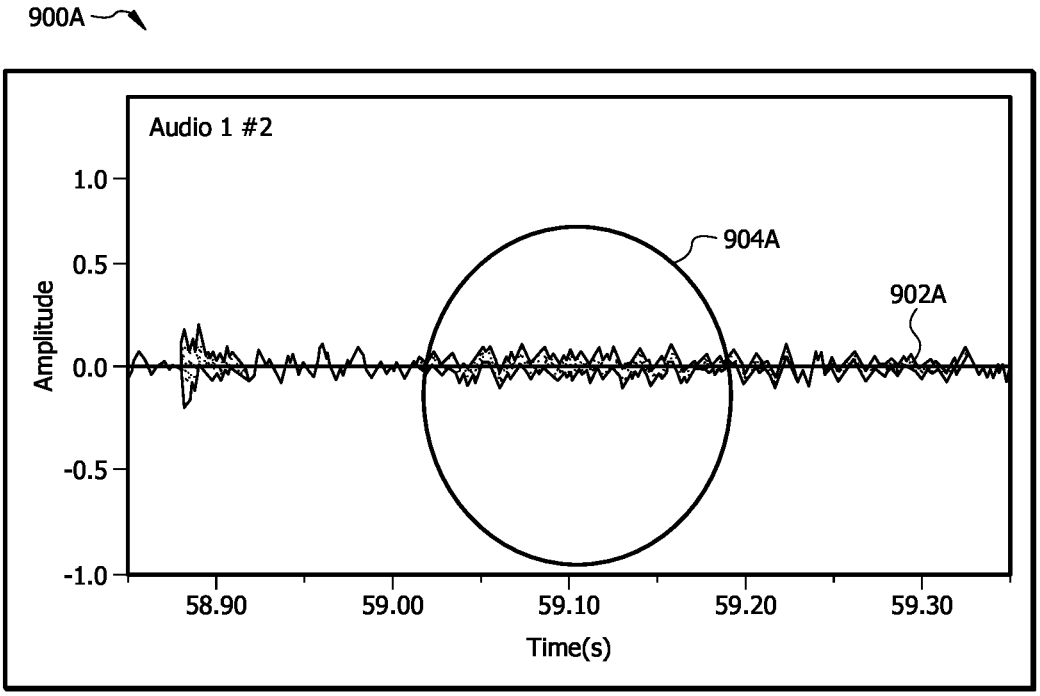
FIG. 9A is an example of a plot of sound data of an outdoor unit of an HVAC system when switching from a cooling mode to a heating mode.

FIG. 9A is an example of a plot 900A of sound data 902A of the outdoor unit 204 of the HVAC system 140 (see FIG. 2) when switching from a cooling mode to a heating mode. In the illustrated embodiment, the plot 900A shows amplitudes for the sound data 902A over time. In other embodiments, the sound data 902A may be represented as an amplitude vs frequency plot, or as a spectrogram (e.g., a visual representation of the spectrum of frequencies of the sound data 902A as it varies with time). In this example, the sound data 902A includes a sound signature 904A of a reversing valve 220 (see FIG. 2) during proper or normal operation. In embodiments when the reversing valve 220 has failed, the sound signature 904A of the reversing valve 220 will be missing from the sound data. In embodiments when the reversing valve 220 is malfunctioning, a sound signature of the reversing valve 220 will be distorted compared to the sound signature 904A.

Figure 9B:
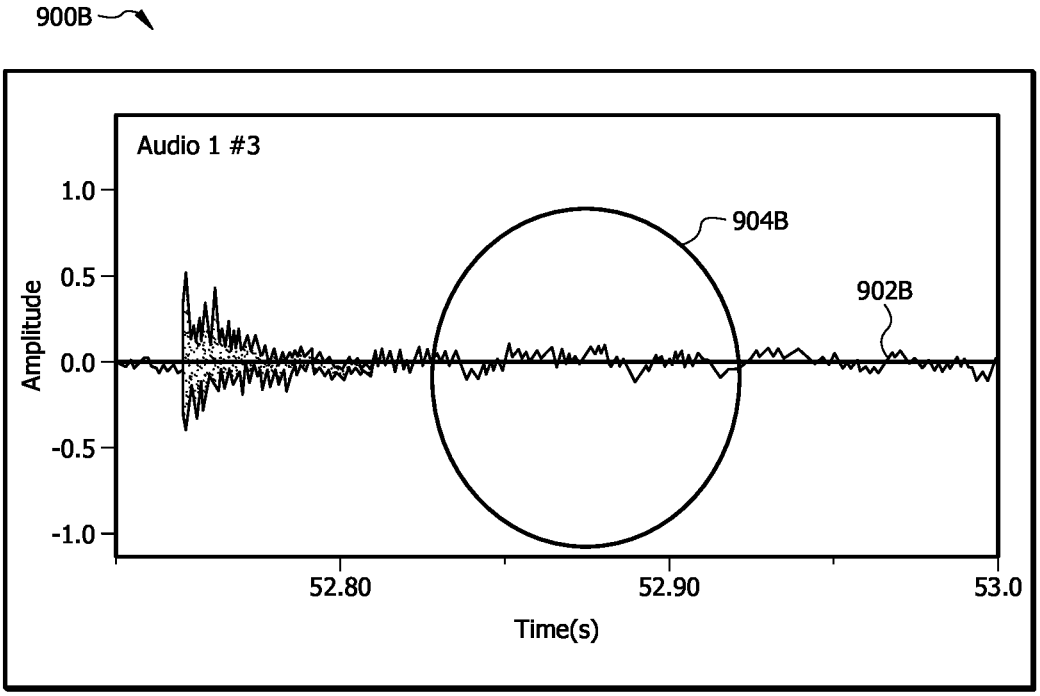
FIG. 9B is an example of a plot of sound data of an outdoor unit of an HVAC system when switching from a heating mode to a cooling mode.

FIG. 9B is an example of a plot 900B of sound data 902B of the outdoor unit 204 of the HVAC system 140 (see FIG. 2) when switching from a heating mode to a cooling mode. In the illustrated embodiment, the plot 900B shows amplitudes for the sound data 902B over time. In other embodiments, the sound data 902B may be represented as an amplitude vs frequency plot, or as a spectrogram (e.g., a visual representation of the spectrum of frequencies of the sound data 902B as it varies with time). In this example, the sound data 902B includes a sound signature 904B of the reversing valve 220 (see FIG. 2) during proper or normal operation. In embodiments when the reversing valve 220 has failed, the sound signature 904B of the reversing valve 220 will be missing from the sound data. In embodiments when the reversing valve 220 is malfunctioning, a sound signature of the reversing valve 220 will be distorted compared to the sound signature 904B.

An Example Diagnostic Process for an HVAC System

Figure 10A:
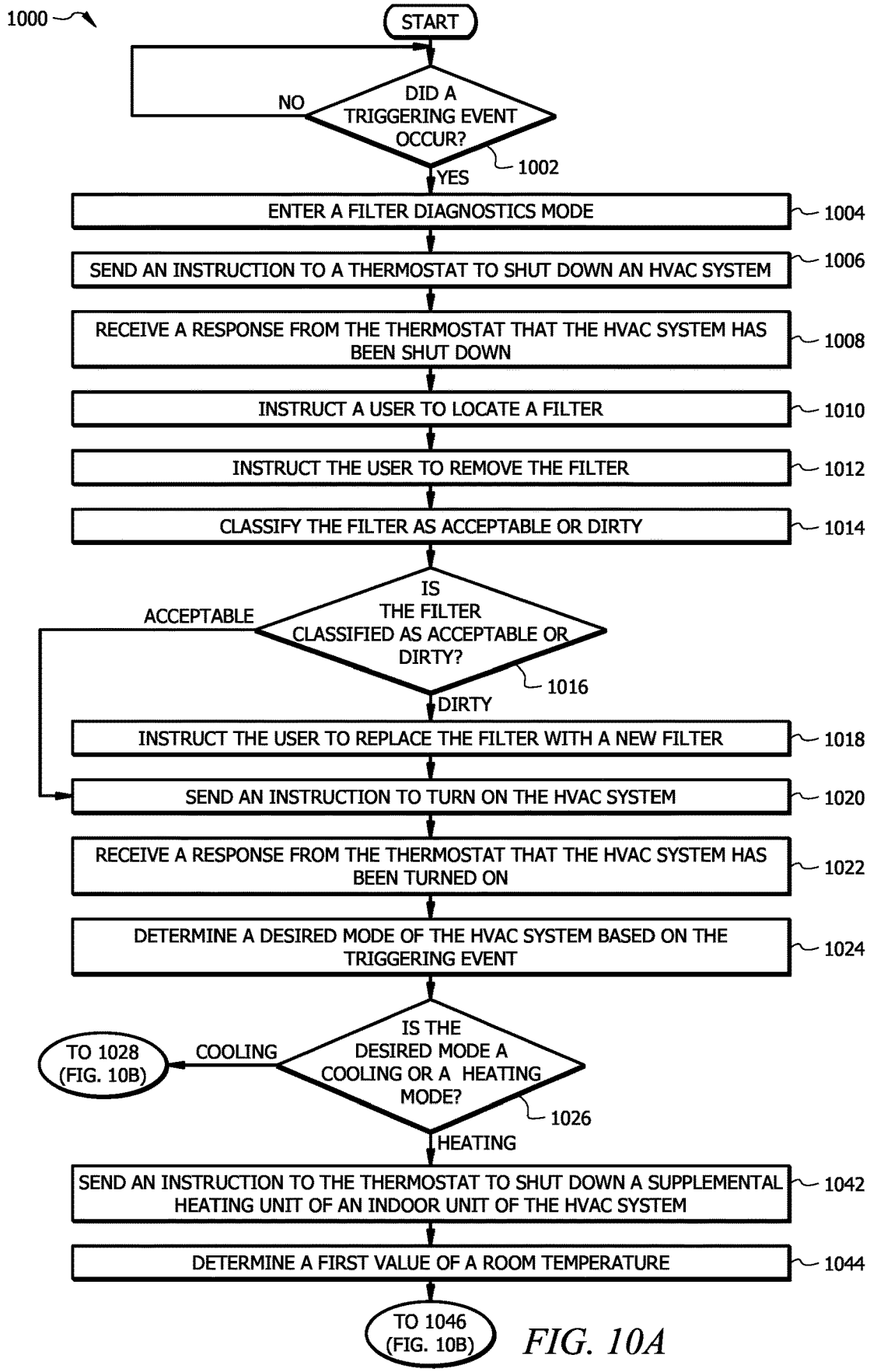
FIGS. 10A and 10B illustrate a flowchart of an embodiment of a diagnostic process for an HVAC system.
Figure 10B:
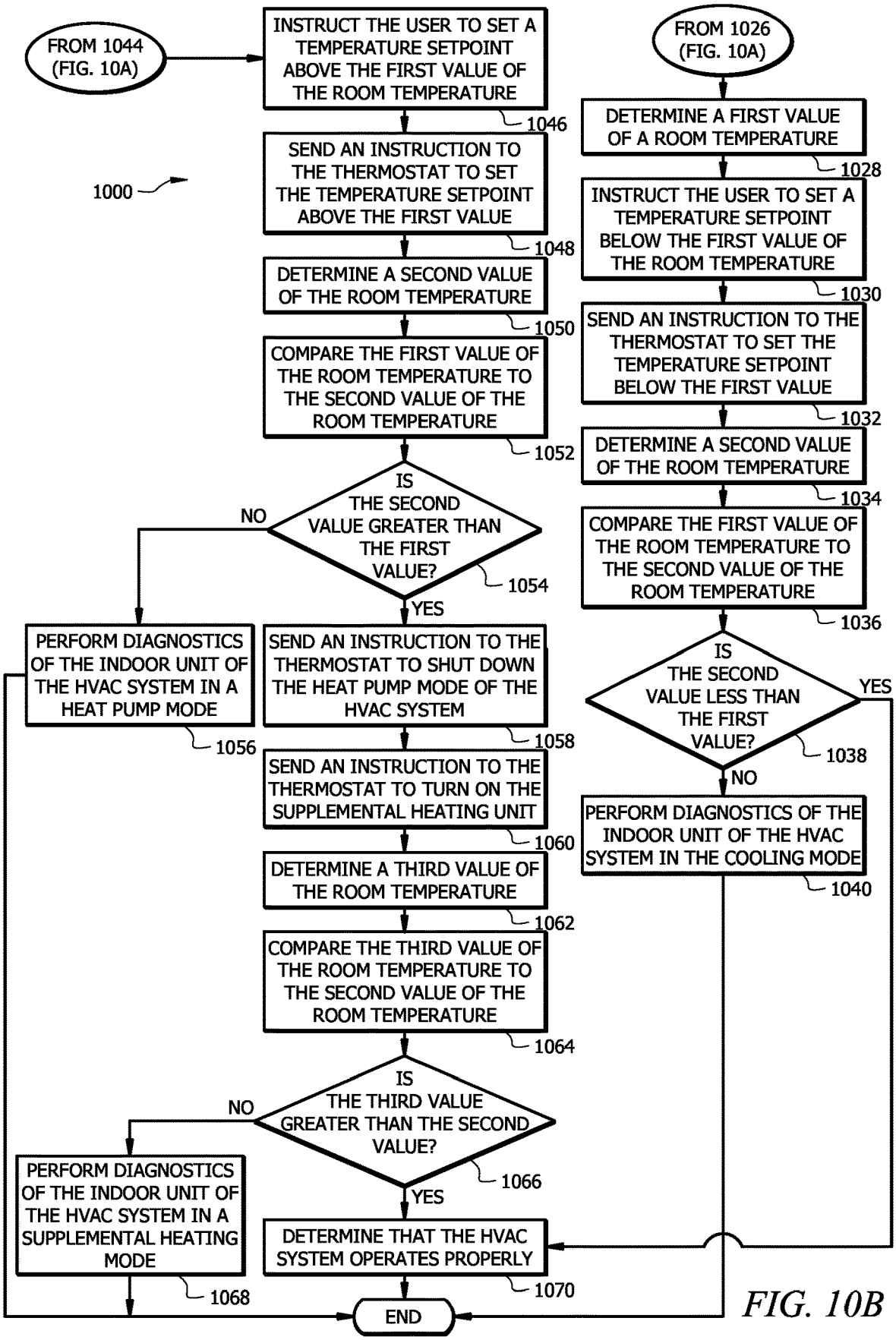

FIGS. 10A and 10B illustrate a flowchart of an embodiment of a diagnostic process 1000 for the HVAC system 140 (see FIG. 2). Modifications, additions, or omissions may be made to diagnostic process 1000. Process 1000 may include more, fewer, or other operations. For example, operations may be performed in parallel or in any suitable order. For example, one or more operations of process 1000 may be implemented, at least in part, in the form of the software instructions (e.g., instructions 110, 139, and/or 145, and/or application 111 of FIG. 1), stored on non-transitory, tangible, machine-readable medium (e.g., memories 109, 138, and/or 144 of FIG. 1) that when executed by one or more processors (e.g., processors 104, 136, and/or 142 of FIG. 1) may cause the one or more processors to perform operations 1000-1070.

At operation 1002, a user device (e.g., user device 103 of FIG. 1) determines if a triggering event has occurred. The triggering event may be an expiration of a diagnostics timer or an event when a user (e.g., user 102 of FIG. 1) experiences comfort issues. For example, the user may experience comfort issues when the user sets a desired temperature setpoint in a thermostat (e.g., thermostat 135 of FIG. 1), but a room temperature does not change in a correct direction based on the desired temperature setpoint. In response to determining at operation 1002 that the triggering event has occurred, diagnostic process 1000 continues to operation 1004.

At operation 1004, the user device (e.g., user device 103 of FIG. 1) enters a filter diagnostics mode.

At operation 1006, the user device (e.g., user device 103 of FIG. 1) sends an instruction (e.g., instruction 156 of FIG. 1) to the thermostat (e.g., thermostat 135 of FIG. 1) to shut down the HVAC system 140.

At operation 1008, the user device 103 receive a response (e.g., response 157 of FIG. 1) from the thermostat 135 that the HVAC system 140 has been shut down.

At operation 1010, the user device (e.g., user device 103 of FIG. 1) instructs the user (e.g., user 102 of FIG. 1) to locate a filter (e.g., filter 242 of FIG. 2).

At operation 1012, the user device (e.g., user device 103 of FIG. 1) instructs the user (e.g., user 102 of FIG. 1) to remove the filter (e.g., filter 242 of FIG. 2) from the HVAC system 140.

At operation 1014, the user device (e.g., user device 103 of FIG. 1) classifies the filter (e.g., filter 242 of FIG. 2) as acceptable or dirty. In certain embodiments, operation 1014 may be implemented by a filter classification process 1100 described below with reference to FIG. 11. In other embodiments, operation 1014 may be implemented by a filter classification process 1200 described below with reference to FIG. 12.

At operation 1016, the user device (e.g., user device 103 of FIG. 1) determines if the filter (e.g., filter 242 of FIG. 2) is classified as acceptable or dirty. In response to determining at operation 1016 that the filter (e.g., filter 242 of FIG. 2) is classified as acceptable, diagnostic process 1000 continues to operation 1020. In response to determining at operation 1016 that the filter (e.g., filter 242 of FIG. 2) is classified as dirty, diagnostic process 1000 continues to operation 1018.

At operation 1018, the user device (e.g., user device 103 of FIG. 1) instructs the user (e.g., user 102 of FIG. 1) to replace the filter (e.g., filter 242 of FIG. 2) with a new filter (e.g., filter 300A of FIG. 3A).

At operation 1020, the user device (e.g., user device 103 of FIG. 1) sends an instruction (e.g., instruction 156 of FIG. 1) to the thermostat (e.g., thermostat 135 of FIG. 1) to turn on the HVAC system 140.

At operation 1022, the user device (e.g., user device 103 of FIG. 1) receives a response (e.g., response 157 of FIG. 1) from the thermostat (e.g., thermostat 135 of FIG. 1) that the HVAC system 140 has been turned on.

At operation 1024, the user device (e.g., user device 103 of FIG. 1) determines a desired mode of the HVAC system 140 based on the triggering event. For example, when the triggering event is an event when the user (e.g., user 102 of FIG. 1) experiences comfort issues, the desired mode may be a cooling mode or a heating mode based on the desired temperature setpoint that is set by the user (e.g., user 102 of FIG. 1).

At operation 1026, the user device (e.g., user device 103 of FIG. 1) determines if the desired mode is a cooling mode or a heating mode.

In response to determining at operation 1026 that the desired mode is the cooling mode, diagnostic process 1000 continues to operation 1028.

At operation 1028, the user device (e.g., user device 103 of FIG. 1) determines a first value of a room temperature (e.g., temperature 131 of FIG. 1). For example, the user device (e.g., user device 103 of FIG. 1) may obtain the first value of the room temperature (e.g., temperature 131 of FIG. 1) from the thermostat (e.g., thermostat 135 of FIG. 1).

At operation 1030, the user device (e.g., user device 103 of FIG. 1) instructs the user (e.g., user 102 of FIG. 1) to set a temperature setpoint (e.g., temperature setpoint 130 of FIG. 1) below the first value of the room temperature (e.g., temperature 131 of FIG. 1). In other embodiments, operation 1030 may be omitted.

At operation 1032, the user device (e.g., user device 103 of FIG. 1) sends an instruction (e.g., instruction 156 of FIG. 1) to the thermostat (e.g., thermostat 135 of FIG. 1) to set the temperature setpoint (e.g., temperature setpoint 130 of FIG. 1) below the first value of the room temperature (e.g., temperature 131 of FIG. 1). In certain embodiments, the temperature setpoint (e.g., temperature setpoint 130 of FIG. 1) is set 5° F. below the first value of the room temperature (e.g., temperature 131 of FIG. 1).

At operation 1034, the user device (e.g., user device 103 of FIG. 1) determines a second value of the room temperature (e.g., temperature 132 of FIG. 1). For example, the user device (e.g., user device 103 of FIG. 1) may obtain the second value of the room temperature (e.g., temperature 132 of FIG. 1) from the thermostat (e.g., thermostat 135 of FIG. 1).

At operation 1036, the user device (e.g., user device 103 of FIG. 1) compares the first value of the room temperature (e.g., temperature 131 of FIG. 1) to the second value of the room temperature (e.g., temperature 132 of FIG. 1).

At operation 1038, the user device (e.g., user device 103 of FIG. 1) determines if the second value of the room temperature (e.g., temperature 132 of FIG. 1) is less than the first value of the room temperature (e.g., temperature 131 of FIG. 1).

In response to determining at operation 1038 that the second value of the room temperature (e.g., temperature 132 of FIG. 1) is less than the first value of the room temperature (e.g., temperature 131 of FIG. 1), diagnostic process 1000 continues to operation 1070.

At operation 1070, the user device (e.g., user device 103 of FIG. 1) determines that the HVAC system 140 operates properly. After performing operation 1070, diagnostic process 1000 ends.

In response to determining at operation 1038 that the second value of the room temperature (e.g., temperature 132 of FIG. 1) is not less than the first value of the room temperature (e.g., temperature 131 of FIG. 1), diagnostic process 1000 continues to operation 1040.

At operation 1040, the user device (e.g., user device 103 of FIG. 1) performs diagnostics of the indoor unit (e.g., indoor unit 202 of FIG. 2) of the HVAC system 140 in the cooling mode. In certain embodiments, operation 1040 may be implemented by a diagnostic process 1300 described below with reference to FIGS. 13A and 13B. After performing operation 1040, diagnostic process 1000 ends.

In response to determining at operation 1026 that the desired mode is the heating mode, diagnostic process 1000 continues to operation 1042.

At operation 1042, the user device (e.g., user device 103 of FIG. 1) sends an instruction (e.g., instruction 156 of FIG. 1) to the thermostat (e.g., thermostat 135 of FIG. 1) to shut down a supplemental heating unit (e.g., heating unit 234 of FIG. 2) of the indoor unit (e.g., indoor unit 202 of FIG. 2) of the HVAC system 140.

At operation 1044, the user device (e.g., user device 103 of FIG. 1) determines a first value of a room temperature (e.g., temperature 131 of FIG. 1). For example, the user device (e.g., user device 103 of FIG. 1) may obtain the first value of the room temperature (e.g., temperature 131 of FIG. 1) from the thermostat (e.g., thermostat 135 of FIG. 1).

At operation 1046, the user device (e.g., user device 103 of FIG. 1) instructs the user (e.g., user 102 of FIG. 1) to set a temperature setpoint (e.g., temperature setpoint 130 of FIG. 1) above the first value of the room temperature (e.g., temperature 131 of FIG. 1). In other embodiments, operation 1046 may be omitted.

At operation 1048, the user device (e.g., user device 103 of FIG. 1) sends an instruction (e.g., instruction 156 of FIG. 1) to the thermostat (e.g., thermostat 135 of FIG. 1) to set the temperature setpoint (e.g., temperature setpoint 130 of FIG. 1) above the first value of the room temperature (e.g., temperature 131 of FIG. 1). In certain embodiments, the temperature setpoint (e.g., temperature setpoint 130 of FIG. 1) is set 5° F. above the first value of the room temperature (e.g., temperature 131 of FIG. 1).

At operation 1050, the user device (e.g., user device 103 of FIG. 1) determines a second value of the room temperature (e.g., temperature 132 of FIG. 1). For example, the user device (e.g., user device 103 of FIG. 1) may obtain the second value of the room temperature (e.g., temperature 132 of FIG. 1) from the thermostat (e.g., thermostat 135 of FIG. 1).

At operation 1052, the user device (e.g., user device 103 of FIG. 1) compares the first value of the room temperature (e.g., temperature 131 of FIG. 1) to the second value of the room temperature (e.g., temperature 132 of FIG. 1).

At operation 1054, the user device (e.g., user device 103 of FIG. 1) determines if the second value of the room temperature (e.g., temperature 132 of FIG. 1) is greater than the first value of the room temperature (e.g., temperature 131 of FIG. 1).

In response to determining at operation 1054 that the second value of the room temperature (e.g., temperature 132 of FIG. 1) is not greater than the first value of the room temperature (e.g., temperature 131 of FIG. 1), diagnostic process 1000 continues to operation 1056.

At operation 1056, the user device (e.g., user device 103 of FIG. 1) performs diagnostics of the indoor unit (e.g., indoor unit 202 of FIG. 2) of the HVAC system 140 in a heat pump heating mode. In certain embodiments, operation 1056 may be implemented by a diagnostic process 1400 described below with reference to FIGS. 14A and 14B. After performing operation 1056, diagnostic process 1000 ends.

In response to determining at operation 1054 that the second value of the room temperature (e.g., temperature 132 of FIG. 1) is greater than the first value of the room temperature (e.g., temperature 131 of FIG. 1), diagnostic process 1000 continues to operation 1058.

At operation 1058, the user device (e.g., user device 103 of FIG. 1) sends an instruction (e.g., instruction 156 of FIG. 1) to the thermostat (e.g., thermostat 135 of FIG. 1) to shut down the heat pump heating mode of the HVAC system 140.

At operation 1060, the user device (e.g., user device 103 of FIG. 1) sends an instruction (e.g., instruction 156 of FIG. 1) to the thermostat (e.g., thermostat 135 of FIG. 1) to turn on the supplemental heating unit (e.g., heating unit 234 of FIG. 2).

At operation 1062, the user device (e.g., user device 103 of FIG. 1) determines a third value of the room temperature (e.g., temperature 133 of FIG. 1). For example, the user device (e.g., user device 103 of FIG. 1) may obtain the third value of the room temperature (e.g., temperature 133 of FIG. 1) from the thermostat (e.g., thermostat 135 of FIG. 1).

At operation 1064, the user device (e.g., user device 103 of FIG. 1) compares the third value of the room temperature (e.g., temperature 133 of FIG. 1) to the second value of the room temperature (e.g., temperature 132 of FIG. 1).

At operation 1066, the user device (e.g., user device 103 of FIG. 1) determines if the third value of the room temperature (e.g., temperature 133 of FIG. 1) is greater than the second value of the room temperature (e.g., temperature 132 of FIG. 1).

In response to determining at operation 1066 that the third value of the room temperature (e.g., temperature 133 of FIG. 1) is not greater than the second value of the room temperature (e.g., temperature 132 of FIG. 1), diagnostic process 1000 continues to operation 1068.

At operation 1068, (e.g., user device 103 of FIG. 1) performs diagnostics of the indoor unit (e.g., indoor unit 202 of FIG. 2) of the HVAC system 140 in a supplemental heating mode. In certain embodiments, operation 1068 may be implemented by a diagnostic process 1500 described below with reference to FIGS. 15A, 15B and 15C. After performing operation 1068, diagnostic process 1000 ends.

In response to determining at operation 1066 that the third value of the room temperature (e.g., temperature 133 of FIG. 1) is greater than the second value of the room temperature (e.g., temperature 132 of FIG. 1), diagnostic process 1000 continues to operation 1070.

At operation 1070, the user device (e.g., user device 103 of FIG. 1) determines that the HVAC system 140 operates properly. After performing operation 1070, diagnostic process 1000 ends.

A First Example of a Filter Classification Process

Figure 11:
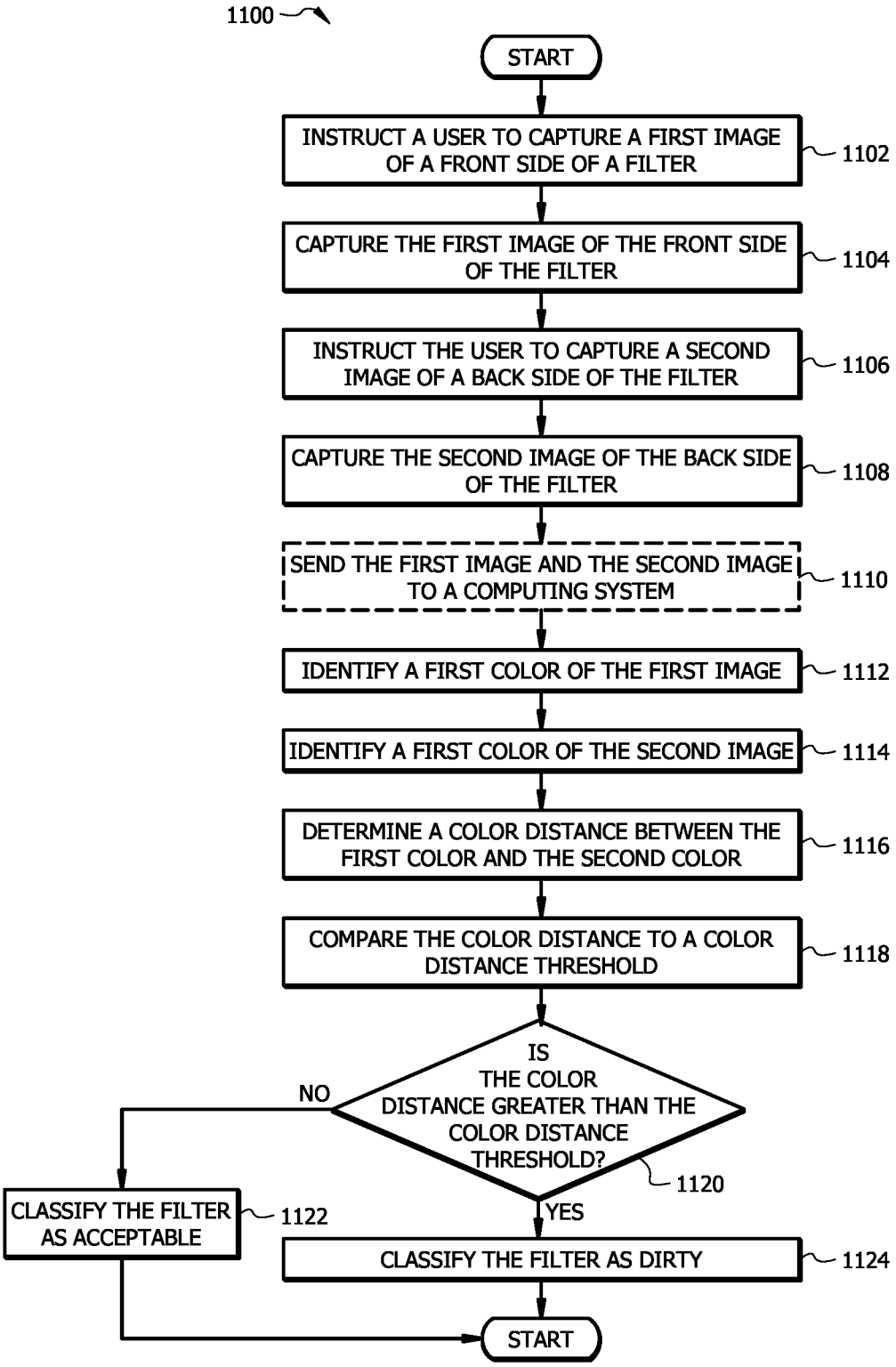
FIG. 11 is a flowchart of an embodiment of a filter classification process.

FIG. 11 is a flowchart of an embodiment of a filter classification process 1100. The filter classification process 1100 may be used to implement operation 1014 of diagnostic process 1000 (see FIG. 10). Modifications, additions, or omissions may be made to process 1100. Process 1100 may include more, fewer, or other operations. For example, operations may be performed in parallel or in any suitable order. For example, one or more operations of process 1100 may be implemented, at least in part, in the form of the software instructions (e.g., instructions 110, 139, and/or 145, and/or application 111 of FIG. 1), stored on non-transitory, tangible, machine-readable medium (e.g., memories 109, 138, and/or 144 of FIG. 1) that when executed by one or more processors (e.g., processors 104, 136, and/or 142 of FIG. 1) may cause the one or more processors to perform operations 1102-1124.

At operation 1102, a user device (e.g., user device 103 of FIG. 1) instructs a user (e.g., user 102 of FIG. 1) to capture a first image (e.g., image 112 of FIG. 1) of a front side of a filter (e.g., filter 242 of FIG. 2).

At operation 1104, the user device (e.g., user device 103 of FIG. 1) captures the first image (e.g., image 112 of FIG. 1) of the front side of the filter (e.g., filter 242 of FIG. 2). For example, a camera (e.g., camera 107 of FIG. 1) of the user device (e.g., user device 103 of FIG. 1) is configured to capture the first image (e.g., image 112 of FIG. 1).

At operation 1106, the user device (e.g., user device 103 of FIG. 1) instructs the user (e.g., user 102 of FIG. 1) to capture a second image (e.g., image 113 of FIG. 1) of a back side of the filter (e.g., filter 242 of FIG. 2).

At operation 1108, the user device (e.g., user device 103 of FIG. 1) captures the second image (e.g., image 113 of FIG. 1) of the back side of the filter (e.g., filter 242 of FIG. 2). For example, the camera (e.g., camera 107 of FIG. 1) of the user device (e.g., user device 103 of FIG. 1) is configured to capture the second image (e.g., image 113 of FIG. 1).

At operation 1110, the user device (e.g., user device 103 of FIG. 1) sends the first image (e.g., image 112 of FIG. 1) and the second image (e.g., image 113 of FIG. 1) to a computing system (e.g., computing system 141 of FIG. 1).

At operation 1112, the computing system (e.g., computing system 141 of FIG. 1) identifies a first color (e.g., color 115 of FIG. 1) of the first image (e.g., image 112 of FIG. 1).

At operation 1114, the computing system (e.g., computing system 141 of FIG. 1) identifies a second color (e.g., color 116 of FIG. 1) of the second image (e.g., image 113 of FIG. 1).

At operation 1116, the computing system (e.g., computing system 141 of FIG. 1) determine a color distance (e.g., color distance 117 of FIG. 1) between the first color (e.g., color 115 of FIG. 1) and the second color (e.g., color 116 of FIG. 1) in a color space.

At operation 1118, the computing system (e.g., computing system 141 of FIG. 1) compares the color distance (e.g., color distance 117 of FIG. 1) to a color distance threshold (e.g., color distance threshold 118 of FIG. 1).

At operation 1120, the computing system (e.g., computing system 141 of FIG. 1) determines if the color distance (e.g., color distance 117 of FIG. 1) is greater than the color distance threshold (e.g., color distance threshold 118 of FIG. 1).

In response to determining at operation 1120 that the color distance (e.g., color distance 117 of FIG. 1) is not greater than the color distance threshold (e.g., color distance threshold 118 of FIG. 1), process 1100 continues to operation 1122.

At operation 1122, the computing system (e.g., computing system 141 of FIG. 1) classifies the filter (e.g., filter 242 of FIG. 2) as acceptable. After performing operation 1122, process 1100 ends.

In response to determining at operation 1120 that the color distance (e.g., color distance 117 of FIG. 1) is greater than the color distance threshold (e.g., color distance threshold 118 of FIG. 1), process 1100 continues to operation 1124.

At operation 1124, the computing system (e.g., computing system 141 of FIG. 1) classifies the filter (e.g., filter 242 of FIG. 2) as dirty. After performing operation 1124, process 1100 ends.

In other embodiments, operations 1112 through 1124 of process 1100 may be performed by the user device (e.g., user device 103 of FIG. 1) instead of the computing system (e.g., computing system 141 of FIG. 1). In such embodiments, operation 1110 of process 1100 is omitted.

A Second Example of a Filter Classification Process

Figure 12:
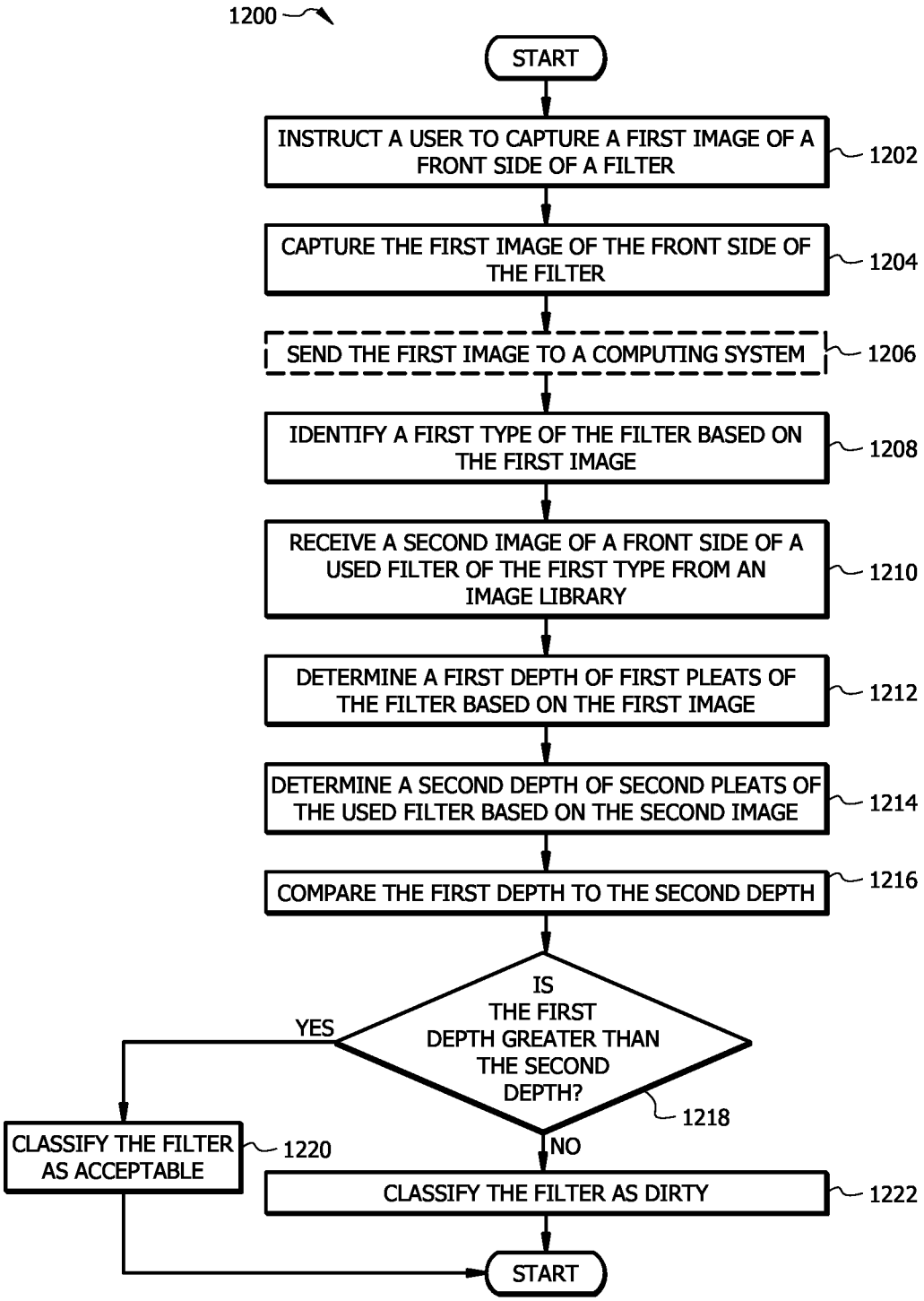
FIG. 12 is a flowchart of an embodiment of a filter classification process.

FIG. 12 is a flowchart of an embodiment of a filter classification process 1200. The filter classification process 1200 may be used to implement operation 1014 of diagnostic process 1000 (see FIG. 10). Modifications, additions, or omissions may be made to process 1200. Process 1200 may include more, fewer, or other operations. For example, operations may be performed in parallel or in any suitable order. For example, one or more operations of process 1200 may be implemented, at least in part, in the form of the software instructions (e.g., instructions 110, 139, and/or 145, and/or application 111 of FIG. 1), stored on non-transitory, tangible, machine-readable medium (e.g., memories 109, 138, and/or 144 of FIG. 1) that when executed by one or more processors (e.g., processors 104, 136, and/or 142 of FIG. 1) may cause the one or more processors to perform operations 1202-1222.

At operation 1202, a user device (e.g., user device 103 of FIG. 1) instructs a user (e.g., user 102 of FIG. 1) to capture a first image (e.g., image 112 of FIG. 1) of a front side of a filter (e.g., filter 242 of FIG. 2).

At operation 1204, the user device (e.g., user device 103 of FIG. 1) captures the first image (e.g., image 112 of FIG. 1) of the front side of the filter (e.g., filter 242 of FIG. 2). For example, a camera (e.g., camera 107 of FIG. 1) of the user device (e.g., user device 103 of FIG. 1) is configured to capture the first image (e.g., image 112 of FIG. 1).

At operation 1206, the user device (e.g., user device 103 of FIG. 1) sends the first image (e.g., image 112 of FIG. 1) to a computing system (e.g., computing system 141 of FIG. 1).

At operation 1208, the computing system (e.g., computing system 141 of FIG. 1) identifies a first type (e.g., type 114 of FIG. 1) of the filter (e.g., filter 242 of FIG. 2) based on the first image (e.g., image 112 of FIG. 1).

At operation 1210, the computing system (e.g., computing system 141 of FIG. 1) receives a second image (e.g., image 147 of FIG. 1) of a front side of a used filter of the first type (e.g., type 114 of FIG. 1) from an image library (e.g., image library 146 of FIG. 1).

At operation 1212, the computing system (e.g., computing system 141 of FIG. 1) determines a first depth (e.g., depth 119 of FIG. 1) of first pleats (e.g., pleats 113 of FIGS. 3A-3C) of the filter (e.g., filter 242 of FIG. 2) based on the first image (e.g., image 112 of FIG. 1).

At operation 1214, the computing system (e.g., computing system 141 of FIG. 1) determine a second depth (e.g., depth threshold 120 of FIG. 1) of second pleats (e.g., pleats 113 of FIGS. 3A-3C) of the used filter based on the second image (e.g., image 147 of FIG. 1).

At operation 1216, the computing system (e.g., computing system 141 of FIG. 1) compares the first depth (e.g., depth 119 of FIG. 1) to the second depth (e.g., depth threshold 120 of FIG. 1).

At operation 1218, the computing system (e.g., computing system 141 of FIG. 1) determines if the first depth (e.g., depth 119 of FIG. 1) is greater than the second depth (e.g., depth threshold 120 of FIG. 1).

In response to determining at operation 1218 that the first depth (e.g., depth 119 of FIG. 1) is greater than the second depth (e.g., depth threshold 120 of FIG. 1), process 1200 continues to operation 1220.

At operation 1220, the computing system (e.g., computing system 141 of FIG. 1) classifies the filter (e.g., filter 242 of FIG. 2) as acceptable. After performing operation 1220, process 1200 ends.

In response to determining at operation 1218 that the first depth (e.g., depth 119 of FIG. 1) is not greater than the second depth (e.g., depth threshold 120 of FIG. 1), process 1200 continues to operation 1222.

At operation 1222, the computing system (e.g., computing system 141 of FIG. 1) classifies the filter (e.g., filter 242 of FIG. 2) as dirty. After performing operation 1222, process 1200 ends.

In other embodiments, operations 1208 through 1222 of process 1200 may be performed by the user device (e.g., user device 103 of FIG. 1) instead of the computing system (e.g., computing system 141 of FIG. 1). In such embodiments, operation 1206 is omitted from process 1200.

Figure 13A:
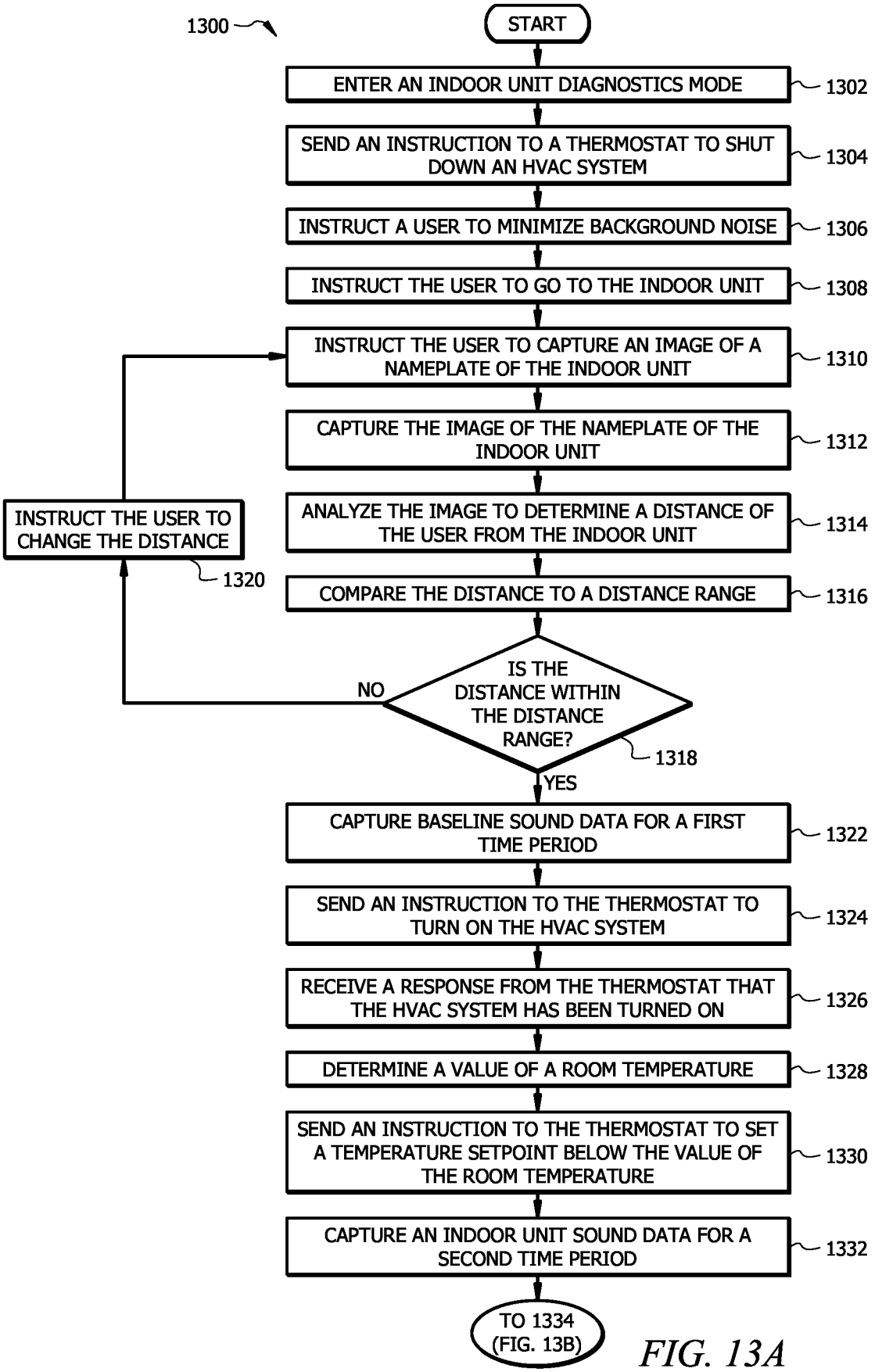
FIGS. 13A and 13B illustrate a flowchart of an embodiment of a diagnostic process for an indoor unit of an HVAC system operating in a cooling mode.
Figure 13B:
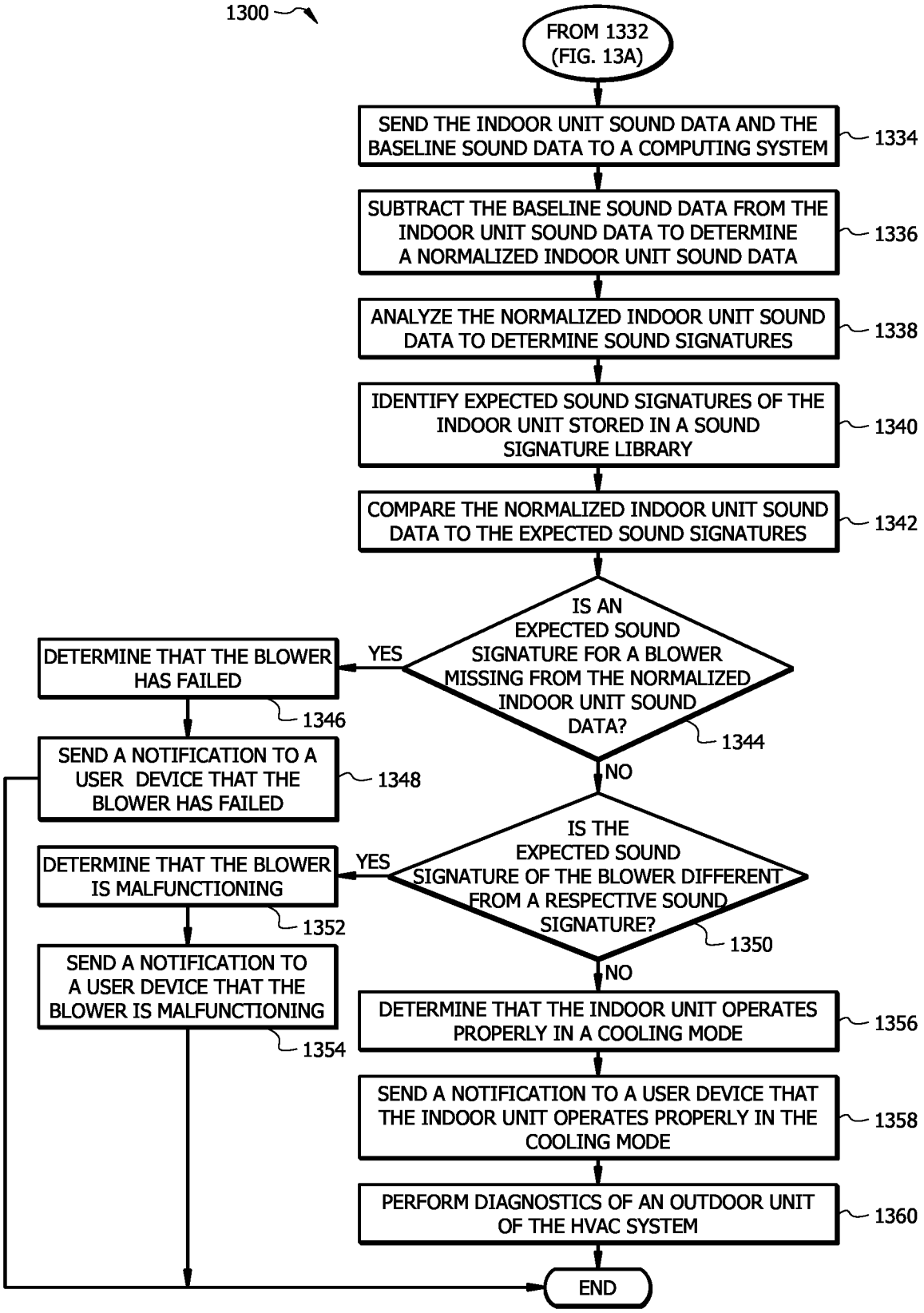

An Example Diagnostic Process for an Indoor Unit of an HVAC System Operating in a Cooling Mode FIGS. 13A and 13B illustrate a flowchart of an embodiment of a diagnostic process 1300 for an indoor unit (e.g., indoor unit 202 of FIG. 2) of an HVAC system (e.g., HVAC system 140 of FIGS. 1 and 2) operating in a cooling mode. The diagnostic process 1300 may be used to implement operation 1040 of diagnostic process 1000 (see FIG. 10). Modifications, additions, or omissions may be made to process 1300. Process 1300 may include more, fewer, or other operations. For example, operations may be performed in parallel or in any suitable order. For example, one or more operations of process 1300 may be implemented, at least in part, in the form of the software instructions (e.g., instructions 110, 139, and/or 145, and/or application 111 of FIG. 1), stored on non-transitory, tangible, machine-readable medium (e.g., memories 109, 138, and/or 144 of FIG. 1) that when executed by one or more processors (e.g., processors 104, 136, and/or 142 of FIG. 1) may cause the one or more processors to perform operations 1302-1360.

At operation 1302, a user device (e.g., user device 103 of FIG. 1) enters an indoor unit diagnostics mode.

At operation 1304, the user device (e.g., user device 103 of FIG. 1) sends an instruction (e.g., instruction 156 of FIG. 1) to the thermostat (e.g., thermostat 135 of FIG. 1) to shut down the HVAC system 140.

At operation 1306, the user device (e.g., user device 103 of FIG. 1) instructs a user (e.g., user 102 of FIG. 1) to minimize background noise.

At operation 1308, the user device (e.g., user device 103 of FIG. 1) instructs a user (e.g., user 102 of FIG. 1) to go to the indoor unit (e.g., indoor unit 202 of FIG. 2).

At operation 1310, the user device (e.g., user device 103 of FIG. 1) instructs the user (e.g., user 102 of FIG. 1) to capture an image (e.g., image 134 of FIG. 1) of a nameplate (e.g., nameplate 248 of FIG. 2) of the indoor unit (e.g., indoor unit 202 of FIG. 2).

At operation 1312, the user device (e.g., user device 103 of FIG. 1) captures the image (e.g., image 134 of FIG. 1) of the nameplate (e.g., nameplate 248 of FIG. 2) of the indoor unit (e.g., indoor unit 202 of FIG. 2). For example, a camera (e.g., camera 107 of FIG. 1) of the user device (e.g., user device 103 of FIG. 1) is configured to capture the image (e.g., image 134 of FIG. 1) of the nameplate (e.g., nameplate 248 of FIG. 2) of the indoor unit (e.g., indoor unit 202 of FIG. 2).

At operation 1314, the user device (e.g., user device 103 of FIG. 1) analyzes the image (e.g., image 134 of FIG. 1) to determine a distance (e.g., distance 121 of FIG. 1) of the user (e.g., user 102 of FIG. 1) from the indoor unit (e.g., indoor unit 202 of FIG. 2).

At operation 1316, the user device (e.g., user device 103 of FIG. 1) compare the distance (e.g., distance 121 of FIG. 1) to a distance range (e.g., distance range 122 of FIG. 1). In certain embodiments, the distance range may be from 15 cm to 25 cm.

At operation 1318, the user device (e.g., user device 103 of FIG. 1) determines if the distance (e.g., distance 121 of FIG. 1) is within the distance range (e.g., distance range 122 of FIG. 1).

In response to determining at operation 1318 that the distance (e.g., distance 121 of FIG. 1) is not within the distance range (e.g., distance range 122 of FIG. 1), process 1300 continues to operation 1320.

At operation 1320, the user device (e.g., user device 103 of FIG. 1) instructs the user (e.g., user 102 of FIG. 1) to change the distance (e.g., distance 121 of FIG. 1). Subsequently, process 1300 repeats operations 1310 through 1320 until the distance (e.g., distance 121 of FIG. 1) is within the distance range (e.g., distance range 122 of FIG. 1).

In response to determining at operation 1318 that the distance (e.g., distance 121 of FIG. 1) is within the distance range (e.g., distance range 122 of FIG. 1), process 1300 continues to operation 1322.

At operation 1322, the user device (e.g., user device 103 of FIG. 1) captures baseline sound data (e.g., baseline sound data 123 of FIG. 1) for a first time period (e.g., time period 127 of FIG. 1). For example, the first time period (e.g., time period 127 of FIG. 1) may be 10 sec. In certain embodiments, a microphone (e.g., microphone 108 of FIG. 1) is configured to capture the baseline sound data (e.g., baseline sound data 123 of FIG. 1).

At operation 1324, the user device (e.g., user device 103 of FIG. 1) sends an instruction (e.g., instruction 156 of FIG. 1) to the thermostat (e.g., thermostat 135 of FIG. 1) to turn on the HVAC system 140.

At operation 1326, the user device (e.g., user device 103 of FIG. 1) receives a response (e.g., response 157 of FIG. 1) from the thermostat (e.g., thermostat 135 of FIG. 1) that the HVAC system 140 has been turned on.

At operation 1328, the user device (e.g., user device 103 of FIG. 1) determines a value of a room temperature (e.g., temperature 131 of FIG. 1). For example, the user device (e.g., user device 103 of FIG. 1) may obtain the value of the room temperature (e.g., temperature 131 of FIG. 1) from the thermostat (e.g., thermostat 135 of FIG. 1).

At operation 1330, the user device (e.g., user device 103 of FIG. 1) sends an instruction (e.g., instruction 156 of FIG. 1) to the thermostat (e.g., thermostat 135 of FIG. 1) to set a temperature setpoint (e.g., temperature setpoint 130 of FIG. 1) below the value of the room temperature (e.g., temperature 131 of FIG. 1). In certain embodiments, the temperature setpoint (e.g., temperature setpoint 130 of FIG. 1) is set 5° F. below the value of the room temperature (e.g., temperature 131 of FIG. 1).

At operation 1332, the user device (e.g., user device 103 of FIG. 1) captures indoor unit sound data (e.g., indoor unit sound data 124 of FIG. 1) for a second time period (e.g., time period 128 of FIG. 1). For example, the second time period (e.g., time period 128 of FIG. 1) may be 60 sec. In certain embodiments, the microphone (e.g., microphone 108 of FIG. 1) is configured to capture the indoor unit sound data (e.g., indoor unit sound data 124 of FIG. 1).

At operation 1334, the user device (e.g., user device 103 of FIG. 1) sends the indoor unit sound data (e.g., indoor unit sound data 124 of FIG. 1) and the baseline sound data (e.g., baseline sound data 123 of FIG. 1) to a computing system (e.g., computing system 141 of FIG. 1).

At operation 1336, the computing system (e.g., computing system 141 of FIG. 1) subtracts the baseline sound data (e.g., baseline sound data 123 of FIG. 1) from the indoor unit sound data (e.g., indoor unit sound data 124 of FIG. 1) to determine a normalized indoor unit sound data (e.g., normalized indoor unit sound data 152 of FIG. 1).

At operation 1338, the computing system (e.g., computing system 141 of FIG. 1) analyzes the normalized indoor unit sound data (e.g., normalized indoor unit sound data 152 of FIG. 1) to determine sound signatures (e.g., sound signatures 155 of FIG. 1).

At operation 1340, the computing system (e.g., computing system 141 of FIG. 1) identifies expected sound signatures (e.g., expected sound signatures 150 of FIG. 1) of the indoor unit (e.g., indoor unit 202 of FIG. 2) stored in a sound signature library (e.g., sound signature library 149 of FIG. 1). For example, the computing system (e.g., computing system 141 of FIG. 1) determines component identifiers (e.g., component identifiers 151 of FIG. 1) of various components of the indoor unit (e.g., indoor unit 202 of FIG. 2) and identifies expected sound signatures (e.g., expected sound signatures 150 of FIG. 1) corresponding to the component identifiers (e.g., component identifiers 151 of FIG. 1).

At operation 1342, the computing system (e.g., computing system 141 of FIG. 1) compares the normalized indoor unit sound data (e.g., normalized indoor unit sound data 152 of FIG. 1) to the expected sound signatures (e.g., expected sound signatures 150 of FIG. 1).

At operation 1344, the computing system (e.g., computing system 141 of FIG. 1) determines if an expected sound signature (e.g., sound signature 404 of FIG. 4) for a blower (e.g., blower 244 of FIG. 2) is missing from the normalized indoor unit sound data (e.g., normalized indoor unit sound data 152 of FIG. 1).

In response to determining at operation 1344 that the expected sound signature (e.g., sound signature 404 of FIG. 4) for the blower (e.g., blower 244 of FIG. 2) is missing from the normalized indoor unit sound data (e.g., normalized indoor unit sound data 152 of FIG. 1), process 1300 continues to operation 1346.

At operation 1346, the computing system (e.g., computing system 141 of FIG. 1) determine that the blower (e.g., blower 244 of FIG. 2) has failed.

At operation 1348, the computing system (e.g., computing system 141 of FIG. 1) sends a notification (e.g., notification 160 of FIG. 1) to the user device (e.g., user device 103 of FIG. 1) that the blower (e.g., blower 244 of FIG. 2) has failed. After performing operation 1348, process 1300 ends.

In response to determining at operation 1344 that the expected sound signature (e.g., sound signature 404 of FIG. 4) for the blower (e.g., blower 244 of FIG. 2) is not missing from the normalized indoor unit sound data (e.g., normalized indoor unit sound data 152 of FIG. 1), process 1300 continues to operation 1350.

At operation 1350, the computing system (e.g., computing system 141 of FIG. 1) determines if the expected sound signature (e.g., sound signature 404 of FIG. 4) for the blower (e.g., blower 244 of FIG. 2) is different from a respective sound signature of the blower (e.g., blower 244 of FIG. 2) determined from the normalized indoor unit sound data (e.g., normalized indoor unit sound data 152 of FIG. 1).

In response to determining at operation 1350 that the expected sound signature (e.g., sound signature 404 of FIG. 4) for the blower (e.g., blower 244 of FIG. 2) is different from the respective sound signature of the blower (e.g., blower 244 of FIG. 2) determined from the normalized indoor unit sound data (e.g., normalized indoor unit sound data 152 of FIG. 1), process 1300 continues to operation 1352.

At operation 1352, the computing system (e.g., computing system 141 of FIG. 1) determines that the blower (e.g., blower 244 of FIG. 2) is malfunctioning.

At operation 1354, the computing system (e.g., computing system 141 of FIG. 1) sends a notification (e.g., notification 160 of FIG. 1) to the user device (e.g., user device 103 of FIG. 1) that the blower (e.g., blower 244 of FIG. 2) is malfunctioning. After performing operation 1354, process 1300 ends.

In response to determining at operation 1350 that the expected sound signature (e.g., sound signature 404 of FIG. 4) for the blower (e.g., blower 244 of FIG. 2) is not different from the respective sound signature of the blower (e.g., blower 244 of FIG. 2) determined from the normalized indoor unit sound data (e.g., normalized indoor unit sound data 152 of FIG. 1), process 1300 continues to operation 1356.

At operation 1356, the computing system (e.g., computing system 141 of FIG. 1) determines that the indoor unit (e.g., indoor unit 202 of FIG. 2) operates properly in a cooling mode.

At operation 1358, the computing system (e.g., computing system 141 of FIG. 1) sends a notification (e.g., notification 160 of FIG. 1) to the user device (e.g., user device 103 of FIG. 1) that the indoor unit (e.g., indoor unit 202 of FIG. 2) operates properly in the cooling mode.

At operation 1360, the user device (e.g., user device 103 of FIG. 1) performs diagnostics of an outdoor unit (e.g., outdoor unit 204 of FIG. 2) of the HVAC system 140. After performing operation 1360, process 1300 ends. In certain embodiments, operation 1360 may be implemented by a diagnostic process 1600 described below with reference to FIGS. 16A, 16B, 16C, 16D and 16E.

Figure 14A:
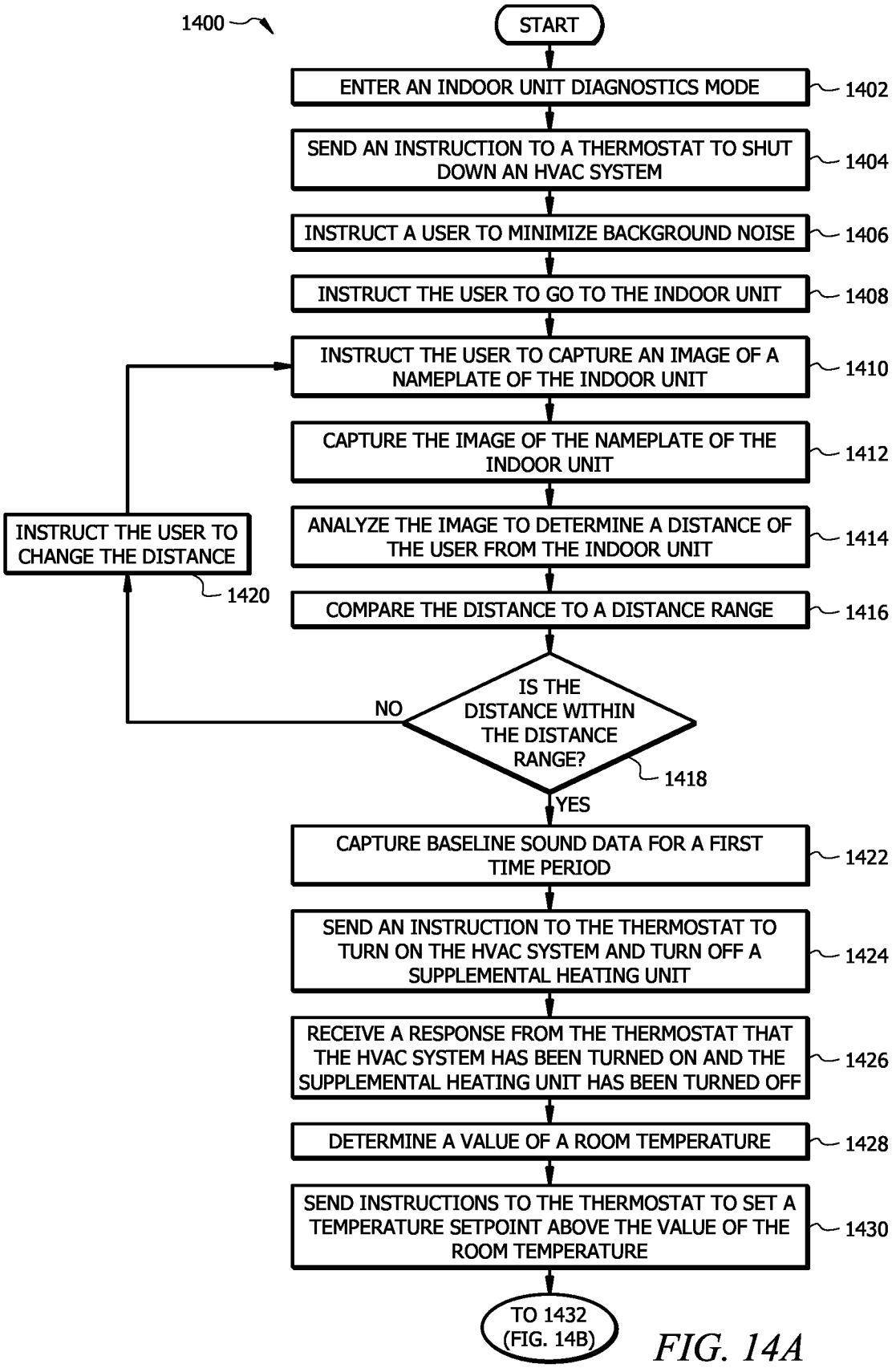
FIGS. 14A and 14B illustrate a flowchart of an embodiment of a diagnostic process for an indoor unit of an HVAC system operating in a heat pump heating mode.
Figure 14B:
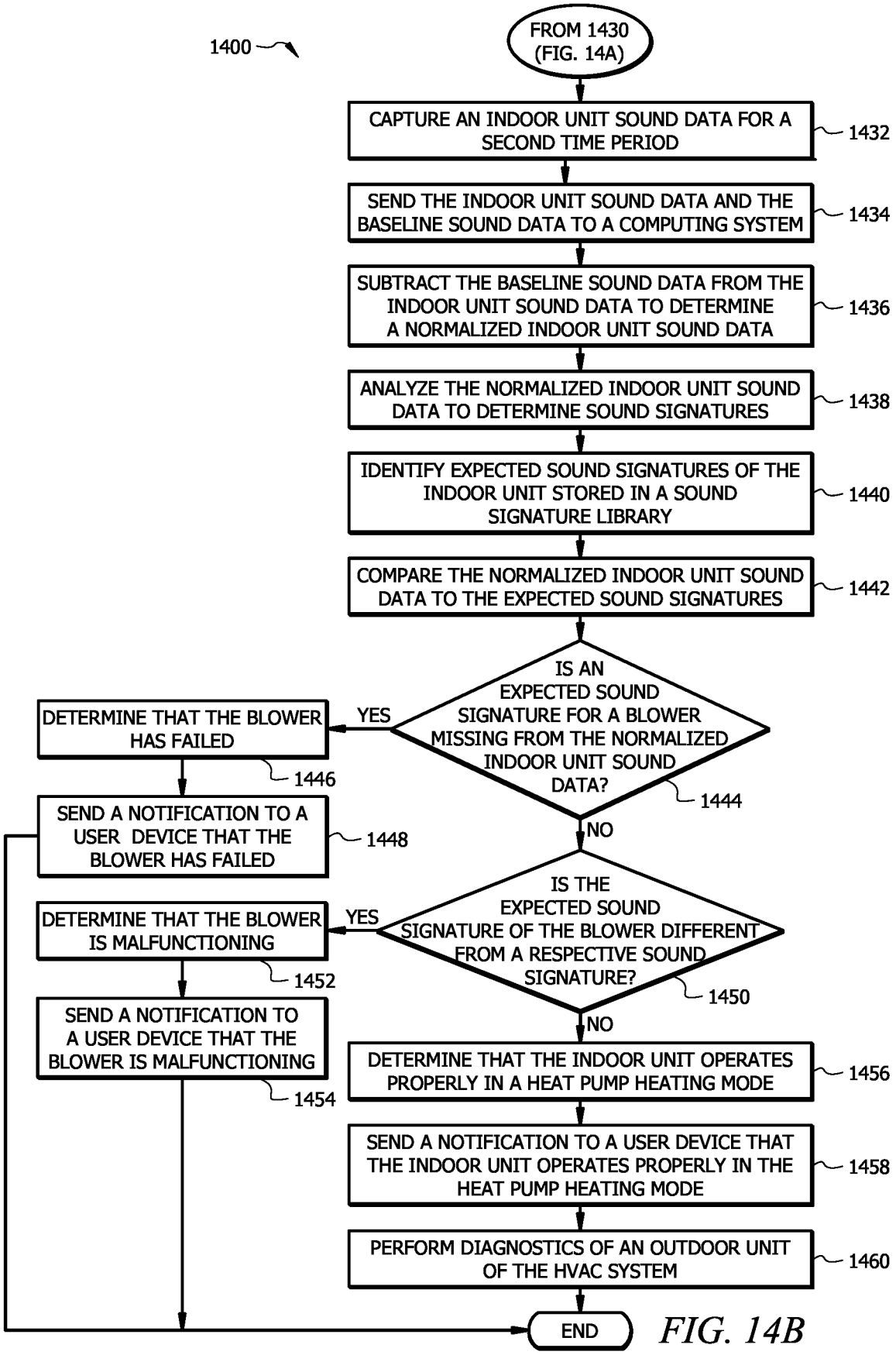

An Example Diagnostic Process for an Indoor Unit of an HVAC System Operating in a Heat Pump Heating Mode FIGS. 14A and 14B illustrate a flowchart of an embodiment of a diagnostic process 1400 for an indoor unit (e.g., indoor unit 202 of FIG. 2) of an HVAC system (e.g., HVAC system 140 of FIGS. 1 and 2) operating in a heat pump heating mode. The diagnostic process 1400 may be used to implement operation 1056 of diagnostic process 1000 (see FIG. 10). Modifications, additions, or omissions may be made to process 1400. Process 1400 may include more, fewer, or other operations. For example, operations may be performed in parallel or in any suitable order. For example, one or more operations of process 1400 may be implemented, at least in part, in the form of the software instructions (e.g., instructions 110, 139, and/or 145, and/or application 111 of FIG. 1), stored on non-transitory, tangible, machine-readable medium (e.g., memories 109, 138, and/or 144 of FIG. 1) that when executed by one or more processors (e.g., processors 104, 136, and/or 142 of FIG. 1) may cause the one or more processors to perform operations 1402-1460.

At operation 1402, a user device (e.g., user device 103 of FIG. 1) enters an indoor unit diagnostics mode.

At operation 1404, the user device (e.g., user device 103 of FIG. 1) sends an instruction (e.g., instruction 156 of FIG. 1) to a thermostat (e.g., thermostat 135 of FIG. 1) to shut down an HVAC system 140.

At operation 1406, the user device (e.g., user device 103 of FIG. 1) instructs a user (e.g., user 102 of FIG. 1) to minimize background noise.

At operation 1408, the user device (e.g., user device 103 of FIG. 1) instructs the user (e.g., user 102 of FIG. 1) to go to the indoor unit (e.g., indoor unit 202 of FIG. 2).

At operation 1410, the user device (e.g., user device 103 of FIG. 1) instructs the user (e.g., user 102 of FIG. 1) to capture an image (e.g., image 134 of FIG. 1) of a nameplate (e.g., nameplate 248 of FIG. 2) of the indoor unit (e.g., indoor unit 202 of FIG. 2).

At operation 1412, the user device (e.g., user device 103 of FIG. 1) captures the image (e.g., image 134 of FIG. 1) of the nameplate (e.g., nameplate 248 of FIG. 2) of the indoor unit (e.g., indoor unit 202 of FIG. 2). For example, a camera (e.g., camera 107 of FIG. 1) of the user device (e.g., user device 103 of FIG. 1) is configured to capture the image (e.g., image 134 of FIG. 1) of the nameplate (e.g., nameplate 248 of FIG. 2) of the indoor unit (e.g., indoor unit 202 of FIG. 2).

At operation 1414, the user device (e.g., user device 103 of FIG. 1) analyzes the image (e.g., image 134 of FIG. 1) to determine a distance (e.g., distance 121 of FIG. 1) of the user (e.g., user 102 of FIG. 1) from the indoor unit (e.g., indoor unit 202 of FIG. 2).

At operation 1416, the user device (e.g., user device 103 of FIG. 1) compares the distance (e.g., distance 121 of FIG. 1) to a distance range (e.g., distance range 122 of FIG. 1). In certain embodiments, the distance range may be from 15 cm to 25 cm.

At operation 1418, the user device (e.g., user device 103 of FIG. 1) determines if the distance (e.g., distance 121 of FIG. 1) is within the distance range (e.g., distance range 122 of FIG. 1).

In response to determining at operation 1418 that the distance (e.g., distance 121 of FIG. 1) is not within the distance range (e.g., distance range 122 of FIG. 1), process 1400 continues to operation 1420.

At operation 1420, the user device (e.g., user device 103 of FIG. 1) instructs the user (e.g., user 102 of FIG. 1) to change the distance (e.g., distance 121 of FIG. 1). Subsequently, process 1400 repeats operations 1410 through 1420 until the distance (e.g., distance 121 of FIG. 1) is within the distance range (e.g., distance range 122 of FIG. 1).

In response to determining at operation 1418 that the distance (e.g., distance 121 of FIG. 1) is within the distance range (e.g., distance range 122 of FIG. 1), process 1400 continues to operation 1422.

At operation 1422, the user device (e.g., user device 103 of FIG. 1) captures baseline sound data (e.g., baseline sound data 123 of FIG. 1) for a first time period (e.g., time period 127 of FIG. 1). For example, the first time period (e.g., time period 127 of FIG. 1) may be 10 sec. In certain embodiments, a microphone (e.g., microphone 108 of FIG. 1) is configured to capture the baseline sound data (e.g., baseline sound data 123 of FIG. 1).

At operation 1424, the user device (e.g., user device 103 of FIG. 1) sends an instruction (e.g., instruction 156 of FIG. 1) to the thermostat (e.g., thermostat 135 of FIG. 1) to turn on the HVAC system 140 and turn off a supplemental heating unit (e.g., heating unit 234 of FIG. 2).

At operation 1426, the user device (e.g., user device 103 of FIG. 1) receives a response (e.g., response 157 of FIG. 1) from the thermostat (e.g., thermostat 135 of FIG. 1) that the HVAC system 140 has been turned on and the supplemental heating unit (e.g., heating unit 234 of FIG. 2) has been turned off.

At operation 1428, the user device (e.g., user device 103 of FIG. 1) determines a value of a room temperature (e.g., temperature 131 of FIG. 1). For example, the user device (e.g., user device 103 of FIG. 1) may obtain the value of the room temperature (e.g., temperature 131 of FIG. 1) from the thermostat (e.g., thermostat 135 of FIG. 1).

At operation 1430, the user device (e.g., user device 103 of FIG. 1) sends an instruction (e.g., instruction 156 of FIG. 1) to the thermostat (e.g., thermostat 135 of FIG. 1) to set a temperature setpoint (e.g., temperature setpoint 130 of FIG. 1) above the value of the room temperature (e.g., temperature 131 of FIG. 1). In certain embodiments, the temperature setpoint (e.g., temperature setpoint 130 of FIG. 1) is set 5° F. above the value of the room temperature (e.g., temperature 131 of FIG. 1).

At operation 1432, the user device (e.g., user device 103 of FIG. 1) captures indoor unit sound data (e.g., indoor unit sound data 124 of FIG. 1) for a second time period (e.g., time period 128 of FIG. 1). For example, the second time period (e.g., time period 128 of FIG. 1) may be 60 sec. In certain embodiments, the microphone (e.g., microphone 108 of FIG. 1) is configured to capture the indoor unit sound data (e.g., indoor unit sound data 124 of FIG. 1).

At operation 1434, the user device (e.g., user device 103 of FIG. 1) sends the indoor unit sound data (e.g., indoor unit sound data 124 of FIG. 1) and the baseline sound data (e.g., baseline sound data 123 of FIG. 1) to a computing system (e.g., computing system 141 of FIG. 1).

At operation 1436, the computing system (e.g., computing system 141 of FIG. 1) subtracts the baseline sound data (e.g., baseline sound data 123 of FIG. 1) from the indoor unit sound data (e.g., indoor unit sound data 124 of FIG. 1) to determine a normalized indoor unit sound data (e.g., normalized indoor unit sound data 152 of FIG. 1).

At operation 1438, the computing system (e.g., computing system 141 of FIG. 1) analyzes the normalized indoor unit sound data (e.g., normalized indoor unit sound data 152 of FIG. 1) to determine sound signatures (e.g., sound signatures 155 of FIG. 1).

At operation 1440, the computing system (e.g., computing system 141 of FIG. 1) identifies expected sound signatures (e.g., expected sound signatures 150 of FIG. 1) of the indoor unit (e.g., indoor unit 202 of FIG. 2) stored in a sound signature library (e.g., sound signature library 149 of FIG. 1). For example, the computing system (e.g., computing system 141 of FIG. 1) determines component identifiers (e.g., component identifiers 151 of FIG. 1) of various components of the indoor unit (e.g., indoor unit 202 of FIG. 2) and identifies expected sound signatures (e.g., expected sound signatures 150 of FIG. 1) corresponding to the component identifiers (e.g., component identifiers 151 of FIG. 1).

At operation 1442, the computing system (e.g., computing system 141 of FIG. 1) compares the normalized indoor unit sound data (e.g., normalized indoor unit sound data 152 of FIG. 1) to the expected sound signatures (e.g., expected sound signatures 150 of FIG. 1).

At operation 1444, the computing system (e.g., computing system 141 of FIG. 1) determines if an expected sound signature (e.g., sound signature 504 of FIG. 5) for a blower (e.g., blower 244 of FIG. 2) is missing from the normalized indoor unit sound data (e.g., normalized indoor unit sound data 152 of FIG. 1).

In response to determining at operation 1444 that the expected sound signature (e.g., sound signature 504 of FIG. 5) for the blower (e.g., blower 244 of FIG. 2) is missing from the normalized indoor unit sound data (e.g., normalized indoor unit sound data 152 of FIG. 1), process 1400 continues to operation 1446.

At operation 1446, the computing system (e.g., computing system 141 of FIG. 1) determine that the blower (e.g., blower 244 of FIG. 2) has failed.

At operation 1448, the computing system (e.g., computing system 141 of FIG. 1) sends a notification (e.g., notification 160 of FIG. 1) to the user device (e.g., user device 103 of FIG. 1) that the blower (e.g., blower 244 of FIG. 2) has failed. After performing operation 1448, process 1400 ends.

In response to determining at operation 1444 that the expected sound signature (e.g., sound signature 504 of FIG. 5) for the blower (e.g., blower 244 of FIG. 2) is not missing from the normalized indoor unit sound data (e.g., normalized indoor unit sound data 152 of FIG. 1), process 1400 continues to operation 1450.

At operation 1450, the computing system (e.g., computing system 141 of FIG. 1) determines if the expected sound signature (e.g., sound signature 504 of FIG. 5) for the blower (e.g., blower 244 of FIG. 2) is different from a respective sound signature of the blower (e.g., blower 244 of FIG. 2) determined from the normalized indoor unit sound data (e.g., normalized indoor unit sound data 152 of FIG. 1).

In response to determining at operation 1450 that the expected sound signature (e.g., sound signature 504 of FIG. 5) for the blower (e.g., blower 244 of FIG. 2) is different from the respective sound signature of the blower (e.g., blower 244 of FIG. 2) determined from the normalized indoor unit sound data (e.g., normalized indoor unit sound data 152 of FIG. 1), process 1400 continues to operation 1452.

At operation 1452, the computing system (e.g., computing system 141 of FIG. 1) determines that the blower (e.g., blower 244 of FIG. 2) is malfunctioning.

At operation 1454, the computing system (e.g., computing system 141 of FIG. 1) sends a notification (e.g., notification 160 of FIG. 1) to the user device (e.g., user device 103 of FIG. 1) that the blower (e.g., blower 244 of FIG. 2) is malfunctioning. After performing operation 1454, process 1400 ends.

In response to determining at operation 1450 that the expected sound signature (e.g., sound signature 504 of FIG. 4) for the blower (e.g., blower 244 of FIG. 2) is not different from the respective sound signature of the blower (e.g., blower 244 of FIG. 2) determined from the normalized indoor unit sound data (e.g., normalized indoor unit sound data 152 of FIG. 1), process 1400 continues to operation 1456.

At operation 1456, the computing system (e.g., computing system 141 of FIG. 1) determines that the indoor unit (e.g., indoor unit 202 of FIG. 2) operates properly in a heat pump heating mode.

At operation 1458, the computing system (e.g., computing system 141 of FIG. 1) sends a notification (e.g., notification 160 of FIG. 1) to the user device (e.g., user device 103 of FIG. 1) that the indoor unit (e.g., indoor unit 202 of FIG. 2) operates properly in the heat pump heating mode.

At operation 1460, the user device (e.g., user device 103 of FIG. 1) performs diagnostics of an outdoor unit (e.g., outdoor unit 204 of FIG. 2) of the HVAC system 140. After performing operation 1460, process 1400 ends. In certain embodiments, operation 1460 may be implemented by a diagnostic process 1600 described below with reference to FIGS. 16A, 16B, 16C, 16D and 16E.

Figure 15A:
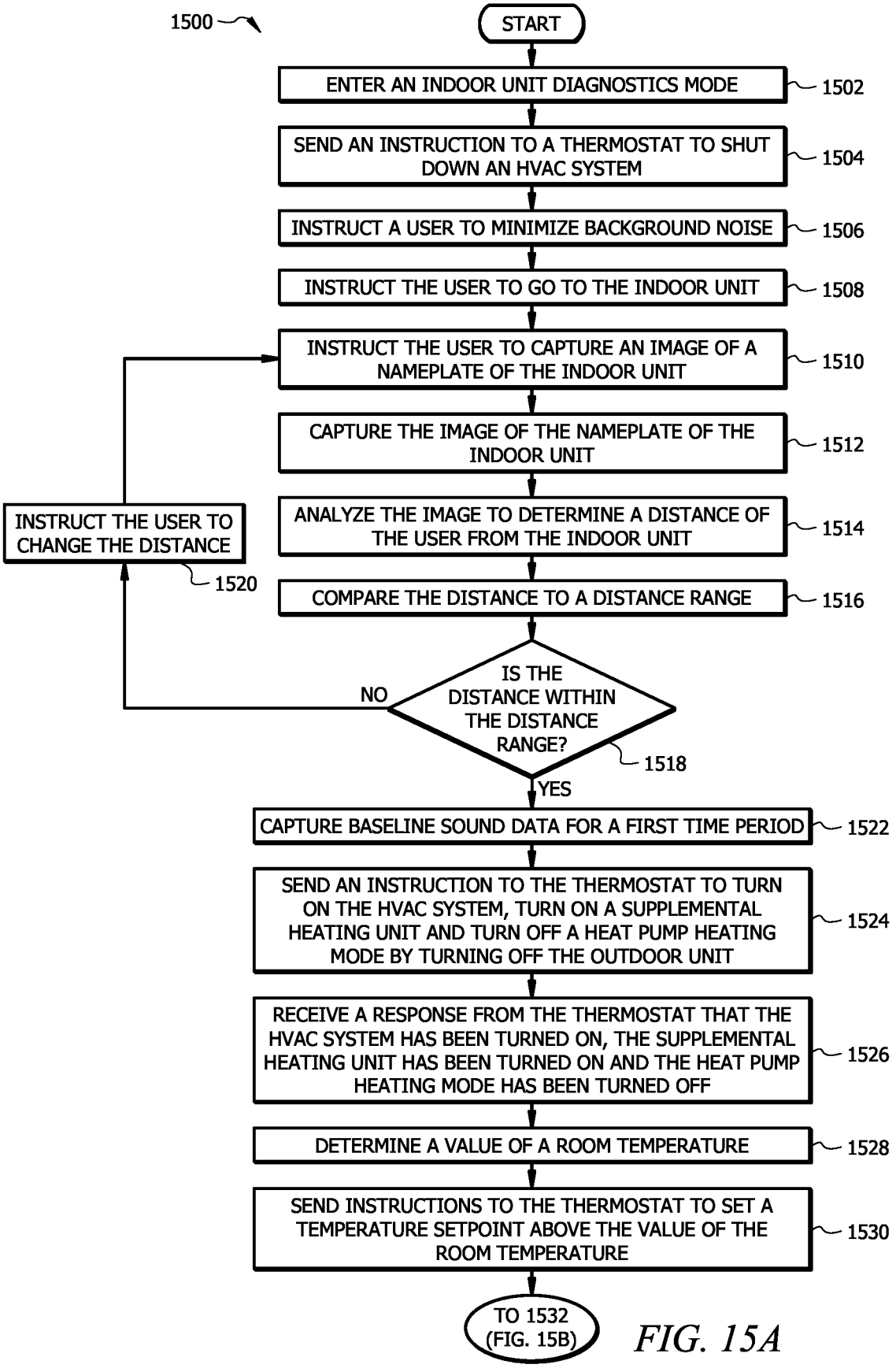
FIGS. 15A, 15B, and 15C illustrate a flowchart of an embodiment of a diagnostic process for an indoor unit of an HVAC system operating in a supplemental heating mode.
Figure 15B:
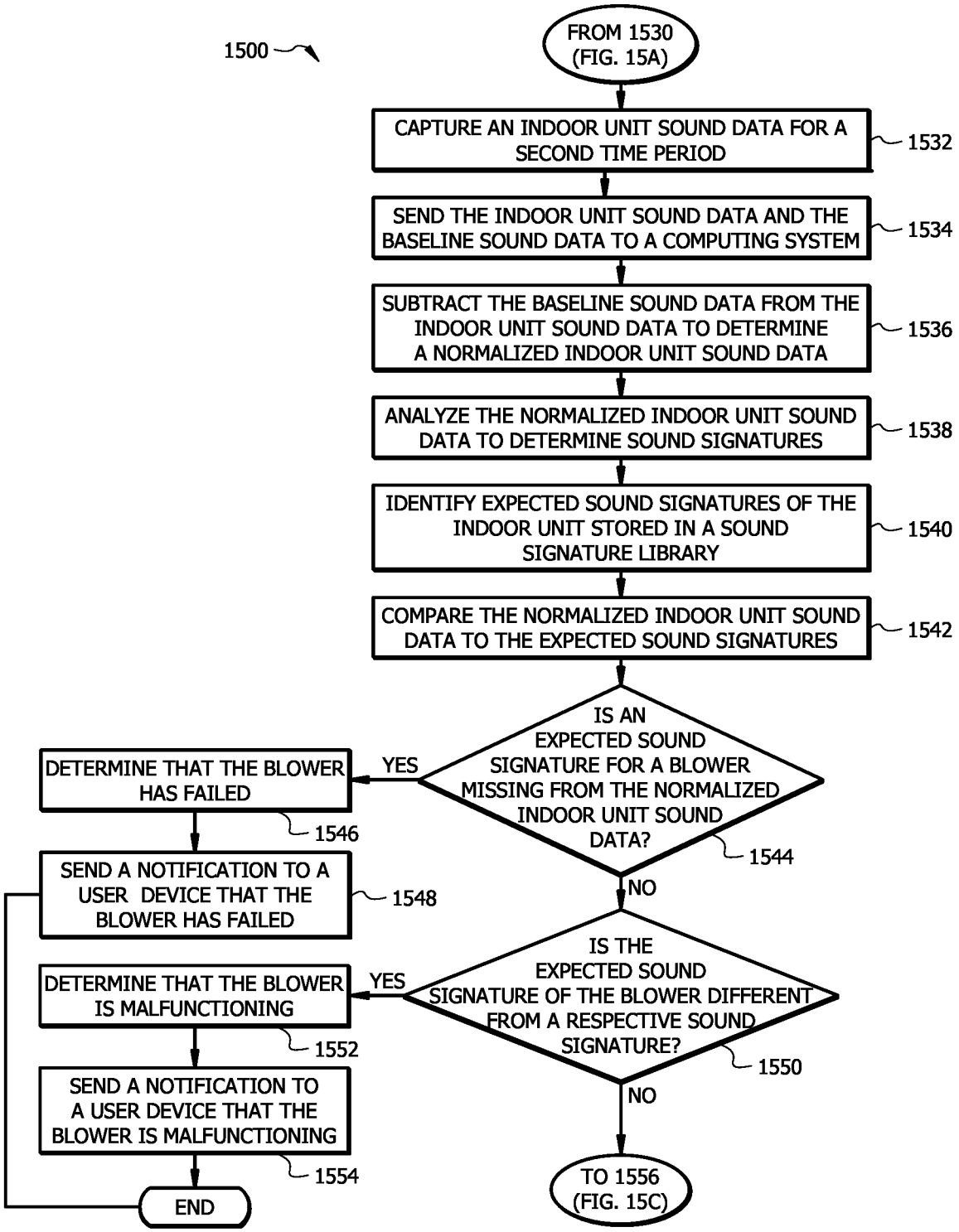
Figure 15C:
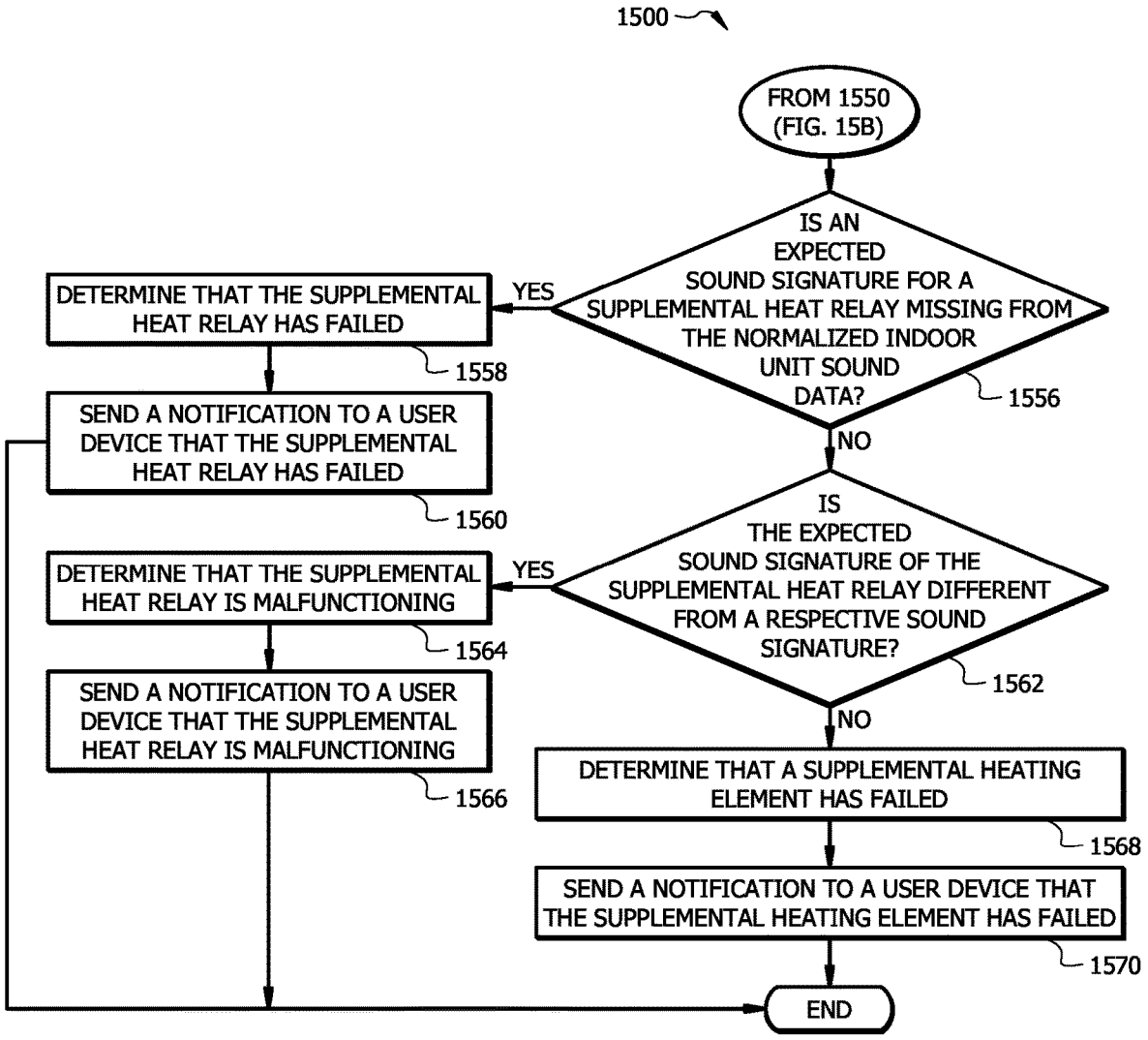
Figure 16A:
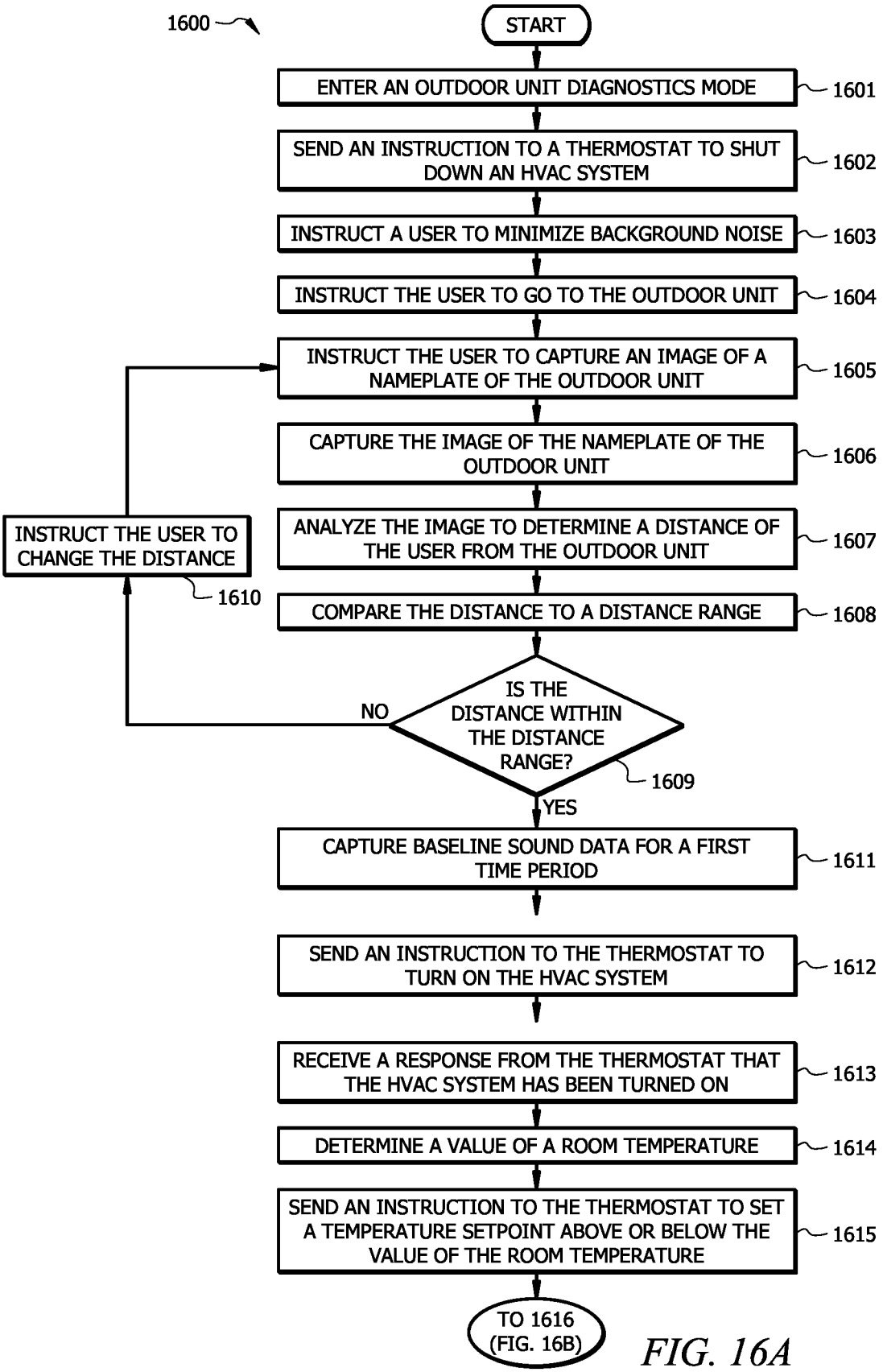
FIGS. 16A, 16B, 16C, 16D, and 16E illustrate a flowchart of an embodiment of a diagnostic process for an outdoor unit of an HVAC system.
Figure 16B:
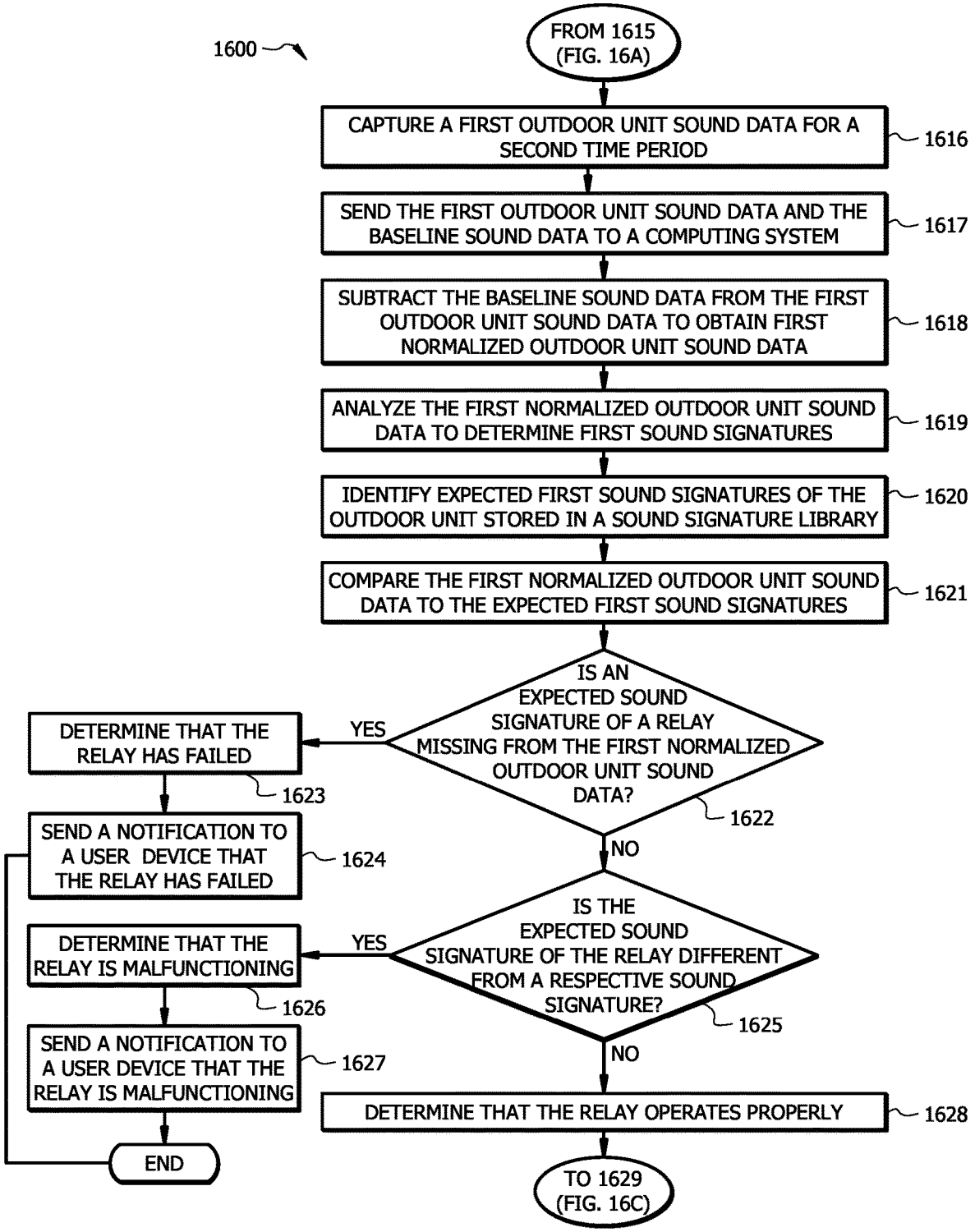
Figure 16C:
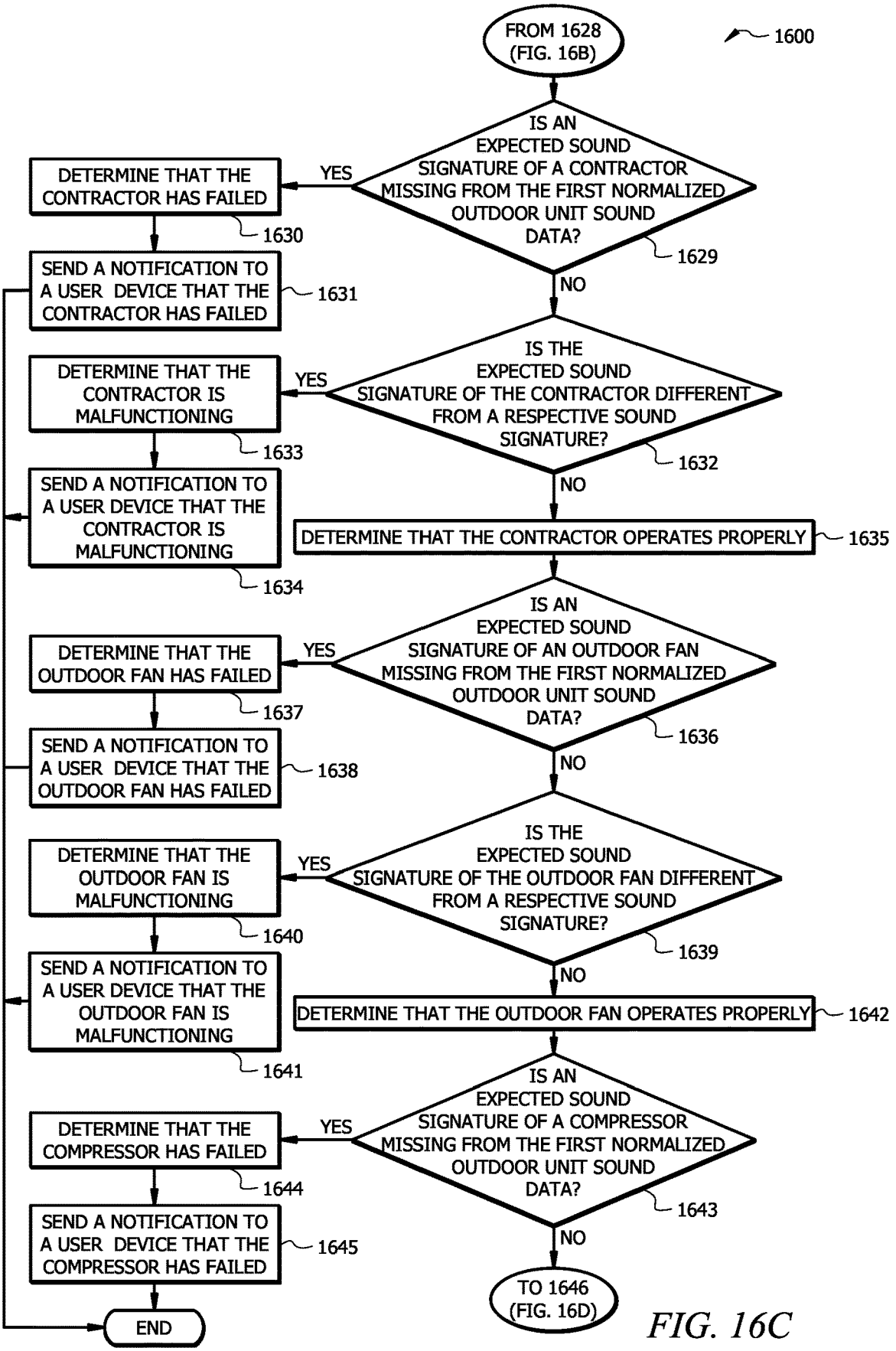
Figure 16D:
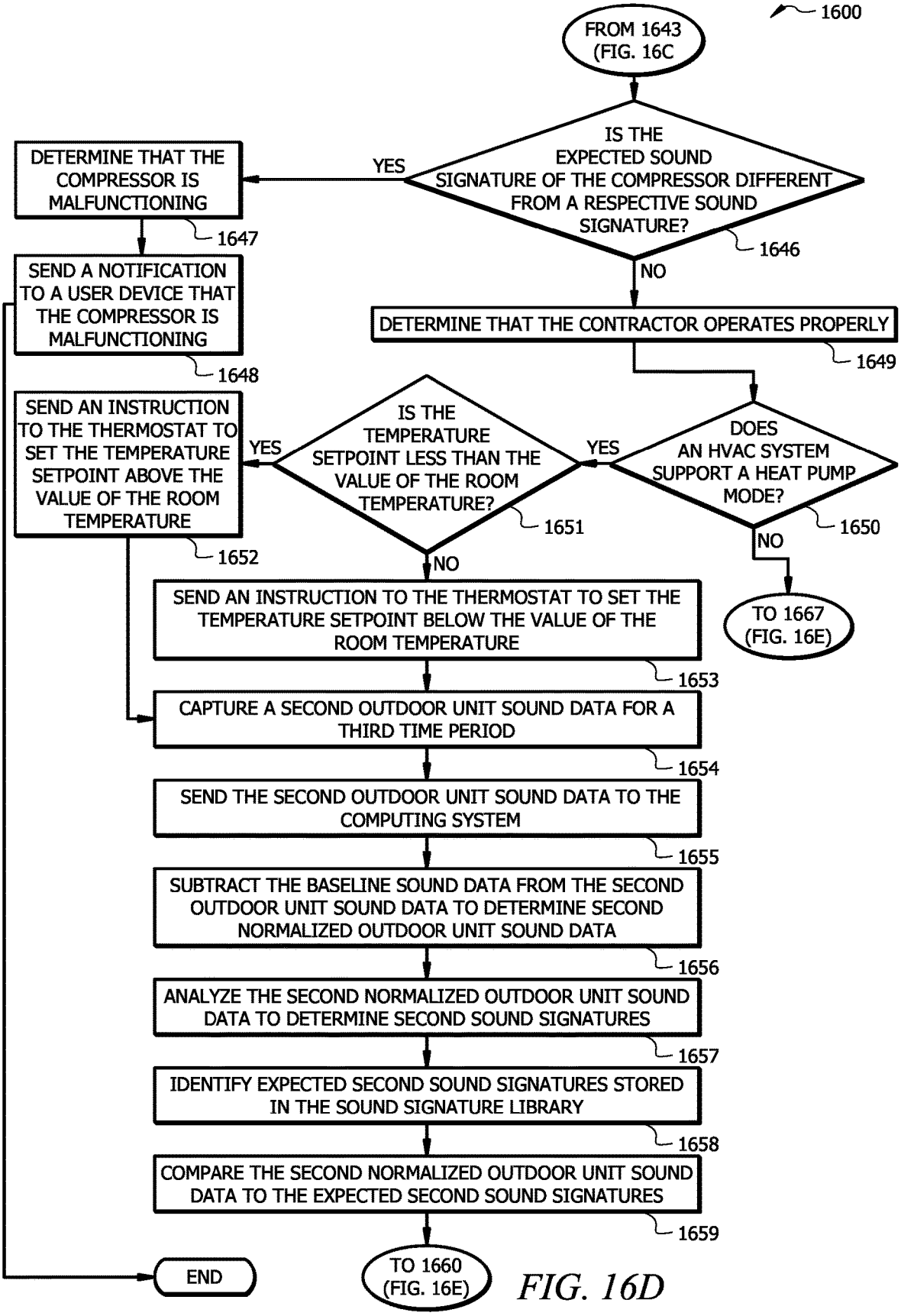
Figure 16E:
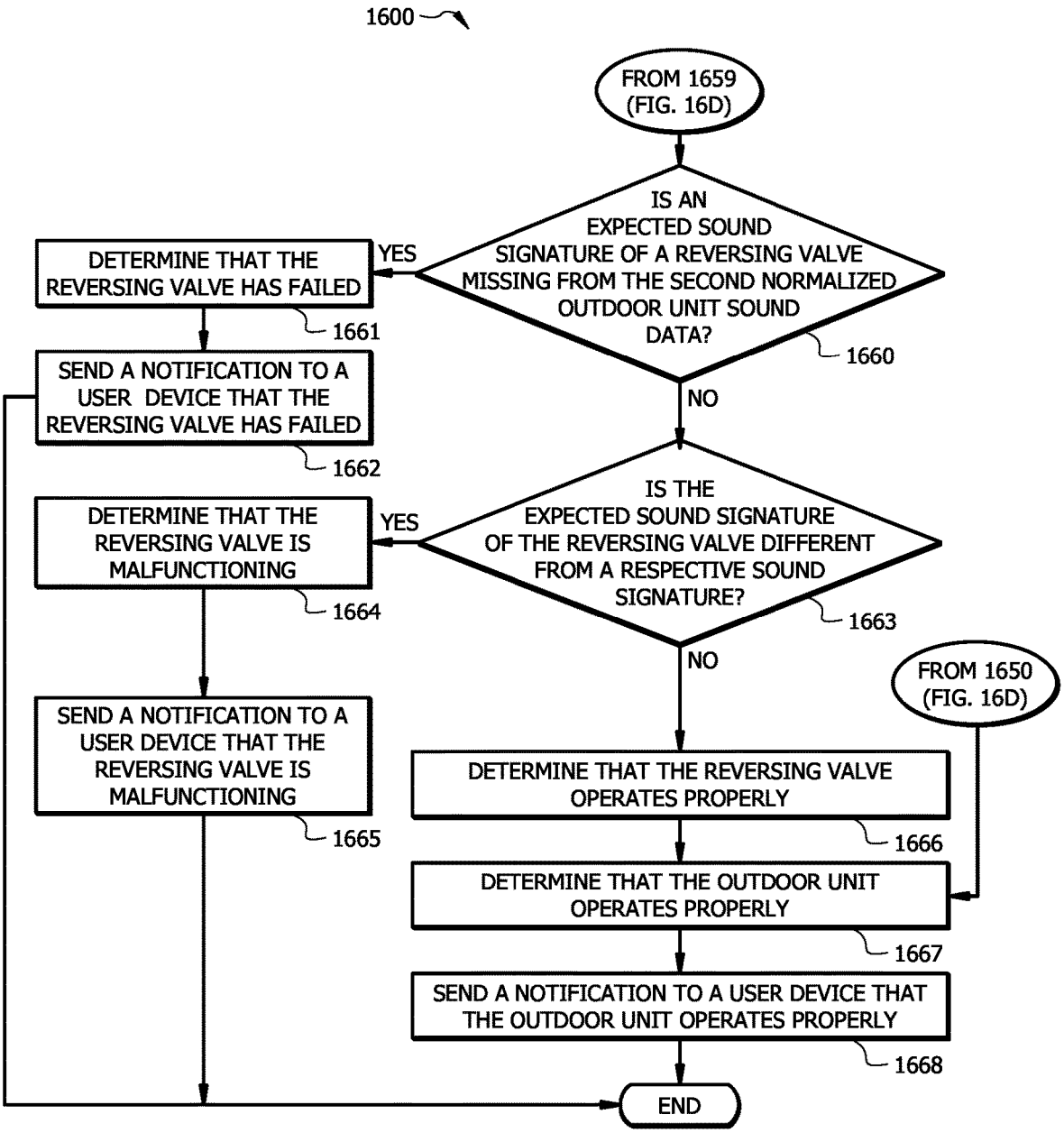

An Example Diagnostic Process for an Indoor Unit of an HVAC System Operating in a Supplemental Heating Mode FIGS. 15A, 15B and 15C illustrate a flowchart of an embodiment of a diagnostic process 1500 for an indoor unit (e.g., indoor unit 202 of FIG. 2) of an HVAC system (e.g., HVAC system 140 of FIGS. 1 and 2) operating in a supplemental heating mode. The diagnostic process 1500 may be used to implement operation 1068 of diagnostic process 1000 (see FIG. 10). Modifications, additions, or omissions may be made to process 1500. Process 1500 may include more, fewer, or other operations. For example, operations may be performed in parallel or in any suitable order. For example, one or more operations of process 1500 may be implemented, at least in part, in the form of the software instructions (e.g., instructions 110, 139, and/or 145, and/or application 111 of FIG. 1), stored on non-transitory, tangible, machine-readable medium (e.g., memories 109, 138, and/or 144 of FIG. 1) that when executed by one or more processors (e.g., processors 104, 136, and/or 142 of FIG. 1) may cause the one or more processors to perform operations 1502-1570.

At operation 1502, a user device (e.g., user device 103 of FIG. 1) enters an indoor unit diagnostics mode.

At operation 1504, the user device (e.g., user device 103 of FIG. 1) sends an instruction (e.g., instruction 156 of FIG. 1) to a thermostat (e.g., thermostat 135 of FIG. 1) to shut down an HVAC system 140.

At operation 1506, the user device (e.g., user device 103 of FIG. 1) instructs a user (e.g., user 102 of FIG. 1) to minimize background noise.

At operation 1508, the user device (e.g., user device 103 of FIG. 1) instructs the user (e.g., user 102 of FIG. 1) to go to the indoor unit (e.g., indoor unit 202 of FIG. 2).

At operation 1510, the user device (e.g., user device 103 of FIG. 1) instructs the user (e.g., user 102 of FIG. 1) to capture an image (e.g., image 134 of FIG. 1) of a nameplate (e.g., nameplate 248 of FIG. 2) of the indoor unit (e.g., indoor unit 202 of FIG. 2).

At operation 1512, the user device (e.g., user device 103 of FIG. 1) captures the image (e.g., image 134 of FIG. 1) of the nameplate (e.g., nameplate 248 of FIG. 2) of the indoor unit (e.g., indoor unit 202 of FIG. 2). For example, a camera (e.g., camera 107 of FIG. 1) of the user device (e.g., user device 103 of FIG. 1) is configured to capture the image (e.g., image 134 of FIG. 1) of the nameplate (e.g., nameplate 248 of FIG. 2) of the indoor unit (e.g., indoor unit 202 of FIG. 2).

At operation 1514, the user device (e.g., user device 103 of FIG. 1) analyzes the image (e.g., image 134 of FIG. 1) to determine a distance (e.g., distance 121 of FIG. 1) of the user (e.g., user 102 of FIG. 1) from the indoor unit (e.g., indoor unit 202 of FIG. 2).

At operation 1516, the user device (e.g., user device 103 of FIG. 1) compares the distance (e.g., distance 121 of FIG. 1) to a distance range (e.g., distance range 122 of FIG. 1). In certain embodiments, the distance range may be from 15 cm to 25 cm.

At operation 1518, the user device (e.g., user device 103 of FIG. 1) determines if the distance (e.g., distance 121 of FIG. 1) is within the distance range (e.g., distance range 122 of FIG. 1).

In response to determining at operation 1518 that the distance (e.g., distance 121 of FIG. 1) is not within the distance range (e.g., distance range 122 of FIG. 1), process 1500 continues to operation 1520.

At operation 1520, the user device (e.g., user device 103 of FIG. 1) instructs the user (e.g., user 102 of FIG. 1) to change the distance (e.g., distance 121 of FIG. 1). Subsequently, process 1500 repeats operations 1510 through 1520 until the distance (e.g., distance 121 of FIG. 1) is within the distance range (e.g., distance range 122 of FIG. 1).

In response to determining at operation 1518 that the distance (e.g., distance 121 of FIG. 1) is within the distance range (e.g., distance range 122 of FIG. 1), process 1500 continues to operation 1522.

At operation 1522, the user device (e.g., user device 103 of FIG. 1) captures baseline sound data (e.g., baseline sound data 123 of FIG. 1) for a first time period (e.g., time period 127 of FIG. 1). For example, the first time period (e.g., time period 127 of FIG. 1) may be 10 sec. In certain embodiments, a microphone (e.g., microphone 108 of FIG. 1) is configured to capture the baseline sound data (e.g., baseline sound data 123 of FIG. 1).

At operation 1524, the user device (e.g., user device 103 of FIG. 1) sends an instruction (e.g., instruction 156 of FIG. 1) to the thermostat (e.g., thermostat 135 of FIG. 1) to turn on the HVAC system 140, turn on a supplemental heating unit (e.g., heating unit 234 of FIG. 2) and turn off a heat pump heating mode by turning off the outdoor unit (e.g., outdoor unit 204 of FIG. 2).

At operation 1526, the user device (e.g., user device 103 of FIG. 1) receives a response (e.g., response 157 of FIG. 1) from the thermostat (e.g., thermostat 135 of FIG. 1) that the HVAC system 140 has been turned on, the supplemental heating unit (e.g., heating unit 234 of FIG. 2) has been turned on and the heat pump heating mode has been turned off.

At operation 1528, the user device (e.g., user device 103 of FIG. 1) determines a value of a room temperature (e.g., temperature 131 of FIG. 1). For example, the user device (e.g., user device 103 of FIG. 1) may obtain the value of the room temperature (e.g., temperature 131 of FIG. 1) from the thermostat (e.g., thermostat 135 of FIG. 1).

At operation 1530, the user device (e.g., user device 103 of FIG. 1) sends an instruction (e.g., instruction 156 of FIG. 1) to the thermostat (e.g., thermostat 135 of FIG. 1) to set a temperature setpoint (e.g., temperature setpoint 130 of FIG. 1) above the value of the room temperature (e.g., temperature 131 of FIG. 1). In certain embodiments, the temperature setpoint (e.g., temperature setpoint 130 of FIG. 1) is set 5° F. above the value of the room temperature (e.g., temperature 131 of FIG. 1).

At operation 1532, the user device (e.g., user device 103 of FIG. 1) captures indoor unit sound data (e.g., indoor unit sound data 1234 of FIG. 1) for a second time period (e.g., time period 128 of FIG. 1). For example, the second time period (e.g., time period 128 of FIG. 1) may be 60 sec. In certain embodiments, the microphone (e.g., microphone 108 of FIG. 1) is configured to capture the indoor unit sound data (e.g., indoor unit sound data 124 of FIG. 1).

At operation 1534, the user device (e.g., user device 103 of FIG. 1) sends the indoor unit sound data (e.g., indoor unit sound data 124 of FIG. 1) and the baseline sound data (e.g., baseline sound data 123 of FIG. 1) to a computing system (e.g., computing system 141 of FIG. 1).

At operation 1536, the computing system (e.g., computing system 141 of FIG. 1) subtracts the baseline sound data (e.g., baseline sound data 123 of FIG. 1) from the indoor unit sound data (e.g., indoor unit sound data 124 of FIG. 1) to determine a normalized indoor unit sound data (e.g., normalized indoor unit sound data 152 of FIG. 1).

At operation 1538, the computing system (e.g., computing system 141 of FIG. 1) analyzes the normalized indoor unit sound data (e.g., normalized indoor unit sound data 152 of FIG. 1) to determine sound signatures (e.g., sound signatures 155 of FIG. 1).

At operation 1540, the computing system (e.g., computing system 141 of FIG. 1) identifies expected sound signatures (e.g., expected sound signatures 150 of FIG. 1) of the indoor unit (e.g., indoor unit 202 of FIG. 2) stored in a sound signature library (e.g., sound signature library 149 of FIG. 1). For example, the computing system (e.g., computing system 141 of FIG. 1) determines component identifiers (e.g., component identifiers 151 of FIG. 1) of various components of the indoor unit (e.g., indoor unit 202 of FIG. 2) and identifies expected sound signatures (e.g., expected sound signatures 150 of FIG. 1) corresponding to the component identifiers (e.g., component identifiers 151 of FIG. 1).

At operation 1542, the computing system (e.g., computing system 141 of FIG. 1) compares the normalized indoor unit sound data (e.g., normalized indoor unit sound data 152 of FIG. 1) to the expected sound signatures (e.g., expected sound signatures 150 of FIG. 1).

At operation 1544, the computing system (e.g., computing system 141 of FIG. 1) determines if an expected sound signature (e.g., sound signature 504 of FIG. 5) for a blower (e.g., blower 244 of FIG. 2) is missing from the normalized indoor unit sound data (e.g., normalized indoor unit sound data 152 of FIG. 1).

In response to determining at operation 1544 that the expected sound signature (e.g., sound signature 504 of FIG. 5) for the blower (e.g., blower 244 of FIG. 2) is missing from the normalized indoor unit sound data (e.g., normalized indoor unit sound data 152 of FIG. 1), process 1500 continues to operation 1546.

At operation 1546, the computing system (e.g., computing system 141 of FIG. 1) determine that the blower (e.g., blower 244 of FIG. 2) has failed.

At operation 1548, the computing system (e.g., computing system 141 of FIG. 1) sends a notification (e.g., notification 160 of FIG. 1) to the user device (e.g., user device 103 of FIG. 1) that the blower (e.g., blower 244 of FIG. 2) has failed. After performing operation 1548, process 1500 ends.

In response to determining at operation 1544 that the expected sound signature (e.g., sound signature 504 of FIG. 5) for the blower (e.g., blower 244 of FIG. 2) is not missing from the normalized indoor unit sound data (e.g., normalized indoor unit sound data 152 of FIG. 1), process 1500 continues to operation 1550.

At operation 1550, the computing system (e.g., computing system 141 of FIG. 1) determines if the expected sound signature (e.g., sound signature 504 of FIG. 5) for the blower (e.g., blower 244 of FIG. 2) is different from a respective sound signature of the blower (e.g., blower 244 of FIG. 2) determined from the normalized indoor unit sound data (e.g., normalized indoor unit sound data 152 of FIG. 1).

In response to determining at operation 1550 that the expected sound signature (e.g., sound signature 504 of FIG. 5) for the blower (e.g., blower 244 of FIG. 2) is different from the respective sound signature of the blower (e.g., blower 244 of FIG. 2) determined from the normalized indoor unit sound data (e.g., normalized indoor unit sound data 152 of FIG. 1), process 1500 continues to operation 1552.

At operation 1552, the computing system (e.g., computing system 141 of FIG. 1) determines that the blower (e.g., blower 244 of FIG. 2) is malfunctioning.

At operation 1554, the computing system (e.g., computing system 141 of FIG. 1) sends a notification (e.g., notification 160 of FIG. 1) to the user device (e.g., user device 103 of FIG. 1) that the blower (e.g., blower 244 of FIG. 2) is malfunctioning. After performing operation 1554, process 1500 ends.

In response to determining at operation 1550 that the expected sound signature (e.g., sound signature 504 of FIG. 4) for the blower (e.g., blower 244 of FIG. 2) is not different from the respective sound signature of the blower (e.g., blower 244 of FIG. 2) determined from the normalized indoor unit sound data (e.g., normalized indoor unit sound data 152 of FIG. 1), process 1500 continues to operation 1556.

At operation 1556, the computing system (e.g., computing system 141 of FIG. 1) determines if an expected sound signature (e.g., sound signature 150 of FIG. 1) for a relay (e.g., relay 236 of FIG. 2) of the supplemental heating unit (e.g., heating unit 234 of FIG. 2) is missing from the normalized indoor unit sound data (e.g., normalized indoor unit sound data 152 of FIG. 1).

In response to determining at operation 1556 that the expected sound signature (e.g., sound signature 150 of FIG. 1) for the relay (e.g., relay 236 of FIG. 2) of the supplemental heating unit (e.g., heating unit 234 of FIG. 2) is missing from the normalized indoor unit sound data (e.g., normalized indoor unit sound data 152 of FIG. 1), process 1500 continues to operation 1558.

At operation 1558, the computing system (e.g., computing system 141 of FIG. 1) determine that the relay (e.g., relay 236 of FIG. 2) of the supplemental heating unit (e.g., heating unit 234 of FIG. 2) has failed.

At operation 1560, the computing system (e.g., computing system 141 of FIG. 1) sends a notification (e.g., notification 160 of FIG. 1) to the user device (e.g., user device 103 of FIG. 1) that the relay (e.g., relay 236 of FIG. 2) of the supplemental heating unit (e.g., heating unit 234 of FIG. 2) has failed. After performing operation 1560, process 1500 ends.

In response to determining at operation 1556 that the expected sound signature (e.g., sound signature 150 of FIG. 1) for the relay (e.g., relay 236 of FIG. 2) of the supplemental heating unit (e.g., heating unit 234 of FIG. 2) is not missing from the normalized indoor unit sound data (e.g., normalized indoor unit sound data 152 of FIG. 1), process 1500 continues to operation 1562.

At operation 1562, the computing system (e.g., computing system 141 of FIG. 1) determines if the expected sound signature (e.g., sound signature 150 of FIG. 1) for the relay (e.g., relay 236 of FIG. 2) of the supplemental heating unit (e.g., heating unit 234 of FIG. 2) is different from a respective sound signature (e.g., sound signature 155 of FIG. 1) of the relay (e.g., relay 236 of FIG. 2) of the supplemental heating unit (e.g., heating unit 234 of FIG. 2) determined from the normalized indoor unit sound data (e.g., normalized indoor unit sound data 152 of FIG. 1).

In response to determining at operation 1562 that the expected sound signature (e.g., sound signature 150 of FIG. 1) for the relay (e.g., relay 236 of FIG. 2) of the supplemental heating unit (e.g., heating unit 234 of FIG. 2) is different from the respective sound signature (e.g., sound signature 155 of FIG. 1) of the relay (e.g., relay 236 of FIG. 2) of the supplemental heating unit (e.g., heating unit 234 of FIG. 2) determined from the normalized indoor unit sound data (e.g., normalized indoor unit sound data 152 of FIG. 1), process 1500 continues to operation 1564.

At operation 1564, the computing system (e.g., computing system 141 of FIG. 1) determines that the relay (e.g., relay 236 of FIG. 2) of the supplemental heating unit (e.g., heating unit 234 of FIG. 2) is malfunctioning.

At operation 1566, the computing system (e.g., computing system 141 of FIG. 1) sends a notification (e.g., notification 160 of FIG. 1) to the user device (e.g., user device 103 of FIG. 1) that the relay (e.g., relay 236 of FIG. 2) of the supplemental heating unit (e.g., heating unit 234 of FIG. 2) is malfunctioning. After performing operation 1566, process 1500 ends.

In response to determining at operation 1562 that the relay (e.g., relay 236 of FIG. 2) of the supplemental heating unit (e.g., heating unit 234 of FIG. 2) is not different from the respective sound signature (e.g., sound signature 155 of FIG. 1) of the relay (e.g., relay 236 of FIG. 2) of the supplemental heating unit (e.g., heating unit 234 of FIG. 2) determined from the normalized indoor unit sound data (e.g., normalized indoor unit sound data 152 of FIG. 1), process 1500 continues to operation 1568.

At operation 1568, the computing system (e.g., computing system 141 of FIG. 1) determines that a supplemental heating element (e.g., heating element 254 of FIG. 2) has failed.

At operation 1570, the computing system (e.g., computing system 141 of FIG. 1) sends a notification (e.g., notification 160 of FIG. 1) to the user device (e.g., user device 103 of FIG. 1) that the supplemental heating element (e.g., heating element 254 of FIG. 2) has failed. After performing operation 1570, process 1500 ends.

An Example Diagnostic Process for an Outdoor Unit of an HVAC System

FIGS. 16A, 16B, 16C, 16D and 16E illustrate a flowchart of an embodiment of a diagnostic process 1600 for an outdoor unit (e.g., outdoor unit 204 of FIG. 2) of an HVAC system (e.g., HVAC system 140 of FIGS. 1 and 2). The diagnostic process 1600 may be used to implement operation 1360 of diagnostic process 1300 (see FIGS. 13A and 13B) and operation 1460 of diagnostic process 1400 (see FIGS. 14A and 14B). Modifications, additions, or omissions may be made to process 1600. Process 1600 may include more, fewer, or other operations. For example, operations may be performed in parallel or in any suitable order. For example, one or more operations of process 1600 may be implemented, at least in part, in the form of the software instructions (e.g., instructions 110, 139, and/or 145, and/or application 111 of FIG. 1), stored on non-transitory, tangible, machine-readable medium (e.g., memories 109, 138, and/or 144 of FIG. 1) that when executed by one or more processors (e.g., processors 104, 136, and/or 142 of FIG. 1) may cause the one or more processors to perform operations 1601-1668.

At operation 1601, a user device (e.g., user device 103 of FIG. 1) enters an outdoor unit diagnostics mode.

At operation 1602, the user device (e.g., user device 103 of FIG. 1) sends an instruction (e.g., instruction 156 of FIG. 1) to a thermostat (e.g., thermostat 135 of FIG. 1) to shut down an HVAC system 140.

At operation 1603, the user device (e.g., user device 103 of FIG. 1) instructs a user (e.g., user 102 of FIG. 1) to minimize background noise.

At operation 1604, the user device (e.g., user device 103 of FIG. 1) instructs the user (e.g., user 102 of FIG. 1) to go to the outdoor unit (e.g., outdoor unit 204 of FIG. 2). In other embodiments, operation 1603 may be performed after performing operation 1604.

At operation 1605, the user device (e.g., user device 103 of FIG. 1) instructs the user (e.g., user 102 of FIG. 1) to capture an image (e.g., image 134 of FIG. 1) of a nameplate (e.g., nameplate 222 of FIG. 2) of the outdoor unit (e.g., outdoor unit 204 of FIG. 2).

At operation 1606, the user device (e.g., user device 103 of FIG. 1) captures the image (e.g., image 134 of FIG. 1) of the nameplate (e.g., nameplate 222 of FIG. 2) of the outdoor unit (e.g., outdoor unit 204 of FIG. 2). For example, a camera (e.g., camera 107 of FIG. 1) of the user device (e.g., user device 103 of FIG. 1) is configured to capture the image (e.g., image 134 of FIG. 1) of the nameplate (e.g., nameplate 222 of FIG. 2) of the outdoor unit (e.g., outdoor unit 204 of FIG. 2).

At operation 1607, the user device (e.g., user device 103 of FIG. 1) analyzes the image (e.g., image 134 of FIG. 1) to determine a distance (e.g., distance 121 of FIG. 1) of the user (e.g., user 102 of FIG. 1) from the outdoor unit (e.g., outdoor unit 204 of FIG. 2).

At operation 1608, the user device (e.g., user device 103 of FIG. 1) compares the distance (e.g., distance 121 of FIG. 1) to a distance range (e.g., distance range 122 of FIG. 1). In certain embodiments, the distance range may be from 15 cm to 25 cm.

At operation 1609, the user device (e.g., user device 103 of FIG. 1) determines if the distance (e.g., distance 121 of FIG. 1) is within the distance range (e.g., distance range 122 of FIG. 1).

In response to determining at operation 1609 that the distance (e.g., distance 121 of FIG. 1) is not within the distance range (e.g., distance range 122 of FIG. 1), process 1600 continues to operation 1610.

At operation 1610, the user device (e.g., user device 103 of FIG. 1) instructs the user (e.g., user 102 of FIG. 1) to change the distance (e.g., distance 121 of FIG. 1). Subsequently, process 1600 repeats operations 1605 through 1610 until the distance (e.g., distance 121 of FIG. 1) is within the distance range (e.g., distance range 122 of FIG. 1).

In response to determining at operation 1609 that the distance (e.g., distance 121 of FIG. 1) is less than the distance threshold (e.g., distance threshold 122 of FIG. 1), process 1609 continues to operation 1611.

At operation 1611, the user device (e.g., user device 103 of FIG. 1) captures baseline sound data (e.g., baseline sound data 123 of FIG. 1) for a first time period (e.g., time period 127 of FIG. 1). For example, the first time period (e.g., time period 127 of FIG. 1) may be 10 sec. In certain embodiments, a microphone (e.g., microphone 108 of FIG. 1) is configured to capture the baseline sound data (e.g., baseline sound data 123 of FIG. 1).

At operation 1612, the user device (e.g., user device 103 of FIG. 1) sends an instruction (e.g., instruction 156 of FIG. 1) to the thermostat (e.g., thermostat 135 of FIG. 1) to turn on the HVAC system 140.

At operation 1613, the user device (e.g., user device 103 of FIG. 1) receives a response (e.g., response 157 of FIG. 1) from the thermostat (e.g., thermostat 135 of FIG. 1) that the HVAC system 140 has been turned on.

At operation 1614, the user device (e.g., user device 103 of FIG. 1) determines a value of a room temperature (e.g., temperature 131 of FIG. 1). For example, the user device (e.g., user device 103 of FIG. 1) may obtain the value of the room temperature (e.g., temperature 131 of FIG. 1) from the thermostat (e.g., thermostat 135 of FIG. 1).

At operation 1615, the user device (e.g., user device 103 of FIG. 1) sends an instruction (e.g., instruction 156 of FIG. 1) to the thermostat (e.g., thermostat 135 of FIG. 1) to set a temperature setpoint (e.g., temperature setpoint 130 of FIG. 1) above or below the value of the room temperature (e.g., temperature 131 of FIG. 1). In certain embodiments, the temperature setpoint (e.g., temperature setpoint 130 of FIG. 1) is set 5° F. above or 5° F. below the value of the room temperature (e.g., temperature 131 of FIG. 1).

At operation 1616, the user device (e.g., user device 103 of FIG. 1) captures first outdoor unit sound data (e.g., outdoor unit sound data 125 of FIG. 1) for a second time period (e.g., time period 128 of FIG. 1). For example, the second time period (e.g., time period 128 of FIG. 1) may be 90 sec. In certain embodiments, the microphone (e.g., microphone 108 of FIG. 1) is configured to capture the first outdoor unit sound data (e.g., outdoor unit sound data 125 of FIG. 1).

At operation 1617, the user device (e.g., user device 103 of FIG. 1) sends the first outdoor unit sound data (e.g., outdoor unit sound data 125 of FIG. 1) and the baseline sound data (e.g., baseline sound data 123 of FIG. 1) to a computing system (e.g., computing system 141 of FIG. 1).

At operation 1618, the computing system (e.g., computing system 141 of FIG. 1) subtracts the baseline sound data (e.g., baseline sound data 123 of FIG. 1) from the first outdoor unit sound data (e.g., outdoor unit sound data 125 of FIG. 1) to determine first normalized outdoor unit sound data (e.g., normalized outdoor unit sound data 153 of FIG. 1).

At operation 1619, the computing system (e.g., computing system 141 of FIG. 1) analyzes the first normalized outdoor unit sound data (e.g., normalized outdoor unit sound data 153 of FIG. 1) to determine first sound signatures (e.g., sound signatures 155 of FIG. 1).

At operation 1620, the computing system (e.g., computing system 141 of FIG. 1) identifies expected first sound signatures (e.g., expected sound signatures 150 of FIG. 1) of the outdoor unit (e.g., outdoor unit 204 of FIG. 2) stored in a sound signature library (e.g., sound signature library 149 of FIG. 1). For example, the computing system (e.g., computing system 141 of FIG. 1) determines component identifiers (e.g., component identifiers 151 of FIG. 1) of various components of the outdoor unit (e.g., outdoor unit 204 of FIG. 2) and identifies expected first sound signatures (e.g., expected sound signatures 150 of FIG. 1) corresponding to the component identifiers (e.g., component identifiers 151 of FIG. 1).

At operation 1621, the computing system (e.g., computing system 141 of FIG. 1) compares the first normalized outdoor unit sound data (e.g., normalized outdoor unit sound data 153 of FIG. 1) to the expected first sound signatures (e.g., expected sound signatures 150 of FIG. 1).

At operation 1622, the computing system (e.g., computing system 141 of FIG. 1) determines if an expected sound signature (e.g., sound signature 604 of FIG. 6A) for a relay (e.g., relay 216 of FIG. 2) is missing from the first normalized outdoor unit sound data (e.g., normalized outdoor unit sound data 153 of FIG. 1).

In response to determining at operation 1622 the expected sound signature (e.g., sound signature 604 of FIG. 6A) for the relay (e.g., relay 216 of FIG. 2) is missing from the first normalized outdoor unit sound data (e.g., normalized outdoor unit sound data 153 of FIG. 1), process 1600 continues to operation 1623.

At operation 1623, the computing system (e.g., computing system 141 of FIG. 1) determines that the relay (e.g., relay 216 of FIG. 2) has failed.

At operation 1624, the computing system (e.g., computing system 141 of FIG. 1) sends a notification (e.g., notification 160 of FIG. 1) to the user device (e.g., user device 103 of FIG. 1) that the relay (e.g., relay 216 of FIG. 2) has failed. After performing operation 1624, process 1600 ends.

In response to determining at operation 1522 the expected sound signature (e.g., sound signature 604 of FIG. 6A) for the relay (e.g., relay 216 of FIG. 2) is not missing from the first normalized outdoor unit sound data (e.g., normalized outdoor unit sound data 153 of FIG. 1), process 1600 continues to operation 1625.

At operation 1625, the computing system (e.g., computing system 141 of FIG. 1) determines if the expected sound signature (e.g., sound signature 604 of FIG. 6A) for the relay (e.g., relay 216 of FIG. 2) is different from a respective sound signature of the relay (e.g., relay 216 of FIG. 2) determined from the first normalized outdoor unit sound data (e.g., normalized outdoor unit sound data 153 of FIG. 1).

In response to determining at operation 1625 that the expected sound signature (e.g., sound signature 604 of FIG. 6A) for the relay (e.g., relay 216 of FIG. 2) is different from the respective sound signature of the relay (e.g., relay 216 of FIG. 2) determined from the first normalized outdoor unit sound data (e.g., normalized outdoor unit sound data 153 of FIG. 1), process 1600 continues to operation 1626.

At operation 1626, the computing system (e.g., computing system 141 of FIG. 1) determines that the relay (e.g., relay 216 of FIG. 2) is malfunctioning.

At operation 1627, the computing system (e.g., computing system 141 of FIG. 1) sends a notification (e.g., notification 160 of FIG. 1) to the user device (e.g., user device 103 of FIG. 1) that the relay (e.g., relay 216 of FIG. 2) is malfunctioning. After performing operation 1627, process 1600 ends.

In response to determining at operation 1625 that the expected sound signature (e.g., sound signature 604 of FIG. 6A) for the relay (e.g., relay 216 of FIG. 2) is not different from the respective sound signature of the relay (e.g., relay 216 of FIG. 2) determined from the first normalized outdoor unit sound data (e.g., normalized outdoor unit sound data 153 of FIG. 1), process 1600 continues to operation 1628.

At operation 1628, the computing system (e.g., computing system 141 of FIG. 1) determines that the relay (e.g., relay 216 of FIG. 2) operates properly.

At operation 1629, the computing system (e.g., computing system 141 of FIG. 1) determines if an expected sound signature (e.g., sound signature 606 of FIG. 6A) for a contactor (e.g., contactor 218 of FIG. 2) is missing from the first normalized outdoor unit sound data (e.g., normalized outdoor unit sound data 153 of FIG. 1).

In response to determining at operation 1629 that the expected sound signature (e.g., sound signature 606 of FIG. 6A) for the contactor (e.g., contactor 218 of FIG. 2) is missing from the first normalized outdoor unit sound data (e.g., normalized outdoor unit sound data 153 of FIG. 1), process 1600 continues to operation 1630.

At operation 1630, the computing system (e.g., computing system 141 of FIG. 1) determines that the contactor (e.g., contactor 218 of FIG. 2) has failed.

At operation 1631, the computing system (e.g., computing system 141 of FIG. 1) sends a notification (e.g., notification 160 of FIG. 1) to the user device (e.g., user device 103 of FIG. 1) that the contactor (e.g., contactor 218 of FIG. 2) has failed. After performing operation 1631, process 1600 ends.

In response to determining at operation 1629 that the expected sound signature (e.g., sound signature 606 of FIG. 6A) for the contactor (e.g., contactor 218 of FIG. 2) is not missing from the first normalized outdoor unit sound data (e.g., normalized outdoor unit sound data 153 of FIG. 1), process 1600 continues to operation 1632.

At operation 1632, the computing system (e.g., computing system 141 of FIG. 1) determines if the expected sound signature (e.g., sound signature 606 of FIG. 6A) for the contactor (e.g., contactor 218 of FIG. 2) is different from a respective sound signature of the contactor (e.g., contactor 218 of FIG. 2) determined from the first normalized outdoor unit sound data (e.g., normalized outdoor unit sound data 153 of FIG. 1).

In response to determining at operation 1632 that the expected sound signature (e.g., sound signature 606 of FIG. 6A) for the contactor (e.g., contactor 218 of FIG. 2) is different from the respective sound signature of the contactor (e.g., contactor 218 of FIG. 2) determined from the first normalized outdoor unit sound data (e.g., normalized outdoor unit sound data 153 of FIG. 1), process 1600 continues to operation 1633.

At operation 1633, the computing system (e.g., computing system 141 of FIG. 1) determines that the contactor (e.g., contactor 218 of FIG. 2) is malfunctioning.

At operation 1634, the computing system (e.g., computing system 141 of FIG. 1) sends a notification (e.g., notification 160 of FIG. 1) to the user device (e.g., user device 103 of FIG. 1) that the contactor (e.g., contactor 218 of FIG. 2) is malfunctioning. After performing operation 1634, process 1600 ends.

In response to determining at operation 1632 that the expected sound signature (e.g., sound signature 606 of FIG. 6A) for the contactor (e.g., contactor 218 of FIG. 2) is not different from the respective sound signature of the contactor (e.g., contactor 218 of FIG. 2) determined from the first normalized outdoor unit sound data (e.g., normalized outdoor unit sound data 153 of FIG. 1), process 1600 continues to operation 1635.

At operation 1635, the computing system (e.g., computing system 141 of FIG. 1) determines that the contactor (e.g., contactor 218 of FIG. 2) operates properly.

At operation 1636, the computing system (e.g., computing system 141 of FIG. 1) determines if an expected sound signature (e.g., sound signature 706 of FIG. 7A or sound signature 806 of FIG. 8A) for an outdoor fan (e.g., fan 212 of FIG. 2) is missing from the first normalized outdoor unit sound data (e.g., normalized outdoor unit sound data 153 of FIG. 1).

In response to determining at operation 1636 that the expected sound signature (e.g., sound signature 706 of FIG. 7A or sound signature 806 of FIG. 8A) for the outdoor fan (e.g., fan 212 of FIG. 2) is missing from the first normalized outdoor unit sound data (e.g., normalized outdoor unit sound data 153 of FIG. 1), process 1600 continues to operation 1637.

At operation 1637, the computing system (e.g., computing system 141 of FIG. 1) determines that the outdoor fan (e.g., fan 212 of FIG. 2) has failed.

At operation 1638, the computing system (e.g., computing system 141 of FIG. 1) sends a notification (e.g., notification 160 of FIG. 1) to the user device (e.g., user device 103 of FIG. 1) that the outdoor fan (e.g., fan 212 of FIG. 2) has failed. After performing operation 1638, process 1600 ends.

In response to determining at operation 1636 that the expected sound signature (e.g., sound signature 706 of FIG. 7A or sound signature 806 of FIG. 8A) for the outdoor fan (e.g., fan 212 of FIG. 2) is not missing from the first normalized outdoor unit sound data (e.g., normalized outdoor unit sound data 153 of FIG. 1), process 1600 continues to operation 1639.

At operation 1639, the computing system (e.g., computing system 141 of FIG. 1) determines if the expected sound signature (e.g., sound signature 706 of FIG. 7A or sound signature 806 of FIG. 8A) for the outdoor fan (e.g., fan 212 of FIG. 2) is different from a respective sound signature of the outdoor fan (e.g., fan 212 of FIG. 2) determined from the first normalized outdoor unit sound data (e.g., normalized outdoor unit sound data 153 of FIG. 1).

In response to determining at operation 1639 that the expected sound signature (e.g., sound signature 706 of FIG. 7A or sound signature 806 of FIG. 8A) for the outdoor fan (e.g., fan 212 of FIG. 2) is different from the respective sound signature of the outdoor fan (e.g., fan 212 of FIG. 2) determined from the first normalized outdoor unit sound data (e.g., normalized outdoor unit sound data 153 of FIG. 1), process 1600 continues to operation 1640.

At operation 1640, the computing system (e.g., computing system 141 of FIG. 1) determines that the outdoor fan (e.g., fan 212 of FIG. 2) is malfunctioning.

At operation 1641, the computing system (e.g., computing system 141 of FIG. 1) sends a notification (e.g., notification 160 of FIG. 1) to the user device (e.g., user device 103 of FIG. 1) that the outdoor fan (e.g., fan 212 of FIG. 2) is malfunctioning. After performing operation 1641, process 1600 ends.

In response to determining at operation 1639 that the expected sound signature (e.g., sound signature 706 of FIG. 7A or sound signature 806 of FIG. 8A) for the outdoor fan (e.g., fan 212 of FIG. 2) is not different from the respective sound signature of the outdoor fan (e.g., fan 212 of FIG. 2) determined from the first normalized outdoor unit sound data (e.g., normalized outdoor unit sound data 153 of FIG. 1), process 1600 continues to operation 1642.

At operation 1642, the computing system (e.g., computing system 141 of FIG. 1) determines that the outdoor fan (e.g., fan 212 of FIG. 2) operates properly.

At operation 1643, the computing system (e.g., computing system 141 of FIG. 1) determines if an expected sound signature (e.g., sound signature 704 of FIG. 7A or sound signature 804 of FIG. 8A) for a compressor (e.g., compressor 208 of FIG. 2) is missing from the first normalized outdoor unit sound data (e.g., normalized outdoor unit sound data 153 of FIG. 1).

In response to determining at operation 1643 that the expected sound signature (e.g., sound signature 704 of FIG. 7A or sound signature 804 of FIG. 8A) for the compressor (e.g., compressor 208 of FIG. 2) is missing from the first normalized outdoor unit sound data (e.g., normalized outdoor unit sound data 153 of FIG. 1), process 1600 continues to operation 1644.

At operation 1644, the computing system (e.g., computing system 141 of FIG. 1) determines that the compressor (e.g., compressor 208 of FIG. 2) has failed.

At operation 1645, the computing system (e.g., computing system 141 of FIG. 1) sends a notification (e.g., notification 160 of FIG. 1) to the user device (e.g., user device 103 of FIG. 1) that the compressor (e.g., compressor 208 of FIG. 2) has failed. After performing operation 1645, process 1600 ends.

In response to determining at operation 1643 that the expected sound signature (e.g., sound signature 704 of FIG. 7A or sound signature 804 of FIG. 8A) for the compressor (e.g., compressor 208 of FIG. 2) is not missing from the first normalized outdoor unit sound data (e.g., normalized outdoor unit sound data 153 of FIG. 1), process 1600 continues to operation 1646.

At operation 1646, the computing system (e.g., computing system 141 of FIG. 1) determines if the expected sound signature (e.g., sound signature 704 of FIG. 7A or sound signature 804 of FIG. 8A) for the compressor (e.g., compressor 208 of FIG. 2) is different from a respective sound signature of the compressor (e.g., compressor 208 of FIG. 2) determined from the first normalized outdoor unit sound data (e.g., normalized outdoor unit sound data 153 of FIG. 1).

In response to determining at operation 1646 that the expected sound signature (e.g., sound signature 704 of FIG. 7A or sound signature 804 of FIG. 8A) for the compressor (e.g., compressor 208 of FIG. 2) is different from the respective sound signature of the compressor (e.g., compressor 208 of FIG. 2) determined from the first normalized outdoor unit sound data (e.g., normalized outdoor unit sound data 153 of FIG. 1), process 1600 continues to operation 1647.

At operation 1647, the computing system (e.g., computing system 141 of FIG. 1) determines that the compressor (e.g., compressor 208 of FIG. 2) is malfunctioning.

At operation 1648, the computing system (e.g., computing system 141 of FIG. 1) sends a notification (e.g., notification 160 of FIG. 1) to the user device (e.g., user device 103 of FIG. 1) that the compressor (e.g., compressor 208 of FIG. 2) is malfunctioning. After performing operation 1648, process 1600 ends.

In response to determining at operation 1646 that the expected sound signature (e.g., sound signature 704 of FIG. 7A or sound signature 804 of FIG. 8A) for the compressor (e.g., compressor 208 of FIG. 2) is not different from the respective sound signature of the compressor (e.g., compressor 208 of FIG. 2) determined from the first normalized outdoor unit sound data (e.g., normalized outdoor unit sound data 153 of FIG. 1), process 1600 continues to operation 1649.

At operation 1649, the computing system (e.g., computing system 141 of FIG. 1) determines that the compressor (e.g., compressor 208 of FIG. 2) operates properly.

At operation 1650, the computing system (e.g., computing system 141 of FIG. 1) determines if the HVAC system 140 supports a heat pump heating mode.

In response to determining at operation 1650 that the HVAC system 140 does not support the heat pump heating mode, process 1600 continues to operation 1667.

At operation 1667, the computing system (e.g., computing system 141 of FIG. 1) determines that the outdoor unit (e.g., outdoor unit 204 of FIG. 2) operates properly.

At operation 1668, the computing system (e.g., computing system 141 of FIG. 1) sends a notification (e.g., notification 160 of FIG. 1) to the user device (e.g., user device 103 of FIG. 1) that the outdoor unit (e.g., outdoor unit 204 of FIG. 2) operates properly.

In response to determining at operation 1650 that the HVAC system 140 supports the heat pump heating mode, process 1600 continues to operation 1651.

At operation 1651, the computing system (e.g., computing system 141 of FIG. 1) determines if the temperature setpoint (e.g., temperature setpoint 130 of FIG. 1) is less than the value of the room temperature (e.g., temperature 131 of FIG. 1).

In response to determining at operation 1651 that the temperature setpoint (e.g., temperature setpoint 130 of FIG.

1) is less than the value of the room temperature (e.g., temperature 131 of FIG. 1), process 1600 continues to operation 1652.

At operation 1652, the user device (e.g., user device 103 of FIG. 1) sends an instruction (e.g., instruction 156 of FIG. 1) to the thermostat (e.g., thermostat 135 of FIG. 1) to set the temperature setpoint (e.g., temperature setpoint 130 of FIG. 1) above the value of the room temperature (e.g., temperature 131 of FIG. 1). In certain embodiments, the temperature setpoint (e.g., temperature setpoint 130 of FIG. 1) is set 5° F. above the value of the room temperature (e.g., temperature 131 of FIG. 1). After performing operation 1652, process 1600 continues to operation 1654.

In response to determining at operation 1651 that the temperature setpoint (e.g., temperature setpoint 130 of FIG. 1) is not less than the value of the room temperature (e.g., temperature 131 of FIG. 1), process 1600 continues to operation 1653.

At operation 1653, the user device (e.g., user device 103 of FIG. 1) sends an instruction (e.g., instruction 156 of FIG. 1) to the thermostat (e.g., thermostat 135 of FIG. 1) to set the temperature setpoint (e.g., temperature setpoint 130 of FIG. 1) below the value of the room temperature (e.g., temperature 131 of FIG. 1). In certain embodiments, the temperature setpoint (e.g., temperature setpoint 130 of FIG. 1) is set 5° F. below the value of the room temperature (e.g., temperature 131 of FIG. 1).

At operation 1654, the user device (e.g., user device 103 of FIG. 1) captures second outdoor unit sound data (e.g., outdoor unit sound data 126 of FIG. 1) for a third time period (e.g., time period 129 of FIG. 1). For example, the third time period (e.g., time period 129 of FIG. 1) may be 60 sec. In certain embodiments, the microphone (e.g., microphone 108 of FIG. 1) is configured to capture the second outdoor unit sound data (e.g., outdoor unit sound data 126 of FIG. 1).

At operation 1655, the user device (e.g., user device 103 of FIG. 1) sends the second outdoor unit sound data (e.g., outdoor unit sound data 126 of FIG. 1) to the computing system (e.g., computing system 141 of FIG. 1).

At operation 1656, the computing system (e.g., computing system 141 of FIG. 1) subtracts the baseline sound data (e.g., baseline sound data 123 of FIG. 1) from the second outdoor unit sound data (e.g., outdoor unit sound data 126 of FIG. 1) to determine second normalized outdoor unit sound data (e.g., normalized outdoor unit sound data 154 of FIG. 1).

At operation 1657, the computing system (e.g., computing system 141 of FIG. 1) analyzes the second normalized outdoor unit sound data (e.g., normalized outdoor unit sound data 154 of FIG. 1) to determine second sound signatures (e.g., sound signatures 155 of FIG. 1).

At operation 1658, the computing system (e.g., computing system 141 of FIG. 1) identifies expected second sound signatures (e.g., expected sound signatures 150 of FIG. 1) of the outdoor unit (e.g., outdoor unit 204 of FIG. 2) stored in the sound signature library (e.g., sound signature library 149 of FIG. 1). For example, the computing system (e.g., computing system 141 of FIG. 1) determines component identifiers (e.g., component identifiers 151 of FIG. 1) of various components of the outdoor unit (e.g., outdoor unit 204 of FIG. 2) and identifies expected second sound signatures (e.g., expected sound signatures 150 of FIG. 1) corresponding to the component identifiers (e.g., component identifiers 151 of FIG. 1).

At operation 1659, the computing system (e.g., computing system 141 of FIG. 1) compares the second normalized outdoor unit sound data (e.g., normalized outdoor unit sound data 154 of FIG. 1) to the expected second sound signatures (e.g., expected sound signatures 150 of FIG. 1).

At operation 1660, the computing system (e.g., computing system 141 of FIG. 1) determines if an expected sound signature (e.g., sound signature 904A of FIG. 9A or sound signature 904B of FIG. 9B) for a reversing valve (e.g., reversing valve 220 of FIG. 2) is missing from the second normalized outdoor unit sound data (e.g., normalized outdoor unit sound data 154 of FIG. 1).

In response to determining at operation 1660 that the expected sound signature (e.g., sound signature 904A of FIG. 9A or sound signature 904B of FIG. 9B) for the reversing valve (e.g., reversing valve 220 of FIG. 2) is missing from the second normalized outdoor unit sound data (e.g., normalized outdoor unit sound data 154 of FIG. 1), process 1600 continues to operation 1661.

At operation 1661, the computing system (e.g., computing system 141 of FIG. 1) determines that the reversing valve (e.g., reversing valve 220 of FIG. 2) has failed.

At operation 1662, the computing system (e.g., computing system 141 of FIG. 1) sends a notification (e.g., notification 160 of FIG. 1) to the user device (e.g., user device 103 of FIG. 1) that the reversing valve (e.g., reversing valve 220 of FIG. 2) has failed. After performing operation 1662, process 1600 ends.

In response to determining at operation 1660 that the expected sound signature (e.g., sound signature 904A of FIG. 9A or sound signature 904B of FIG. 9B) for the reversing valve (e.g., reversing valve 220 of FIG. 2) is not missing from the second normalized outdoor unit sound data (e.g., normalized outdoor unit sound data 154 of FIG. 1), process 1600 continues to operation 1663.

At operation 1663, the computing system (e.g., computing system 141 of FIG. 1) determines if the expected sound signature (e.g., sound signature 904A of FIG. 9A or sound signature 904B of FIG. 9B) for the reversing valve (e.g., reversing valve 220 of FIG. 2) is different from a respective sound signature of the reversing valve (e.g., reversing valve 220 of FIG. 2) determined from the second normalized outdoor unit sound data (e.g., normalized outdoor unit sound data 154 of FIG. 1).

In response to determining at operation 1663 that the expected sound signature (e.g., sound signature 904A of FIG. 9A or sound signature 904B of FIG. 9B) for the reversing valve (e.g., reversing valve 220 of FIG. 2) is different from the respective sound signature of the reversing valve (e.g., reversing valve 220 of FIG. 2) determined from the second normalized outdoor unit sound data (e.g., normalized outdoor unit sound data 154 of FIG. 1), process 1600 continues to operation 1664.

At operation 1664, the computing system (e.g., computing system 141 of FIG. 1) determines that the reversing valve (e.g., reversing valve 220 of FIG. 2) is malfunctioning.

At operation 1665, the computing system (e.g., computing system 141 of FIG. 1) sends a notification (e.g., notification 160 of FIG. 1) to the user device (e.g., user device 103 of FIG. 1) that the reversing valve (e.g., reversing valve 220 of FIG. 2) is malfunctioning. After performing operation 1665, process 1600 ends.

In response to determining at operation 1663 that the expected sound signature (e.g., sound signature 904A of FIG. 9A or sound signature 904B of FIG. 9B) for the reversing valve (e.g., reversing valve 220 of FIG. 2) is not different from the respective sound signature of the reversing valve (e.g., reversing valve 220 of FIG. 2) determined from the second normalized outdoor unit sound data (e.g., normalized outdoor unit sound data 154 of FIG. 1), process 1600 continues to operation 1666.

At operation 1666, the computing system (e.g., computing system 141 of FIG. 1) determines that the reversing valve (e.g., reversing valve 220 of FIG. 2) operates properly.

At operation 1667, the computing system (e.g., computing system 141 of FIG. 1) determines that the outdoor unit (e.g., outdoor unit 204 of FIG. 2) operates properly.

At operation 1668, the computing system (e.g., computing system 141 of FIG. 1) sends a notification (e.g., notification 160 of FIG. 1) to the user device (e.g., user device 103 of FIG. 1) that the outdoor unit (e.g., outdoor unit 204 of FIG. 2) operates properly.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112 (f) as it exists on the date of filing hereof unless the words "means for" or "step for" are explicitly used in the particular claim.

The invention claimed is:

1. A system comprising:

a thermostat communicatively coupled to a heating, ventilation, and air conditioning (HVAC) system;

a user device communicatively coupled to the thermostat, wherein the user device comprises a first processor configured to:

send a first instruction to the thermostat to shut down the HVAC system;

instruct a user to minimize background noise;

instruct the user to go to an outdoor unit of the HVAC system;

instruct the user to capture an image of a nameplate of the outdoor unit;

analyze the image to determine a distance of the user from the outdoor unit;

compare the distance to a distance range;

in response to determining that the distance is within the distance range, capture baseline sound data for a first time period;

send a second instruction to the thermostat to turn on the HVAC system;

determine a value of a room temperature;

send a third instruction to the thermostat to set a temperature setpoint below or above the value of the room temperature;

capture first outdoor unit sound data for a second time period; and send the first outdoor unit sound data and the baseline sound data to a computing system; and the computing system communicatively coupled to the user device, wherein the computing system comprises a second processor configured to:

subtract the baseline sound data from the first outdoor unit sound data to determine first normalized outdoor unit sound data;

analyze the first normalized outdoor unit sound data to determine first sound signatures;

identify expected first sound signatures of the outdoor unit;

compare the first normalized outdoor unit sound data to the expected first sound signatures;

in response to determining that an expected sound signature for a compressor is missing from the first normalized outdoor unit sound data, determine that the compressor has failed; and send a first notification to the user device that the compressor has failed.

2. The system of claim 1, wherein the second processor is further configured to:

in response to determining that the expected sound signature for the compressor is not missing from the first normalized outdoor unit sound data:

in response to determining that the expected sound signature for the compressor is different from a respective sound signature of the compressor determined from the first normalized outdoor unit sound data, determine that the compressor is malfunctioning; and send a second notification to the user device that compressor is malfunctioning.

3. The system of claim 2, wherein the second processor is further configured to:

in response to determining that the expected sound signature for the compressor is not different from the respective sound signature of the compressor determined from the first normalized outdoor unit sound data:

in response to determining that an expected sound signature for an outdoor fan is missing from the first normalized outdoor unit sound data, determine that the outdoor fan has failed; and send a third notification to the user device that the outdoor fan has failed.

4. The system of claim 3, wherein the second processor is further configured to:

in response to determining that the expected sound signature for the outdoor fan is not missing from the first normalized outdoor unit sound data:

in response to determining that the expected sound signature for the outdoor fan is different from a respective sound signature of the outdoor fan determined from the first normalized outdoor unit sound data, determine that the outdoor fan is malfunctioning; and send a fourth notification to the user device that the outdoor fan is malfunctioning.

5. The system of claim 4, wherein the second processor is further configured to:

in response to determining that the expected sound signature for the outdoor fan is not different from the respective sound signature of the outdoor fan determined from the first normalized outdoor unit sound data:

determine that the outdoor unit operates properly; and send a fifth notification to the user device that the outdoor unit operates properly.

6. The system of claim 4, wherein the second processor is further configured to:

in response to determining that the expected sound signature for the outdoor fan is not different from the respective sound signature of the outdoor fan determined from the first normalized outdoor unit sound data:

in response to determining that the temperature setpoint is less than the value of the room temperature:

send a fourth instruction to the thermostat to set the temperature setpoint above the value of the room temperature;

capture second outdoor unit sound data for a third time period;

subtract the baseline sound data from the second outdoor unit sound data to determine second normalized outdoor unit sound data;

analyze the second normalized outdoor unit sound data to determine second sound signatures;

identify expected second sound signatures of the outdoor unit;

compare the second normalized outdoor unit sound data to the expected second sound signatures;

in response to determining that an expected sound signature for a reversing valve is missing from the second normalized outdoor unit sound data, determine that the reversing valve has failed; and send a fifth notification to the user device that the reversing valve has failed.

7. The system of claim 6, wherein the second processor is further configured to:

in response to determining that the expected sound signature for the reversing valve is not missing from the second normalized outdoor unit sound data:

in response to determining that the expected sound signature for the reversing valve is different from a respective sound signature of the reversing valve determined from the second normalized outdoor unit sound data, determine that the reversing valve is malfunctioning; and send a sixth notification to the user device that reversing valve is malfunctioning.

8. A method comprising:

sending a first instruction to a thermostat to shut down a heating, ventilation, and air conditioning (HVAC) system;

instructing a user to minimize background noise;

instructing the user to go to an outdoor unit of the HVAC system;

instructing the user to capture an image of a nameplate of the outdoor unit;

analyzing the image to determine a distance of the user from the outdoor unit;

comparing the distance to a distance range;

in response to determining that the distance is within the distance range, capturing baseline sound data for a first time period;

sending a second instruction to the thermostat to turn on the HVAC system;

determining a value of a room temperature;

sending a third instruction to the thermostat to set a temperature setpoint below or above the value of the room temperature;

capturing first outdoor unit sound data for a second time period;

subtracting the baseline sound data from the first outdoor unit sound data to determine first normalized outdoor unit sound data;

analyzing the first normalized outdoor unit sound data to determine first sound signatures;

identifying expected first sound signatures of the outdoor unit;

comparing the first normalized outdoor unit sound data to the expected first sound signatures;

in response to determining that an expected sound signature for a compressor is missing from the first normalized outdoor unit sound data, determining that the compressor has failed; and sending a first notification to the user device that the compressor has failed.

9. The method of claim 8, further comprising:

in response to determining that the expected sound signature for the compressor is not missing from the first normalized outdoor unit sound data:

in response to determining that the expected sound signature for the compressor is different from a respective sound signature of the compressor determined from the first normalized outdoor unit sound data, determining that the compressor is malfunctioning; and sending a second notification to the user device that compressor is malfunctioning.

10. The method of claim 9, further comprising:

in response to determining that the expected sound signature for the compressor is not different from the respective sound signature of the compressor determined from the first normalized outdoor unit sound data:

in response to determining that an expected sound signature for an outdoor fan is missing from the first normalized outdoor unit sound data, determining that the outdoor fan has failed; and sending a third notification to the user device that the outdoor fan has failed.

11. The method of claim 10, further comprising:

in response to determining that the expected sound signature for the outdoor fan is not missing from the first normalized outdoor unit sound data:

in response to determining that the expected sound signature for the outdoor fan is different from a respective sound signature of the outdoor fan determined from the first normalized outdoor unit sound data, determining that the outdoor fan is malfunctioning; and sending a fourth notification to the user device that the outdoor fan is malfunctioning.

12. The method of claim 11, further comprising:

in response to determining that the expected sound signature for the outdoor fan is not different from the respective sound signature of the outdoor fan determined from the first normalized outdoor unit sound data:

determining that the outdoor unit operates properly; and sending a fifth notification to the user device that the outdoor unit operates properly.

13. The method of claim 11, further comprising:

in response to determining that the expected sound signature for the outdoor fan is not different from the respective sound signature of the outdoor fan determined from the first normalized outdoor unit sound data:

in response to determining that the temperature setpoint is less than the value of the room temperature:

sending a fourth instruction to the thermostat to set the temperature setpoint above the value of the room temperature;

capturing second outdoor unit sound data for a third time period;

subtracting the baseline sound data from the second outdoor unit sound data to determine second normalized outdoor unit sound data;

analyzing the second normalized outdoor unit sound data to determine second sound signatures;

identifying expected second sound signatures of the outdoor unit;

comparing the second normalized outdoor unit sound data to the expected second sound signatures;

in response to determining that an expected sound signature for a reversing valve is missing from the second normalized outdoor unit sound data, determining that the reversing valve has failed; and sending a fifth notification to the user device that the reversing valve has failed.

14. The method of claim 13, further comprising:

in response to determining that the expected sound signature for the reversing valve is not missing from the second normalized outdoor unit sound data:

in response to determining that the expected sound signature for the reversing valve is different from a respective sound signature of the reversing valve determined from the second normalized outdoor unit sound data, determining that the reversing valve is malfunctioning; and sending a sixth notification to the user device that reversing valve is malfunctioning.

15. A non-transitory computer-readable medium storing instructions that, when executed by one or more processors, cause the one or more processors to:

send a first instruction to a thermostat to shut down a heating, ventilation, and air conditioning (HVAC) system;

instruct a user to minimize background noise;

instruct the user to go to an outdoor unit of the HVAC system;

instruct the user to capture an image of a nameplate of the outdoor unit;

analyze the image to determine a distance of the user from the outdoor unit;

compare the distance to a distance range;

in response to determining that the distance is within the distance range, capture baseline sound data for a first time period;

send a second instruction to the thermostat to turn on the HVAC system;

determine a value of a room temperature;

send a third instruction to the thermostat to set a temperature setpoint below or above the value of the room temperature;

capture first outdoor unit sound data for a second time period;

subtract the baseline sound data from the first outdoor unit sound data to determine first normalized outdoor unit sound data;

analyze the first normalized outdoor unit sound data to determine first sound signatures;

identify expected first sound signatures of the outdoor unit;

compare the first normalized outdoor unit sound data to the expected first sound signatures;

in response to determining that an expected sound signature for a compressor is missing from the first normalized outdoor unit sound data, determine that the compressor has failed; and send a first notification to the user device that the compressor has failed.

16. The non-transitory computer-readable medium of claim 15, wherein the instructions, when executed by the one or more processors, further cause the one or more processors to:

in response to determining that the expected sound signature for the compressor is not missing from the first normalized outdoor unit sound data:

in response to determining that the expected sound signature for the compressor is different from a respective sound signature of the compressor determined from the first normalized outdoor unit sound data, determine that the compressor is malfunctioning; and send a second notification to the user device that compressor is malfunctioning.

17. The non-transitory computer-readable medium of claim 16, wherein the instructions, when executed by the one or more processors, further cause the one or more processors to:

in response to determining that the expected sound signature for the compressor is not different from the respective sound signature of the compressor determined from the first normalized outdoor unit sound data:

in response to determining that an expected sound signature for an outdoor fan is missing from the first normalized outdoor unit sound data, determine that the outdoor fan has failed; and send a third notification to the user device that the outdoor fan has failed.

18. The non-transitory computer-readable medium of claim 17, wherein the instructions, when executed by the one or more processors, further cause the one or more processors to:

in response to determining that the expected sound signature for the outdoor fan is not missing from the first normalized outdoor unit sound data:

in response to determining that the expected sound signature for the outdoor fan is different from a respective sound signature of the outdoor fan determined from the first normalized outdoor unit sound data, determine that the outdoor fan is malfunctioning; and send a fourth notification to the user device that the outdoor fan is malfunctioning.

19. The non-transitory computer-readable medium of claim 18, wherein the instructions, when executed by the one or more processors, further cause the one or more processors to:

in response to determining that the expected sound signature for the outdoor fan is not different from the respective sound signature of the outdoor fan determined from the first normalized outdoor unit sound data:

determine that the outdoor unit operates properly; and send a fifth notification to the user device that the outdoor unit operates properly.

20. The non-transitory computer-readable medium of claim 18, wherein the instructions, when executed by the one or more processors, further cause the one or more processors to:

in response to determining that the expected sound signature for the outdoor fan is not different from the respective sound signature of the outdoor fan determined from the first normalized outdoor unit sound data:

in response to determining that the temperature setpoint is less than the value of the room temperature:

send a fourth instruction to the thermostat to set the temperature setpoint above the value of the room temperature;

capture second outdoor unit sound data for a third time period;

subtract the baseline sound data from the second outdoor unit sound data to determine second normalized outdoor unit sound data;

analyze the second normalized outdoor unit sound data to determine second sound signatures;

identify expected second sound signatures of the outdoor unit;

compare the second normalized outdoor unit sound data to the expected second sound signatures;

in response to determining that an expected sound signature for a reversing valve is missing from the second normalized outdoor unit sound data, determine that the reversing valve has failed; and send a fifth notification to the user device that the reversing valve has failed.

* * * * *